US007572303B2

(12) United States Patent
Orr

(10) Patent No.: US 7,572,303 B2
(45) **Date of Patent: *Aug. 11, 2009**

(54) FUEL COMPOSITIONS EXHIBITING IMPROVED FUEL STABILITY

(75) Inventor: William C. Orr, Denver, CO (US)

(73) Assignee: Octane International, Ltd., Denver, CO (US)

( * ) Notice: Subject to any disclaimer, the term of this patent is extended or adjusted under 35 U.S.C. 154(b) by 560 days.

This patent is subject to a terminal disclaimer.

(21) Appl. No.: 10/722,063

(22) Filed: Nov. 24, 2003

(65) Prior Publication Data

US 2004/0237384 A1 Dec. 2, 2004

Related U.S. Application Data

(63) Continuation-in-part of application No. 08/986,891, filed on Dec. 8, 1997, now Pat. No. 6,652,608.

(51) Int. Cl.
*C10L 1/18* (2006.01)

(52) U.S. Cl. ..... 44/387; 44/320; 44/354; 44/359; 44/360

(58) Field of Classification Search ..... 44/314, 44/320, 354, 359, 360, 387
See application file for complete search history.

(56) References Cited

U.S. PATENT DOCUMENTS 2,331,386 A * 10/1943 Gaylor ..... 44/387

* cited by examiner

*Primary Examiner*—Cephia D Toomer
(74) *Attorney, Agent, or Firm*—Hogan & Hartson LLP

(57) ABSTRACT

A fuel composition of the present invention exhibits minimized hydrolysis and increased fuel stability, even after extended storage at 65° F. for 6-9 months. The composition, which is preferably not strongly alkaline (3.0 to 10.5), is more preferably weakly alkaline to mildly acidic (4.5 to 8.5) and most preferably slightly acidic (6.3 to 6.8), includes a lower dialkyl carbonate, a combustion improving amount of at least one high heating combustible compound containing at least one element selected from the group consisting of aluminum, boron, bromine, bismuth, beryllium, calcium, cesium, chromium, cobalt, copper, francium, gallium, germanium, iodine, iron, indium, lithium, magnesium, manganese, molybdenum, nickel, niobium, nitrogen, phosphorus, potassium, palladium, rubidium, sodium, tin, zinc, praseodymium, rhenium, silicon, vanadium, or mixture, and a hydrocarbon base fuel.

8 Claims, No Drawings

FUEL COMPOSITIONS EXHIBITING IMPROVED FUEL STABILITY

This application is a continuation-in-part of U.S. patent application Ser. No. 08/986,891 filed Dec. 8, 1997, now U.S. Pat. No. 6,652,608.

FIELD OF THE INVENTION

The present invention relates to enhanced structured fuel compositions for use in jet, turbine, diesel, gasoline, and other combustion systems. More particularly, the present invention relates to fuel compositions using viscous hydrocarbons, which are substantially neutral pH;, and which employ a silicon based combustion catalyst.

BACKGROUND OF THE INVENTION

International patent application Nos. PCT/US95/02691, PCT/US95/06758, and PCT/US96/09653, are incorporated in their entirety herein by reference, and disclose fuel compositions and combustion techniques for achieving vapor phase combustion based on an enhanced combustion structure ("ECS"). This enhanced combustion structure includes a combustible metallic and free radical generating oxygenated compound. It has been found that such free radical generating oxygenates include C2-C12 aldehydes, aldehydic acids, C2-C12 ethers, C1-C15 alcohols, C2-C12 oxides, C3-C15 ketones, ketonic acids, C3-C15 esters, othroesters, C3-C12 diesters, C5-C12 phenols, C5-C20 glycol ethers, C2-C12 glycols, C3-C20 alkyl carbonates, C3-C20 dialkyl carbonates, C3-C20 di-carbonates, C1 to C20 organic and inorganic peroxides, hydroperoxides, carboxylic acids, amines, nitrates, di-nitrates, oxalates, phenols, acetic acids, boric acids, orthoborates, hydroxyacids, orthoacids, anhydrides, acetates, acetyls, formic acids, nitrates, di-nitrates, nitro-ethers, which can meet minimum burning velocity (BV) and latent heats of vaporization (LHV) requirements of aforementioned PCT Applications. Specific compounds can be found in detail in Organic Chemistry 6 th Ed, T. W. G. Solomons, John Wiley & Sons, N.Y., (1995), Physical Chemistry, 5 th Ed, P. W. Atkins, Oxford University Press, U.K. (1994), Physical Organic Chemistry, 2 Ed, N. S. Issacs, John Wiley & Sons, N.Y. (1995) and Lange's Handbook of Chemistry, 14 th Ed, J. A. Dean, McGraw-Hill, N.Y. (1992), and their minimum BV/LHV requirements in aforementioned PCT Applications, which are herein by incorporated by reference.

Said enhanced combustion structure oxygenates, when in combination with a combustible non-lead metal or non-metal (as set forth below), exhibit high heats of enthalpy capable, improved combustion, thermal efficiency, fuel economy, and power. Of particularly interest to this invention are the enhanced combustion struture oxygenates of symmetrical dialkyl carbonates, especially dimethyl and diethyl carbonates.

However, it has been reported symrrietrical dialkyl carbonates, such as dimethyl carbonate can be problematical fuel additives due to their potential instability in fuel compositions, which can result in undesired hydrolysis in acidic and aqueous environments. See EPO Application #91306278.2 Karas. Thus, it would be reasonable to expect fuels containing lower dialkyl carbonates to store and perform optimally only when in moderately strong or strongly alkaline environments, i.e., pH's exceeding 11 or more. Fuels-having pH's lower than 11, e.g. moderately alkaline, nuetral and acidic would be expected to be problematic.

In addition, conventional thinking and regulatory standards encourage the utilization of more refined less viscous base fuel hydrocarbons. The longer chain or more complex hydrocarbons, e.g., heavy oils, heavy fuel oils, diesels, etc., are typically not preferred as fuels due to handling, emission and combustion concerns.

SUMMARY OF THE INVENTION

A primary object of the present invention is the development and utilization of fuels having enhanced combustion structure which have increased stability. A further object of the present invention is the development of enhanced combustion structured in which the base fuel may be more viscous, or not as highly refined, as now required to meet minimum fuel standards. A further object is the employment of a co-metallic catalyst, which further enhances the combustion structure of the DMC and metal/non-metals component, further improving thermal efficiency, fuel economy, power and emissions.

In accordance therewith, the substantially non-alkaline fuel compositions of the present invention exhibits improved stability, with no apparent hydrolysis after storage for six months or more. In addition, the presence of lower dialkyl carbonates and metals in the fuel compositions of the present invention allows for the use of-highly viscous base fuels.

The improved fuels described herein contain a base hydrocarbon fuel or propellant (including hydrogen) co-fuel, as provided in the PCT applications referenced above. Such co-fuels may be viscous, moderately viscous, or highly viscous (e.g. having viscosities outside industry standards). Said viscous fuels are combined with high energy non-lead metallic or non-metallics (presented below), together with symmetrical dialkyl carbonates, e.g., dimethyl or diethyl carbonate, and preferably a silicon co-metallic combustion catalyst. When the fuel compositions of the present invention are then constructed to a weakly alkaline (7.5 to 11.0 pH), substantially neutral (6.5 to 7.5 pH), or acidic (4.5 to 6.5 pH), whether or not water is present, they exhibit improved stability with no substantial hydrolytic propensity.

DETAILED DESCRIPTION OF THE PRESENT INVENTION

The improved fuel composition of the present invention includes an alkyl carbonate (dimethyl and/or diethyl carbonate) a metal or non-metallic compound, more fully described below, and optionally a silicon catalyst, co-fuel(propellant), and/or oxidizer. So long as the composition is not strongly alkaline, i.e., has a pH of from 3.0 to about 10.5, hydrolysis of the fuel composition is avoided. A desirable pH range of the fuel composition of the present invention is from approximately 4.5 to approximately 10.5, with a more desirable pH range of from approximately 4.5 to approximately 9.5. An even more desireable pH range is from approximately 4.5 to 9.0. Another highly preferred pH range is from approximately 5.5 to 8.0. A preferred pH range is from approximately 4.5 to approximately 6.5. The most preferred pH range for the fuel composition of the present invention is from approximately 6.3 to approximately 6.8.

When the pH of the fuel composition of the present invention is less than 11.0, preferably 10.5 or below, 9.5 or below, and more preferably 8.5 or below, the fuel, whether anhydrous or hydrous, may be stored at ambient temperature for up to 6 six months without substantial apparent hydrolysis.

For example, Fuel A containing 5% by volume dimethyl carbonate, 95% by volume unleaded regular grade commercially available 87 octane (R+M)/2, ⅛ gram Mn/gal of methylcyclopentadienyl manganese tricarbonyl, a pH of 7.0, and 5% by volume of water, was stored for six months, the fuel exhibited no apparent hydrolysis.

When such fuel composition was titrated with acetic acid to a pH of 6.4, still containing 5% by volume of water (Fuel B) and was then stored for six months, the fuel exhibited no apparent hydrolysis.

However, when a fuel composition containing dimethyl carbonate and cyclopentadienyl manganese tricarbonyl was prepared with a pH of approximately 11, contained 5% by volume of water and was stored for six months, the fuel showed slight evidence of hydrolysis. The same fuel at a pH of 12.5, however, showed stronger evidence of hydrolysis.

It should be appreciated that although acetic acid was used to acidify the pH of the fuel in the present case, many other fuel soluble acids, including but not limited to benzoic acid derivatives e.g. 2,4-dimethyl benzoic acid, methyl red, p-tert-butylbenzoic acid, 2-(1-methylethyl)benzoic acid, benzoic acid anhydride, 4-benzoyl benzoic acid, 2,4-dihdroxy benzoic acid, 2,4-dimethyl-benzoic acid, 3-ethoxy benzoic acid, 2-hydroxy-4-methyl benzoic acid, 2-hydroxy benzontrile, 4-methoxy benzotrile, acetic acid derivatives, e.g. anhydride acetic acid, chloroacetic acid, decyl ester acetic acid, dibromoacetic acid, and the like, may be employed. See for example CRC Handbook of Chemistry and Physics, 75 th Ed, Lide, CRC Press (1994-1995) "Dissociation Constants for Inorganic Acids and Bases," and "Dissociation Constants for Organic Acids and Bases," incorporated herein by reference.

Naturally, acidic fuel components, which are indigenous to the either the base fuel composition, e.g. individual fuel components, metallic, DMC, or an additional ECS component (e.g. aldehydic acids, ketonic acids, carboxylic acids, hydroxyacids, orthoacids, formic acids, and the like) are desireable, and should be employed/modified first to achieve minimum pH's, prior to addition of an additive acid. Thus, the pH of the composition may be tailored using normal hydrocarbon fuel components, dialkyl carbonates, and metallic(s) to achieve requisite pH. However, individual circumstances will dictate proper approach and additive acids are contemplated.

Naturally, acidic metals of this invention may be used individually and/or in conjunction with one or more other metallics to reduce pH. Non-limiting examples of such acidic metallics include binary, ternary and higher metallic acid salts, hydroxy acids, etc. Other non-limiting compounds are set forth below and include for example, oxamic acid, lithium acetate acid, lithium salt acetic acid, propanoic acid lithium salt, cyclohexanebutyric acid lithium salt, aminobenzole acid lithium salt, borate ester, dimethyl borate, di-n-butyl borate, dicyclohexyl borate, didodecylborate, di-p-cresyl borates, boric acids, orthoborates, henylboronic acid, diphenylboronic acid, o-tolylboronic acid, p-tolylboronic acid, m-tolylboronic acid, cylohexylboronic acid, cylohexenylboronic acid, cyclopentylboronic acid, methylphenylboronic acid, methylcylohexyl-boronic acid, methylcyclopentylboronic acid, methylbenzylboronic acid, dimethylphenylboronic acid, dimethylcylohexylboronic acid, dimethylcyclopentylboronic acid, dimethylbenzylboronic acid, diphenylboronic acid, dibenzylboronic acid, dicylohexylboronic acid, dicylohexenylboronic acid, dicyclopentylboronic acid, mgethyldiphenylboronic acid, bis[(methyl)cylohexyl]boronic acid, bis[(methyl)cyclopentyl]boronic acid, bis[(methyl)benzyl] boronic acid, bis[(dimethyl)phenyl]boronic acid, bis[(dimethyl)-cylohexyl]boronic acid, bis[(dimethyl)cyclopentyl] boronic acid, or bis[(dimethyl)benzyl]boronic acid. Many other acidic metallics are set forth below and contemplated.

If an additive acid is employed, it is preferred it be compatible with the base fuel and have low toxicity, low corrosivity, and be as envirnomentally friendly as possible.

PCT/US95/02691 and PCT/US95/06758 disclose compositions and methods achieving vapor phase combustion employing symmetrical dialkyl carbonates and certain non-leaded high energy metals and non-metals (herein "metals"). It has been discoveredin the construction of a fuel composition, which employs one metal or a mixture of metals, together with at least one C3 to C13 dialkyl symmetrical carbonate, as taught therein, improved fuel stability can be obtained when the pH is kept as close to neutral as possible, such that if alkaline, it is only weakly alkaline (i.e., preferably equal or less than 11.0, 10.5, 10.0, 9.5, 9.0, 8.5, 8.0 pH), but that it preferably be either substantially neutral (i.e., 6.5 to 7.5) or slightly acidic (6.3 to 6.9 pH).

Anhydrous fuels or substantially anhydrous fuels are contemplated and particularly preferred when employing water reactive group Ia, IIa, IIb, IIIA metals and derivative compounds. Other circumstances will require anhydrous fuels as well, e.g. jet aviation applications, etc. Although anhydrous fuels are preferable, when the fuel compositions of the present invention have a pH in the preferred range of from approximately 10.5 to 4.5, there is no apparent hydrolysis, even when such fuels include an aqueous layer. When the pH of the fuel composition is in the preferred range, the composition may contain water up to 10.0% by volume of the fuel with no apparent hydrolysis of the organic phase after six months of storage.

It should be appreciated in the practice of this invention and the examples set forth herein, it is only required that a hydrocarbon fuel containing a lower dialkyl carbonate have a pH of less than 10.5. The addition of metals or non-metals herein, co-metallics, viscous hydrocarbons are further embodiments, and not necessary elements to this aspect of the invention. Thus, the claims below may reflect only a hydrocarbon fuel containing a lower dialkyl carbonate having a pH of less than 10.5, absent any additional limitation. As example, a composition of this invention includes a hydrocarbon base together with dimethyl carbonate or diethyl carbonate, said composition adjusted such that its maximum pH is 10.5 of less, a more preferred pH is 6.8 or less.

Acidity level of fuels is sometimes measured in terms of equivalents, e.g., equivalents of KOH required to neutralize the fuel composition. The fuels of the present invention show improved operation at acidity levels which are 100%, 150%, 200%, 300%, or more, above such standards. Acidity levels below such standards, including those at least 50% less, are expressly contemplated. Also by way of example, when the fuel compositions of the present invention are used in jet turbine engines, such fuels typically must meet ASTM D 1655 specifications (incorporated herein by reference) or other international specifications, including maximum acidity levels ASTM D 3242 and IP 354 standards. However, it is believed that the increased efficiency of the fuels of the present invention are less destructive to engines during combustion, and operation with lower pH's than presently acceptable. International, industry and government fuel standards, including ASTM, IP, GOST, DERD, MIL, AN, U.S. Clean Air Act, California Air Resources Board, and Swedish/European EPEFET standards, etc., governing hydrocarbon fuels containing applicant's alkyl dicarbonates/metal are incorporated herein by reference.

When the fuel compositions of the present invention have a pH in the desired range of from approximately 4.5 to 11.0, stability is maintained and hydrolysis is substantially avoided so long as fuel storage temperature is at or below 90° F.

Preferably, the fuel compositions of the present invention have pH's less than 10.5 and are stored at or below 65° F. When Fuels A and B, described above,were stored at 65° F. during the period from 6 months after mixing to 9 months after mixing, fuel stability was maintained without apparent hydrolysis.

In addition to the preferred pH ranges described above, it is further contemplated that Applicant's pH adjusted hydrocarbon based fuels will additionally contain known additive, including but not limited to antioxidants, co-solvents, metal deactivators, detergents, dispersants, corrosion inhibitors, mutual solvents, oxygenated anti-knock compound (e.g. hydrocarbyl ethers, alcohols, etc.), other additive, and additive set forth in incorporated PCT Applications. Said known additive is incorporated herein by reference.

A preferred fuel of the present invention comprises 1) dimethyl carbonate or dimethyl carbonate, representing 0.1% to 99.5% wt of composition; 2) at least one metal as set forth below, representing 0.01% to 99.5% wt of composition; optionally a metal deactivator representing 0.00001% to 10.0% wt of composition, or an, antioxidant representing 0.00001% to 10.0% wt, or a detergent/dispersant representing 0.00001% to 10.0% wt, or an ignition promoter representing 0.000001% to 20.0% wt, or a demulsifier representing 0.00001% to 10.0% wt, or a co-solvent or salt representing 0.000001% to 40.0% wt, or a hydrocarbon representing 0.1% to 99.0% volume of the composition, or a silicon based combustion catalyst (described below) representing 0.000001% to 80.0% wt, or mixture. Said fuel is constructed with a pH no greater than 11.0 or 10.5, and preferrably. less than 9.5. More preferably, the pH is from 6.3 to 6.8. When such fuel is a jet aviation turbine hydrocarbon based-fuel, preferred acidity does not exceed equivalent of 0.1 mg KOH/g.

As described in the aforementioned PCT applications, the presence of a co-solvent is also preferred, so long as pH is maintained. Co-solvents that enhance mutual solubility of fuel components, fuel stability, water tolerance are preferred (e.g. C1 to C12 alcohols alkanolamines, etc.). These are known in the art and incorporated herein by reference. Additionally, co-solvents that increase flash point or reduce vapor pressure are contemplated. Non-limiting examples include, ethanetriols, propanetriols, butanetriols, 1,2,3 butanetriol, pentanetriols, 1,2,3 pentanetriol, 2,3,4 pentanetriol, hexanetriols, septanetriols, octanetriols, or tertraethylene glycol, triethylene glycol, 1-octene, high flash point ketone, naphthalenes, triethylene glycol, trimethylene glycol, isopropyl acetone, diisopropyl acetone, diisopropyl diacetone, diethylene acetate, diethylene diacetate, ethylene acetate compound, phenol, or other flash point temperature reducing co-solvent set forth in aforementioned PCT Applications. Co-solvents should not be corrosive or hazardous to fuel systems.

It is desirable the resultant fuel be constructed to have an average latent heat of vaporization (LHV) no less than typical industry standards. Prefered LHV's are generally greater. For example, the latent heat of vaporization or enthalpy of vaporization (vapH(Tb)/kJ mol-1) for commercial grade diesel, gas turbine, or fuel oils range from about 90 to 105 btu/lb (at 60° F.) or 18 to 21 jK/mole or (at boiling temperatures). Likewise, commercial motor gasolines have a LHV ranging from 135 to 145 btu/lb or 27 to 29 jK/mole, aviation gasolines about 130 to 150 btu/lb or 26 to 30 jk/mole; and aviation jet fuels about 105 to 115 btu/lb or 21 to 23 jK/mole.

Thus, it is preferred that the LHV for commercial grade diesel, gas turbine, or fuel oils at 60° F. exceed 105 btu/lb or 21 jK/mole (at boiling temperatures), for-commercial motor gasolines LHV's should exceed 145 btu/lb or 29 jK/mole, for aviation gasolines LHV's should exceed 150 btu/lb or 30 jk/mole, and for aviation jet fuels LHV's should exceed 115 btu/lb or 23 jK/mole. LHV's at least 2%, 5%, 10%, 20%, 30% or greater than these amounts are however preferred.

The burning velocities (as measured by laminar Bunsen burner flame) for commercial grade diesel, gas turbine, and fuel oils range from about 35-37 cm/sec, kerosine about 36 cm/sec, automotive gasoline about 47-50 cm/sec, aviation gasoline about 45-47 cm/sec, aviation jet fuels about 36-38 cm/sec. Methanol is reported at 57.2 cm/sec. Thus, in Applicant's fuels it is desireable that burning velocities for commercial grade diesel, gas turbine, and fuel oils exceed 37 cm/sec, kerosine exceed 36 cm/sec, automotive gasoline exceed 50cm/sec, aviation gasoline exceed 47 cm/sec, and aviation jet fuels exceed 38 cm/sec. However, BV's at least 2%, 5%, 10%, 20%, 30%, or greater than above speeds are preferred.

It is also desirable that the hydrocarbon based fuels have high possible allowable densities. High densities of base fuels permit higher concentrations of metallics and dialkyl carbonates. For example, aviation turbine densities equal or exceeding 841 kg/m3 @ 15° C. are contemplated. More generally, the fuel compositions of the present invention allow for base fuel densities of from 840 to 1200 kg/m3 @ 15° C., and even 900 to over 1200 kg/m3 @ 15° C. Moderate, low, to very low densities are also contemplated so long as the increased burning velocity object of above PCT Applications is accomplished and a pH is not greater than 10.5, preferably below 9.0, and most preferably from 6.3 to 6.8 is maintained.

Moreover, highly viscous hydrocarbon fuel bases with viscosities above fuel specification, are unexpectedly brought to within fuel viscosity limits by the addition of dialkyl carbonates and metal. For example, is has been foundi;that a diesel fuel oil having a viscosity of 2.6 mm2/S at 40° C. was acceptably combined with dimethyl carbonate representing 5% volume of the composition, and 2.0 grs Mn/gal of methylcyclopentadienyl manganese tricarbonyl (MMT). The resultant fuel composition had a lower viscosity of 2.4 mm2/S at 40° C. In this way, highly viscous fuels can be adapted by the addition of applicant's ingredients, whereby non-conforming highly viscous fuels can be made less viscous and brought into compliance with ASTM or other specification (herein incorporated by refererence).

Also by way of, example, Jet A hydrocarbon bases having a viscosity of 8.1 to 15.0 or more, (ASTM 445) can be adapted to meet the current 8.0 mm2/sL at −20° C. standard by addition of the components described above. Alternatively, base fuel viscosity of from 13.5 to 23.0 Cs at −30° F., or more, may be met by the addition of the components described above.

Similarly, a gas oil turbine hydrocarbon base may have maximum kinetic viscosities at 40° C. equal or exceeding 2.45 to 7.0, or greater, mm2/s for ASTM D 445 No. 1-GT fuels, and be adapted to meet the 2.4 standard, by addition of the components described herein. Alternatively, base fuel kinetic viscosities of 4.15 to 6.0, or more, mm2/s for ASTM D 445 No. 2-GT fuels, may be adapted to meet the 4.1 standard by addition of applicantþs additives, as described herein.

In an analogous manner, a diesel fuel oil base may have maximum kinetic viscosities at 40° C. equal or exceeding 2.45 to 7.0, or greater, mm2/s for ASTM D 445 low sulfur or regular No. 1-D fuels, and be adapted to meet the 2.4 standard by addition of applicantþs additives. Alternatively, a diesel fuel oil base having maximum kinetic viscosities of 4.15 to 9.0 or more, mm2/s for ASTM D 445 low sulfur or regular No. 2-D fuels, and be adapted to meet the 4.1 standard, by addition of applicantþs additives. Similarly, fuels having a maximum kinetic viscosity of 24.5 to 60.0 ore more mm2/s for ASTM D 445 No. 4-D fuels, and be adapted to meet 24.0 by addition of applicantþs additives. Additionally, a low emission diesel base may have viscosities exceeding 2.45 to 5.5, or more, cSt at 40° C. (where 1 mm2/s=1 cSt), and be adapted to meet the 2.4 standard.

Furthermore, a fuel oil base may have kinetic viscosities equal or exceeding 2.15 10.0, or more, mm2/s at 40° C. ASTM D 445 for No. 1 fuels, and can be adapted to the 2.1 standard by addition of applicantþs additives. A fuel base having kinetic viscosities of from 3.45 to 10.0, or more, mm2/s at 40° C. ASTM D 445 for No. 2 fuels can be similarly adapted to meet 3.4. A fuel base having kinetic viscosities of 5.55 to 25.0 or more, mm2/s at 40° C. ASTM for D 445 No. 4 fuels (Light), may be similarly adapted to meet 5.5. A fuel base having kinetic viscosities of from 24.5 to 40.0, or more, mm2/s at 40° C. ASTM D 445 for No. 4 fuels (regular), may be adapted to meet 24. A fuel base having kinetic viscosities of from 8.95 to 25.0, or more, mm3/s at 100° C. ASTM D 445 for No. 5 fuels (Light), may be adapted to meet 8.9. A fuel base having kinetic viscosities of from 15.0 to 30.0, or more, mm3/s at 100° C. ASTM D 445 for No. 5 fuels (Heavy), may be adapted to meet 14.9. A fuel base having kinetic viscosities of from 50.5 to 80.0, or more, mm3/s at 100° C. ASTM D 445 for No. 6 fuel oils, and adapted to meet 50.0.

Similarly, a heavy diesel, locomotive or marine engine base fuel, exceeding ISO DIS 8217, BS MA 100, government and/or other industry viscosity specifications, but adapted to meet such standards (incorporated by reference), typically uncorrected viscosity exceeds such standards by 1.0, 2.0, 10.0, 50.0, or more centistokes at 50° C. Applicant has discovered by incorporating his lower dialkyl carbonates and metals, fuels having excessive viscosities can meet government, or other viscosity standards.

By way of further example, an enhanced combustion aviation turbine fuel composition of the present invention includes a symmetrical alkyl dicarbonate, preferably dimethyl carbonate, a metal, an aviation turbine hydrocarbon base having a viscosity of from 8.1 to 9.0 MM2/S (ASTM 445); optionally one or more of the following: a salt, a co-solvent, antioxidant, freeze point additive, anti-icing additive, metal deactivator, corrosion inhibitor, hydroscopic control additive, lubricity agent, lubricant or friction modifier, anti-wear additive, combustion chamber or deposit control additive, any other recognized additive, additive disclosed in aforementioned PCT Applications, or mixture thereof. The resultant fuel is characterized as being slightly alkaline, substantially neutral or acidic, and having a maximum viscosity equal or less than 8.2 MM2/SI (ASTM 445). The fuel preferably has a density of from 840.5 to 850, or greater, kg/m3 @ 15° C., a flash point of at least 38° C., a maximum vapor pressure of 21 kPa @ 38° C., minimum thermal stability meeting ASTM D 1655 standards, a heat of combustion or equivalent equal to or excdlding 42.8 MJ/kg (lower heats of combustion are contemplated, including those less than or equal to 42.5, 42, 41, 40, 39, 38, 37, 36 MJ/kg, based upon additive heats of individual components), and a maximum freezing temperature of from −40 to −50° C., optionally a LHV not less than 115 btu/lb or 23 jK/mole, optionally a burning velocity exceeding 37 cm/sec.

A diesel fuel composition of the present invention includes dimethyl carbonate representing 0.01% to 40.0% oxygen by weight of the fuel; a compound or element containing a combustion improving amount of transition metal, alkaline metal, alkaline earth, group IIIa, IVa, Va, VIa, VIIa element or derivative compound, or mixture, optionally in an concentration of 0.001 to about 100.0 gr element/gal, preferably 2.0 to 20.0 gr element/gal; and a No. 1 (ASTM) diesel fuel base having a viscosity of from 2.45 to 3.0, MM2/S at 40° C.; said fuel base optionally characterized as having one or more of the following: a density ranging from 880 to 800 kg/m3, a cetane index of 40 to 70, an aromatic content by vol. ranging from approximately 0 to 35%, prefereably 0% to 10%, provided that 3-ring+aromatics not to exceed 0.16 volume %; a T10 fraction temperature of about 190 to 230° C., a T 50 fraction temperature of about 220 to 280° C., a T90 fraction of about 260 to 340° C., a cloud point temperature of ° C. −10, −28, −32 or 6° C. above tenth percentile minimum ambient temperature, a sulfur content preferably not greater than 250 ppm, more preferably not greater than 50 ppm, most preferably not exceeding 5 ppm, a bunsen laminar burning velocity of at preferably greater than 37, more preferably greater than 44, most preferably 50 ore more, cm/sec, a latent heat of vaporization of preferably at least 105, more preferably at least 120, most preferably 130 or more, BTU/lb. The resultant fuel is characterized as having a pH less than 10.5 and a viscosity equal to or less than 2.4 MM2/S at 40° C., optionally a LHV at 60° F. equal or in excess of 105 btu/lb or 21, 22, 23, 25, 27 jK/mole (at boiling temperatures), optionally a minimum laminar bunsen burner flame of 37, 39, 40, 41 cm/sec.

An aviation gasoline fuel composition of the present invention includ,es a dialkyl carbonate, a metal and an aviation gasoline base. The resultant fuel is characterized as having a pH less than 7.0 and a minimum octane or performance number of from 87 to 130 (ASTM 909). It is further characterized as having a distillation fraction wherein the sum of the T-10 plus T-50 fractions are 307° F., the T-40 temperature is 167° F. and the T-90 temperature is less than 250° F., a maximum sulfur content of 0.05 wt %, or sulfur free, a latent heat of vaporization preferably exceeding 120, more preferably exceeding 150, most preferably exceeding 160 BTU/lb, a laminar bunsen burning velocity preferably equal to or in excess of 40, more preferably greater than 48, most preferably greater than 52 cm/sec, a heat of combustion (as measured by the sum of fuel ingredients) equal or less than 43.0 kJ/kg, or equal or less than from 18,720 to 15,000, or less, BTU/lb.

A gasoline composition of the present invention includes an dialkyl carbonate, a metal and an unleaded base fuel composition. The resultant composition is characterized as having a pH less than 10.5, and optionally being phosphorus free hydrocarbons, a maximum Reid Vapor Pressure of from 6.0 to 12.0 psi, 6.0 to 10 psi, 6.0 to 9.0 psi; a maximum of 12% to 5.0% by volume, or less of olefins, a maximum of 30% to 20% or less by volume of aromatics (more preferably 15% to 10%, or less), a maximum of 2.0% to 0.8% or less benzene, a maximum of 40 ppm sulfur, most preferably sulfur free, a total O2 concentration ranging of 0.5% to 10.0% wt of dimethyl carbonate, a manganese tricarbonyl compound at 1/64 to 3/16 gr. Mn/gal (preferably 1/32 gr. Mn) or other metallic in a combustion improving amount, a maximum T-90 temperature of 330° F. to 280° F., a T-50 temperature of approx. 170° F. to 230° F., 175° F. preferred, a minimum (R+M)/2 octane of 85, to 92, a bromine number of 20 or less, an average latent heat of vaporization of 880 to 920, or more, BTU/gal at 60° F.; a heating value greater than 106,000 btu/gal at 60° F. (more preferably greater than 108,000, 114,000 btu/gal), as measured by the sum of individual fuel substituents.

Another gasoline composition of the present invention includes an dialkyl carbonate, a metal and an unleaded base fuel composition, characterized as having a pH less than 10.5, and optionally characterized as having one or more of the following: being phosphorus free hydrocarbons, with a maximum Reid Vapor Pressure of 12.0 psi, a maximum of 12% olefins, a maximum of 30% aromatics, a maximum of 2.0% benzene,ia maximum of 50 ppm sulfur or sulfur free, a total O2 concentration ranging from 0.5% to 10.0% wt of dialkyl carbonate, a combustible metal or non-metal selected from groups set forth below including (but not limited to) those consisting of the preferred manganese, silicon, potassium, and iron compounds, or mixture, a maximum T-90 temperature of 330° F. to 280° F., a T−50 temperature of approx. 170° F. to 230° F., a minimum (R+M)/2 octane of 85, to 92, a bromine number of 20 or less, an average latent heat of vaporization of 880 to 920 BTU/gal at 60° F., a heating value greater than 106,000btu/gal at 60° F. (as measured by the sum of individual fuel, substituents), a burning velocity exceeding 50 cm/sec, a latent heat of vaporization exceeding 29 jK/mole (or equivalent).

In the practice,of this invention it is contemplated at least one combustible reactive non-lead transition metal, alkaline metal, alkaline earth, group IIIa, IVa (except carbon), Va, VIa (except oxygen), VIIa element, or derivative thereof, as set forth herein, or mixture (herein referred to as "metal" or "metallic") be together with at least one C3 to C13 symmetrical dialkyl ester of carbonic acid, and-mixture, in a fuel stable composition; said composition optionally containing a combustion catalyst as set forth below, a hydrocarbon, and/or an oxidizer; resultant composition as having a pH slightly alkaline, neutral or acidic.

Non-limiting exampjes of suitable dialkyl carbonates include, dimethyl carbonate, diethyl carbonate, dipropyl carbonate, diisopropyl carbonate, dibutyl carbonate, diisobutyl carbonate, ditertiary butyl. carbonate, diisoamyl carbonate, methyl ethyl carbonate, diphenyl. carbonate, or mixture. C3 to C8 symmetrical dialkyl carbonates are more desirable, with C3 to C5 being preferred. It is contemplated that such carbonates will be introduced into the composition in concentrations of 0.01 to 100.0 volume percent in an amount sufficient to improve combustion. The carbonates may be additionally combined with one or more oxygenated compounds, including but not limited to alkyl butyl ethers (e.g. MTBE, ETBE, TAME, ETAME, etc.), alkyl alcohols, and/or known co-solvents. In the practice of this invention methylal, ethylal, C1 to C6 aliphatic alcohols, may be substituted for dialkyl carbonates, absent compromise of vapor phase combustion.

Non-limiting examples of optional fuel, which may be additionally containred with the dialkyl carbonate and metal, include hydrogen or any hydrocarbon, including but not limited to carbonaceous liquid or solid fuels, alternative fuels, gaseous fuels (including natural gas, methane, ethane, propane, butane, etc.), automotive gasolines, diesel. fuel oils, heavy diesel fuel oils, aviation gasoline, gas oils, fuel oils, aviation jet turbine oils, coal, coal oils, coal liquids, and the like. Industry specifications, including ASTM and all others known in the art, and above PCT Applications, and Criteria for Quality of Petroleum Products, J. P. Allison, 1973 (and subsequent editions), are incorporated herein by reference.

Metals Practice

In the practice of this invention contemplated metallics include all non-lead metals, metalloids, and non-metals (herein "metals" or "metallics"), and their derivative compounds, whose combustion product accomplishes primary object of vapor phase combustion, which is evidenced by a brilliant luminous reaction zone extending some distance from the metal's surface. Such combustion does not take place on the surface of the metal, or on and/or within the molten layer of oxide covering the metal, typical of heretofore metallic combustion. Distinguishing vapor phase combustion is that its combustion is expansive with elevated exhaust velocities, and resultant metallic oxide particles are formed in the submicron range. Typically fuel economy, power output, exhaust emissions, combustion temperatures are materally improved.

Thus, a very wide range of acceptable metals and derivative compounds are contemplated. Group IA (alkali metals), IIA (alkaline earths) elements, the transition elements/metals of group IIIb, IVb, Vb, VIb, VIIb, VIIIb [8, 9, 10], the elements of group Ib, IIb, IIIa, IVa (absent carbon), and group Va, VIa, VIIa elements are contemplated. Non-limiting examples include aluminum, boron, bromine, bismuth, beryllium, calcium, cesium, chromium, cobalt, copper, francium, gallium, germanium, iodine, iron, indium, lithium, magnesium, manganese, molybdenum, nickel, niobium, phosphorus, potassium, palladium, rubidium, sodium, tin, zinc, praseodymium, rhenium, silicon, vanadium, strontium, barium, radium, scandium, yttrium, lanthanum, actinium, cerium, thorium, titanium, zirconium, hafium, praseodymium, protactinium, tantalum, neodyium, uranium, tungsten, promethium, neptunium, samarium, plutonium, ruthenium, osmium, europium, americium, rhodium, iridium, gadolinium, curium, platinum, terbium, berkelium, silver, gold, dysprosium, californium, cadmium, mercury, holmium, titanium, erbium, thulium, arsenic, antimony, ytterbium, selenium, tellurium, polonium, lutetium, and astatine, including their organic and inorganic derivative compounds, which are capable of vapor phase combustion, are contemplated in the claims hereto and incorporated herein by reference. Applicant's metals, including derivative compound, may be organo-metallic or inorganic. Accordingly, the inorganic and organic compounds of CRC Handbook of Chemistry and Physics, Lide, 75 th (1994-1995) and earlier editions, Ann Arbor, CRC Press; Sigma-Aldrich Chemical Directory, Aldrich Chemical Company (1997), Chemical Abstract Service (CAS), on line Registry File [1], American Chemical Society, Chemical Abstract Service, Ohio State University, A Manual of Inorganic Chemistry, Thorpe, N.Y., Putnam & Son's (1896), Inorganic Materials, 2 ed., Ducan, N.Y. J.Wiley & Son (1996), Handbook of Inorganic Compounds, Perry, Phillips, CRC Press, Boco Raton, (1995), Inorganic Chemistry, Phillips, Williams, N.Y. Oxford University Press (1965-1966), Inorganic Materials Chemistry, D. Seneeta, G. E. R & D Center, N.Y., CRC Press (1997), Inorganometallic Chemistry, Fehiner, N.Y., Plenum (1992), Nontransition-Metal Compounds, Eisch, N.Y., Academic Press (1981), Metal & Metalloid Amides, Horwood, N.Y., Halsted Press (1980), Kirk-Othmer Encyclopedia of Chemical Technology, 2 nd and subsequent editions, John Wiley & Sons (1963), Dictionary of Chemical Names & Synonyms, Howard, Neal, Lewis Publishers, Ann Arbor, (1992), Dictionary of Chemical Solubilities, Inorganic, Comey, MacMillian Press (1921), Solubilities of Inorganic and Metal Organic Substances, Seidell, N.Y., Van Nostrand (1940-1941), Solubility of Inorganic and Metal-Organic Compounds, Like, Princeton N.J., Van Nostrand (1958-1965), Organometallics (cite omitted), Organo Metallic Chemistry, F. G. A. Stone, Academic Press (1972 and subsequent years), Organo Metallic Compounds, 2 Ed, Michael Dub, Springer-Verlag, New York Inc. (1966 Vol. 1 to 3, and subsequent volumes/supplments), Organo-metallic Compounds, Coates, Edward, New York, Wiley (1960), Comprehensive Organometallic Chemistry II (A Review of the Literature 1982-1994), Abel, Stone, Wilkinson, El Sevier Science Ltd (1995), Handbook of Organometallic Compounds, Kaufman, D. Van Nostranl Company Inc. (1961), Handbook of Organometallic Compounds, Hagihara, Kumanda, Okawars, W. A. Benjamin Inc (1968), Organometallic Chemistry, Mehrotra, Singh, John Wiley and Sons, (1991), Organometallic Chemistry, Chemical Society (1971 and all subsequent publications), London, Metal-Organic Compounds, American Chemical Society (1959 to present), Chemical Abstracts, American Chemical Society, Chemical Abstract Service, Ohio State University, (From 1907 to present), Structure Reports 1913 to 1973 (Metals and Inorganic Compounds), International Union of Crystallography, Bohn, Scheltena & Hellema (volumes 1-40), The Merck Index, 12 th Ed., Budavari, O'Neil, Merck Research Laboratories, N.J. (1996), which are capable of vapor phase combustion, together with said publications (including all related/subsequent editions, volumes, supplements, updates, or related publications) are incorporated herein by reference.

Cyclomatic compounds are particularly desireable. Non-limiting examples of cyclomatic compounds include compounds with one or more rings systems, including alicylic or aromatic ring systems. Ring systems which may be wholely organic, wholely inorganic, or heterocyclic. Such ring systems may include cyclic borons (borazoles), cyclic silanes (silacyclobutane, 2,4,6,8,10-pentamethylcyclopentasilazane, cyclohexasilanes, cyclopropenyl silanes, etc.), cyclic nitrogens (pyrazoles, pyridines, pyrroles, piperazines, imidazals, etc.), cyclic oxygens (benzoyls, furans, pyrans, e.g. tetrahydropyran, pyrones, dioxins, etc,), cyclic sulfurs (thiophens, dithiles, etc.) or other cyclic inorganics. Cyclomatic organic ring systems include saturated rings (cyclopropyl, cyclobutyl, cyclopentyl, cyclohexyl, cyclooctyl, etc.), unsaturated rings, rings with one or more multiple or double bonds (cyclohexadiene, cyclopentadiene, cyclotetraene, etc.), aromatic rings/cycloalkyl radicals (phenyl, benzyl, styryl, etc.), fused rings, fused aromatic rings (naphthls, naphthenates, etc.), fused ring with cyciopentadienyl moiety, rings containing oxygen or a hydroxyl (phenol, etc.). The disclosed metallic cyclomatics contained in Heterocyclic Chemistry, Katritzy, Boulton, Academic Press (1966 to 1997 all volumes), Benzenoid-Metal Complexes, Zeiss, Wheatley, Winkler, The Ronald Press Co (1966), The Ring Index 2 Ed, Patterson, Capell, American Chemical Society, Reinhold Publishing Corp (1960 and subsequent editions), Ring Enlargement of Organic Chemistry, Hesse, VCH Publishers (1991), Rings, Cluster, and Plymers of Main Group Elements, Cowley, American Chemical Society (1983), which are capable of vapor phase combustion, together with said publications (including subsequent editions, volumes, or supplements), are incorporated herein by reference.

Desireable metal containing cyclomatic compounds are those with cyclic rings having high burning velocities. The higher the burning the velocity, generally the higher the preference. Generally larger rings have higher burning velocities compared to smaller rings. Thus, a cyclooctane ring is preferred over cyclohexane, which is perferred over a cyclobutane ring. Saturated rings are normally more perferred over unsaturated rings. The more saturated the ring the more preferred. Thus, cyclohexane is preferred over benzene. Ring systems where the metal is in turn attached to one or more a hydroxyl, carbonyl, an alkyloxy radicals is preferred.

Non-limiting examples of desireable ring systems/complexes include: cyclohexane, cyclohexene, cyclopentane, cyclobutane, cyclopentadiene, phenyl, benzene, and naphthalene. More desireable are cyclohexane, cyclohexene, and cyclopentadienyl. It is contemplated each elemental metal of this invention can be employed in a cyclomatic compound.

Transition metal ring systems are well known in the art and. highly desireable. See U.S. Pat. Nos. 2,818,416, 3,127,351, 2,818,417, 2,839,552, 2,680, 2,804,468; 3,341,311, 3,272, 606, 3,718,444), Canadian Patent #1073207, European Patent Application #93303488.6, pages 6-8 (1993), incorporated herein by reference.

As contemplated herein, attachment may be direct or indirect. Attachment may be via molecular bond, ionic bond, coordination bond or other bond known in the art. Indirect attachment may be via one or more radical or element, or be via other bond as described below or known in the art. See The Chemistry of Organometallic Compounds, Rochow, Hurd, Lewis, New York, John Wiley & Sons, Inc. (latest edition), incorporated by reference.

One or more radicals (including cyclic radicals), side chains, saturated or unsaturated, may be attached to one or more locations on the ring, and/or to one or more locations of each metal. Thus, the metal may contain between one to as many radicals as available valence electrons (oxidation states) permit. See Handbook of Data on Organic Compounds 2 ed, Weast, Grasselli, CRC (185).

Non-limiting examples of radicals, include organic or inorganic, saturated or unsaturated, or combinations thereof, including: hydrogen (hydride), hydroxyl, hydrocarbyl group radicals, including alkyl radicals (e.g. methyl, ethyl, propyl, issopropyl, butyl, isobutyl, sec-butyl, tert-butyl, amyl, pentyl, hexyl, etc.), alkyloxy radicals, various positional-isomers thereof (e.g. 1-methyl-butyl, 2-methyl-butyl, 3-methyl-butyl, 1,1-dimethyl-propyl, 1,2-dimethyl-propyl, etc.), corresponding straight and branched chain isomers (e.g. hexyl, hepyl, octyl, nonyl, decyl, etc.), alkenyl radicals (ethyl, /\1-propenyl, /\2-propenyl, isopropenyl, etc.), corresponding branch chain isomers thereof, other isomers thereof (e.g. heptenyl, octenyl, nonyl, decenyl, etc.), alkenyloxy radicals, aryl radicals (e.g. phenyl, a-napthyl, b-naphthyl, a-anthryl, b-anthryl, etc.), aryloxy radicals, including monovalent radicals of such aromatics (e.g. indene, isoindene, acenaphthene, flourene, phenanthrene, naphthacene, chrysene, pyrene, triphenylene, etc.), aralkyl radicals (e.g. benzyl, a-phenyl-ethyl, b-phenyl-ethyl, a-phenyl-propyl, etc.), aralkyloxy radicals, various positional isomers thereof (e.g. derivatives of 1-methyl-butyl, 2-methyl-butyl, 3-methyl-butyl, 1,1 dimethyl-propyl, etc.), corresponding alkyl derivatives of phenanthrene, flourene, acenapthene, etc., alkaryl radicals, (e.g. o-tolyl, m-tolyl, p-tolyl, o-ethylphenyl, etc.), arylalkenyl, cycloalkyl radicals (benzyl, etc.), cycloalkyloxy radicals, aliphatic radicals, mesityl. See generally Canadian Patent 1073207, pages 4-7, European Patent Application #93303488.6, pages 6-8, Oct. 11, 1993), Handbook of Data on Organic Compounds 2 Ed, Weast, Grasselli, CRC 1985, CRC Handbook of Chemistry and Physics, 75 th and earlier editions, sections re:. "Nomenclature For Inorganic Ions and Radicals," "Organic Radicals and Ring Systems," Nomenclature of Inorganic Chemistry (Recommendations), Blackwell Scientific Publications, Offord 1990; Richer, J. C., Panico, R., and Powell, W. H. A Guide to IUPAC Nomenclature of Organic Compounds, Blackwell Scientific Publications, Offord 1993, Weast, R. C., and Grasselli, J. C., Handbook of Data on Organic Compounds, 2 nd Ed. CRC Press, Boca Raton, Fla., 1989; incorporated, by reference.

Hydroxyl, alkanol, alkanolamine, oxy and/or oxygen containing radicals, including derivatives of thereof and derivative of above radical are also contemplated. Non-limiting examples include hydroxy, methoxide, ethoxide, propoxide, isopropoxide,butoxide; isobutoxide, sec-butoxide, tert-butoxide, pentoxide, amyloxide, phenyloxidesperhydroxy, methoxy, methylol, methylenedioxy, ethoxy, ethylol, ethylervedioxy, enanthyl, propoxy, proprylol, propylene-dioxy, isopropoxy, isopropylol, isopropylenedioxy, butoxy, butylenedioxy, butylol, iso-butoxy, iso-butylol, isobutylenedioxy, isobutyryl, sec-butoxy, sec-butylol, sec-butylenedidxy, tert-butoxy, tert-butylol, tert-butylenedioxy, butyryl, caproyl, capryl, caprylrl, pentoxy, pentylol, pentalenedioxy, amylol, amylenedioxy, phenoxy, phenylol, phenylenedioxy, phenylmethoxy, diphenylmethoxy, benzoyl, benzyloxy, benzoxy, iso-benzoyl, napthoxy, napthylol, hexylol, hexamethylol, amylenedioxy, hexadecanoyl, heptanedioyl, hexylenedioxy, carbomethoxy, carbethoxy, carbobenzoxy, carbpropoxy, carbisopropoxy, carbutoxy, phenacyl, phenacylidene, propionyl radicals, methylenedioxyl, carbonyldioxy, etc., including derivatives, homologes, analoges, and isomers thereof.

Additional non-limiting oxygen containing radicals include acetyl, acetamido, acetoacetyl, acetonyl, acetonylidene, acrylyl, alanyl, B-alanyl, allophanoyl, anisyl, benzamido, butryl, carbonyl, carboxy, carbazoyl, caproyl, capryl, caprylrl, carbamido, car-bamoyl, carbamyl, carbazoyl, chromyl, cinnamoyl, crotoxyl, cyanato, decanoly, disiloxanoxy, epoxy, formamido, formyl, furyl, furfuryl, furfurylidene, glutaryl, glycinamido, glycolyl, glycyl, glyocylyl, heptadecanoyl, heptanolyl, hydroperoxy, hydroxamino, hydroxylamido, hydrazido/hydrazide, hydroxy, ibdoso, isoccyanato, isonitroso, keto, lactyl, methacrylyl, malonyl, nitroamino, nitro, nitrosamino, nitrosimino, nitrosyl/nitroso, nitrilo, oxamido, peroxy, phosphinyl, phosphide/phosphido, phosphite/phosphito, phospho, phosphono, phosphoryl, seleninyl, selenonyl, siloxy, succinamyl, sulfamino, sulfamyl, sulfeno, thiocarboxy, toluyl, ureido, valeryl radicals, etc., including derivatives, homologes, analoges, and isomers thereof.

Additional non-limiting examples of other radicals, include: acetimido, amidino, amido, amino, aniline, anilino, arsino, azido, azino, azo, azoxy, benzylidine, benzldyne, biphenylyl, butylene, iso-butylene, sec-butylene, tert-butylene, cyano, cyanamido, diazo, diazoamino, ethylene, disilanyl, glycidyl, guanidino, guanyl, heptanamido, hydrazino, hydrazo, hypophosphite (hypophosphito), imido, isobutylidene, isopropylidene, silyl, silylene, methylene, mercapto, methylene, ethylene, naphthal, napthobenzyl, naphthyl, naphthylidene, propylene, propylidene, pryidyl, pyrryl, phenethyl, phenylene, pyridino, sulfinyl, sulfo, sulfonyl, tetramethylene, thenyl, thienyl, thiobenzyl, thiocarbamyl, thiocarbonyl, thiocyanato, thionyl, thiuram, toluidino, tolyl, a-tolyl, tolylene, a-tolylene, tosyl, triazano, ethenyl (vinyl), selenyl, trihydrocarbylamino, trihaloamino, trihydrocarbyl phosphite, trihalophosphine, trimethylene, trityl, vinylidene, xenyl, xylidino, xylyl, xylylene, 1,3-diene, hydrocarbyl radicals, etc., including derivatives, homologes, analoges, and isomers thereof. Thus, ring compounds or metals themselves may directly or indirectly contain one or more chelating radicals (e.g. carbonyl, cyano, etc.).

One or more of the above radicals may be attached directly or indirectly to another. Indirect attachment may be via one or more intermediate atom, including but not limited to carbon, nitrogen, oxygen, phosophorus, silicon, boron, sulfur, or another metal.

Metallic compounds may have one or more non-ring radicals attached. Desireable metals may for example have one or more alkyl, alkylene or similar radical attached to the metal, or one or more hydroxyl, carbonyl, alkyloxy, alkanol radicals, or combination thereof.

Other metallic compounds may have one or more ring systems attached directly or indirectly to a metal, with or without an attached non-ring radical to the metal.

One or more cyclic rings maybe attached, fused or indirectly attached together or linked together via one or more radicals, one or more atoms, including but not limited to carbon, nitrogen, oxygen, phosophorus, silicon, boron, sulfur, or a metal.

One or more metals may be attached to each other, for example hexamethyldisilane, which is a preferred metallic. Indirect attachment herein includes attachment via one or more radicals, and/or one or more atoms, including but not limited to carbon, nitrogen, oxygen, phosophorus, silicon, boron, sulfur, or another metal.

As contemplated herein said carbon, nitrogen, oxygen, phosophorus, silicon, boron, sulfur, or other metal atom, may be attached to itself or to another herein, one or more times, with each atom optionally having one or more hydrogen and/or radical(s). Said attachment may be independent of attachment to any other radical or metal, or may include an attachment to another radical or metal.

Likewise one-or more cyclic rings may be attached directly to the, metal, or indirectly via one or more non-ring radicals, and/or via one or more intermediate atoms, including but not limited to carbon, nitrogen, oxygen, phosophorus, silicon, boron, sulfur, or another metal.

Thus, one or more metals may be attached at one, or up to every location possible on the ring system, directly and/or indirectly. Likewise, one or more ring systems may be attached at one, or up to every metal location possible, directly and/or indirectly.

A non-ring radical may be independently attached directly or indirectly to the metal, absent its attachment of a ring system. In the practice of this invention the attachment of one or more non-ring radical(s) to a metal, absent a ring system is expressly contemplated.

Contemplated oxygenated metallic compounds include metallic alkanols, ethers, ketones, hydroxides, alkyloxy, including methoxy, dimethoxy, trimethoxy, ethoxy, diethoxy, triethoxy, oxalate, carbonate, dicarbonate, tricarbonate, and similar structured compounds, including mixture thereof. For example trimethoxymethyl silane (as set forth below) is desireable. Metallic carbonates, including dimetallic carbonates, dimetallic dicarbonates, and the like, are also contemplated. It is contemplated these oxygenated metallic or organo-metallic compounds may be employed absent a dialkyl carbonate or other oxygenated ECS structure.

Likewise one or more non-ring radicals may be independently attached directly or indirectly to the ring system, absent attachment of a metal. An independent attachment of a metal may be via intermediate radical, one or more intermediate atoms, including but not limited to carbon, nitrogen, oxygen, phosophorus, silicon, boron, sulfur, or another metal.

A cyclic ring/radical/side chain may be indirectly attached to the metal through one of more atom, including but not limited to carbon, nitrogen, oxygen, phosophorus, silicon, boron, sulfur, or a metal. Indirect attachment via oxygen is contemplated but less desireable.

Cyclic rings may be attached to one or more non-ring radicals, atoms and/or ring systems prior to a direct or indirect attachment of the metal. For example, [2-(cyclohexenyl) ethyl]triethoxysilane contains a ethyl radical attached to the cyclohexenyl ring, which is then attached to silicon. This is a preferred metallic structure.

Thus, cyclomatic compounds may contain one or more ring systems, optionally with one or more non-ring radicals attached thereto. Said ring(s) then may be attached directly or indirectly to a metal, with said metal in turn optionally attached directly or indirectly to a radical, with said radical being optionally a non-ring radical selected from one or more hydrogen, hydroxyl, alkyl, aryl, carbonyl, alkanol, alkanolamine, alkyloxy, oxy or oxygen containing radical. Non-limiting examples include methylcyclopentadienyl manganese tricarbonyl, [2-(cyclohexenyl)ethyl]triethoxysilane, and cyclohexenyl dimethoxymethylsilane.

A class of metallics, which are capable of vapor phase combustion include spiral compounds based for example upon ferricyanhydric acid derivatives, namely ferricyanides.

See Dictionary of Chemical Solubilties, supra, pages 334-342, which lists various ferrocyanides, incorporated herein by reference. Alkali metals and alkali earth metals are desireable ferricyanides. Potassium hexacyanoferrate(II) and potassium hexacyanoferrate(III) are desireable. Non-limiting examples of substitutes include potassium hexacyanocobalt II-ferrate, potassium Hexacyanocobalt III, potassium hexachloroosmate(IV), potassium hexachloroplatinate(IV), potassium hexafluorosilicate, potassium hexafluoromanganate(IV), potassium Hexaflourozirconate, potassium hexathiocyanatoplatinate(IV), potassium sodium ferricyanide, potassium hexacyanoplatinate, potassium hexacyanoruthinate(II)hydrate, potassium hexacyanoplatinate(IV), potassium hexafluoroaluminate, potassium hexafluoroarsenate, potassium hexafluorophosphite, potassium hexafluorophosphite, potassium hexafluorosilicate, potassium hexahydroxyantimonate, potassium hexafluoro titante, Potassium copper ferracyanide, potassium cyanide, iron(III) ferrocyanide, sodium ferrocyanide decahydrate. Naturally other cyano-spiral, including hexacyano compounds are contemplated. Substitutions for potassium and/or iron are also contemplated. Examples of such substitution include potassium hexacyanocobaltate(III), sodium hexacyanocobaltate(III), etc: Structurally similar compounds, analogues, and homologues, ect., are incorporated herein by reference.

It is contemplated these compounds will require a solvent inorder to be adapted to Applicant's invention. Non-limiting examples of solvents, include alkyl ketones (acetone, etc.), alkyl alcohols, alkyl ethers, glycerols, alkanol amines (ethanolamine, etc.), and the like. Other contemplated solvents are known in the art and those which are both soluable with said hexacyanides and DMC are incorporated herein by reference.

An example of this fuel composition would include those already provided herein, except the metal component would be a hexacyanide, preferrabiy potassium hexacyanoferrate (II) or (III).

Other example, would be a fuel composition including DMC and potassium hexacyanoferrate(II) with a mutual solvent, optionally containing trimethoxymethylsilane, a hydrocarbon/hydrogen, and/or an oxidizer, formulated to acheive vapor phase combustion. Said composition may also be constructed to have maximum pH of 10.5.

Another class of desireable metallics include metal hydrides or metallic hydryls. Examples of metallic hydryls include sodium hydride, lithiuml hydride, aluminum hydride, aluminum borohydride, boron hydride, boron anhydride, beryllium borohydride, lithium borohydride,lithium aluminum hydride, lithium borohydride, sodium borohydride, transition-metal hydrides, transition-metal carbonyl hydrides, transition-metal cyclopentadienyl hydrides, and mixture. Those hydrides known in the art and those disclosed in Metal Hydrides, Bambakidis, N.Y., Plenum Press (1981), Boron Hydride Chemistry, Muetterties, N.Y., Academic Press (1975), which accomplish primary vapor phase combustion object of this invention, are contemplated in the claims below and incorporated herein by reference.

Organometallic nitrosyls are also desireable. See for example Metal Nitrosyls, Richter-Addo, Oxford University Press, U.K. (1992).

Alkyl metal carbonates, multi-metal alkyl carbonates, or carbonates including those with a hydrogen (e.g. LiHCO3, Na2CO3, NaHCO3, MnCO3, MgCO3, CaCO3, CaMg(CO3)2, etc.), alkali metal carbonates, and other metal carbonates (e.g. AgCO3, T12CO3, etc.) are contemplated. Contemplated salts also include acid salts containing replaceable hydrogen. Double oxides and hydroxides are also contemplated.

Transition metals and their known cyclomatic compounds, including carbonyl compounds are expressly contemplated. See Fundamental Transition Metal Organometallic Chemistry, Lukehart, Monteray, Calif., Brooks/Cole (1985), Transition Metal Compounds, King, N.Y., Academic Press (1965), Transition-Metal OrganQmetallic Chemistry, King, N.Y., Academic Press (1969), Fundamental Transition Metal Organometallic Chemistry, lukehart, Monterey, Calif., Brooks/Cole (1985), incorporated herein by reference. A preferred cyclomatic transition metallic is MMT.

As contemplated herein non-transition-metal compounds known in the art. See Nontransition-Metal Compounds, Eisch, N.Y., Academic Press (1981). Non-transition metal compounds that accomplish primary object of vapor phase combustion are contemplated in the claims below and incorporated herein by reference.

Likewise known metallocenes are contemplated. Non-limiting examples include alkylmetallocenes, arylmetallocenes, including dicyclopentadienyl-metal with the general formula (C5H5)2M, dicyclopentadienyl-metal halides with the general formula (C5H5)2MX1-3, monocyclopentadienyl-metal compounds with the general formula C5H5MR1-3, where R is CO, NO, halide group, alkyl group, etc. Non-limiting examples include napthacenes, ferrocene, methylferrocene, cobaltocene, nickelocene, titanocene dichloride, zirconocene dichloride, uranocene, decamethylferrocene, decamethylsilicocene, decamethylgermaniumocene, decamethylstannocene, decamethylphosocene, decamethylosmocene, decamethylruthenocene, decamethylzirconocene, silicocene, decamethylsilicocene, etc.) are also contemplated. Metallocenes that accomplish primary object of vapor phase combustion are contemplated in the claims below and incorporated herein by reference. See also Hawley's Condensed Chemical Dictionary 12 th. ed, Lewis, Van Nostrand Reinhold Company, New York (1993), also incorporated by reference.

Carbonyl compounds are expressly contemplated. A limited number of examples include decacarbonyl dimanganese, (acetylacetonato)di-carbonylrhodium. See for example Carbonylation: Direct Synthesis of Carbonyl Compounds, H. M. Colquhoun, Plenum Press (1991), incorporated herein by reference.

Alkyl metal and alkyl earth metal salts and derivative, compound are expressly contemplated. For example, potassium salts are contemplated including those commercially marketed by Shell Chemical, known as "SparkAid or SparkAde." Other acceptable potassium salts include potassium alkanols, e.g. potassium methoxide, potassium ethoxide, potassium propoxide, potassium isopropoxide, potassium butoxide, potassium sec-butoxide, potassium tert-butoxide, potassium pentoxide, potassium tert-pentoxide, etc. Other non-limiting examples of potassium salts include potassium hydrogenphthalate, potassium hydrogensulfate, monopotassium acetylenedicarboxylic acid, potassium phenoxide, potassium pyrophosphate, potassium dihydrogenphosphate, potassium benzoate, potassium chloride, potassium hexoate (potassium salt hexoic acid), potassium acetate, potassium diphenylphosphide, potassium trimethylsilonalate, potassium phthalic acid, P-aminobenzoic acid potassium salt, monopotassium L-aspartic acid. Corresponding sodium, Lithium, rubidium, sesium compounds are contemplated.

As noted above, non-limiting non-leaded simple binary/ternary metallic compounds, including binary/ternary and higher metallic salts, acid salts, including those with replaceable hydrogen, etc., are contemplated. Hydroxy acids, perchlorates, sulfates, nitrates, carbonates, hydroxides, methylates, ethylates, propylates, and others, are also contemplated.

Non-limiting examples include potassium nitrite, sodium nitrite, lithium nitrite, and hexamethylphosphoric triamide.

Silicon containing metallics are particularly preferred. Non-limiting examples preferred silicons include [2-(cyclohexenyl)ethyl]triethoxysilane, cyclohexenyl dimethoxymethylsilane, benzyltrimethylsilane, N-(3-(trimethoxysilyl) propyl)ethylenediamine, N-1-(3-(trimethoxysilyl)propyl) diethylenetriamine, N-(3-(trimethoxysilyl)propyl) ethylenediamine, 1-(trimethyl(silyl)pyrrolidine, triphenylsilanol; octamethyltrisiloxane, 2,2,4,4,6,6-hexamethylcyclotrisilazane, hexamethylcyctrisiloxane, hexamethyldisilane, 1,1,1,3,3,3-hexamethyl disilazane, hexamethyldisiloxane, hexamethyldisilthiane, allyltributylsilane, tetraalkylsilanes, (e.g. tetraethylsilane, tetrabutylsilane, etc.), 3-aminopropyltriethoxysilane, benzytrimethylsilane, benzytriethylsilane, N-benzyltrimethylsilylamihe, diphenylsilanediol, dihexylsilanediol, (trimethylsilyl)cyclopentadiene, including homologues, analogues and derivative thereof.

An an example of a desirable fuel composition of this invention would then include a lower molecular weight dialkyl carbonate (preferrably DMC or EMC), a silane selected from preferred silicons immedately above (or as set forth elsewhere in this specification), and optionally trimethoxymethylsilane as a co-metallic, a hydrogen or a hydrocarbon co-fuel, and/or an oxidizer.

Preferrable tin compounds include benzltriphenyltin and allyltributyltin. A preferrable phosphorus compound includes benzyldiethylphosphite.

It is also within the scope and practice of this invention to employ oxygenated containing metallic compounds, including oxygenated organo metallic compounds, which are metallic alcohols, alkanolamines, ketones, esters, ethers, carbonates, and the like, which are themselves ECS compounds, in hydrocarbon fuels with or absent additional dialkyl carbonate or other ECS structure. Those metallics are incorporated herein by reference. Additionally, this invention contemplates one or more similar organo oxygen containing metallics, including mixture, with or without an ECS compound, to act as neat "stand alone" fuel. Thus, it is an express embodiment to use metallic compounds alone, as singular means of enhancing fuel combustion. However, it is perferred the metallic be added to DMC, optionally a co-fuel, an oxidizer, catalyst, and/or a hydrocarbon.

The compositions of this invention contemplate usage of an oxidizer and other ingredients. See incorporated references, including aforementioned PCT applications, for the definitions incorporated in the claims below.

It is also within the practice of this invention to employ a metallic compound, including homologue, analogue, isomer, or derivative thereof, having a structure or structure similar to M-Rn, Rn-M-M-Rn, Rn-M-Q-M-Rn, Rn-M-Q'-M-Rn, Rn-M-R'-M-Rn, wherein M is one or more non-leaded metal (s), metalloid(s), or non-metal element(s), and R is one or more hydrogen, cyclic ring system/radical/side chain(s), and/or non-ring radical/side chain(s) as provided herein above, including but not limited to alkyl, aryl, alkyloxy, alkylanol (alkanol), hydroxyl, aryloxy, polyalkyl, polyaryl, polyalkyloxy, polyalkylanol, polyaryloxy, polyhydroxyl radicals. R' is one or more cyclic ring system/radical/side chain(s), and/or non-ring radical/side chain(s) as provided herein. If R is greater than 1, then subsequent R's may be same or different radical, etc. R also be a single radical or one radical attached to one or more radicals. "n" is an interger ranging from 1 to the number of valence electrons (or common oxidation states) available of M. Q is an atom having a minimum oxidation available of 2, including but not limited to carbon, nitrogen, oxygen, phosophorus, silicon, boron, sulfur, or a differing metal than M. Q' is an atom with a minimum available oxidation state of 2, including but not limited to carbon, nitrogen, oxygen, phosophorus, silicon, boron, sulfur, or a differing metal than M, also containing one or more radicals.

Additional oxygenated-orgaho or oxygenated metallic structure includes M1-O(CO)O-M2, wherein M1 or M2 are the same or different metal or element. M1 may be a double valence cation, wherein M2 is absent from above structure, unless additional carbonate is included. Preferred M valences are 1 or 2. M valences or multiple M1M2 combinations having combined valence greater than two are acceptable. In which case, additional carbonate structure would be added, e.g. CaMg(CO3)2.

In the immediate structure above, M1/M2 valence's may be greater than one, wherein excess valence is occupied by same or additional metal (element), and/or wherein M1 or M2 are substituted for a single or double bond oxygen, and/or by one or more radicals. M1 or M2 also may be substituted for single bond oxygen, or nitrogen, and/or by one or more radicals, including methyl, hydrogen, hydroxy, ethoxy, carbethoxy, carbomethoxy, carbonyl, carbonyldioxy, carboxy, methyoxy, isonitro, isonitroso, or methylenedioxyl radical. Non-limiting examples include carbonates of lithium [Li2O2 (CO)], ammonium manganese, potassium [K2O2(CO)], sodium, calcium, cesium, copper, rubidium, lithium hydrogen, sodium hydrogen, potassium hydrogen, potassium sodium, magnesium, and the like.

It is contemplated that C2 to C8 metallic ethers, C2 to C4/C5 metallic ethers being more desireable, will be used as metallic structure in this invention. For example, M'1-CH2-CH2-O—CH2-CH2-M'2 structure is contemplated wherein M'1 and M'2 may be same or different metallic or wherein one M'1 or M'2 may be hydrogen, or other atom, or radical with one available valence.

Other contemplated structure include metallic ketone, ester, alcohol, acid, and the like. Non-limiting examples include M'1-C—OH3-R, wherein M'1 is one or more metallic comprising valence of 3 or greater, and R is radical, whereby resulting structure is ketone, ester, acid, alcohol, or ether. Other structure include M'1-C2O4, wherein M'1 has avalence of 2. M1-C—C—O—C—C-M2 structure is also contemplated wherein M1 and M2 may be same or different metallic or wherein M2 may be hydrogen or atom of one valence. Other structure includes RO-M, where RO is an alkanol and M is a metal. Similar structure is contemplated for M have available valence greater than 1.

It is preferred when an oxygenated organo-metallic compound is employed, it have ECS properties when ever possible, e.g. higher heats of vaporization, high burning velocities, favorable decomposition characteristic (e.g. decomposition at post ignition pre-combustion temperatures into enhanced combustion or free radicals structure), be thermally stable at normal handling temperatures, etc.; and have high heat and energy releasing characteristics of metals, etc. Non limiting examples of lithium derivative compounds of this invention, include: lithium bis(dimethylsilyl)amide, lithium bis(trimethylsilyl)amide, oxamic acid, P-aminosalicylic acid lithium salt, lithium salt 5-nitroorotic acid, lithium D-gluconate, lithium hexacyanoferrate(III) (Li3Fe(CN)6), lithium diphenylphosphide, lithium acetate, lithium acetate acid, lithium salt acetic acid, lithium acetamide, lithium anilide, lithium azide, lithium benzamide, lithium antimonide, lithium orthoarsenate, lithium orthoarsenite, lithium metaarsenite, lithium diborane, lithium pentaborate, lithium dihydroxy diborane, lithium borohydride, lithium cadium iodide, lithium chloride, lithium calcium chloride, lithium carbide, lithium carbonate, lithium hydrogen carbonate, lithium carbonate, lithium carbonyl, lithium cobalt(II) cyanide, lithium cobalt(III) cyanide, lithium cobaltinitrite, lithium cynomanganate(II), lithium cynomanganate(III), lithium citrate, lithium ferricyanide, lithium ferrocyanide, lithium hydride, lithium hydroxide, lithium manganate, lithium permanganate, lithium methionate, lithium napthenate, lithium nitride, lithium nitrate, lithium nitrite, lithium nitrobenzene (e.g. lithium-p-nitrobenzene), lithium nitrophenoxide, lithium etherate, lithium chromate, lithium oleate, lithium oxalate, lithium oxalatoferrate(II), lithium oxalatoferrate(III), lithium monoxide, lithium oxide, lithium peroxide, lithium lithium mono-orthophosphate, lithium hypophosphite, lithium orthophosphite, lithium hydroxoplumbate, lithium rhodium cyanide, lithium selenide, lithium selenite, lithium selenocynate, lithium selenocyanoplatinate, lithium disilicate, lithium metasilicate, lithium sodium carbonate, lithium sodium ferricyanide, lithium hydroxostannate, lithium disufide, lithium hydrosulfide, lithium pentasulfide, lithium tetrasulfide, lithium trisulfide, lithium telluride, lithium thioarseiiate, lithium thioarsenite, lithium trithiocarbonate, lithium thiocyanate, lithium amide, lithium salt (E,E)-2,4-hexadienoic acid, dilithium fluorophosphate, dilithium fluorophosphite, trilithium phosphate, trilithium phosphite, lithium perchlorate, propanoic acid lithium salt, lithium formate, lithium cyanate, lithium hexacyanocobaltate(III), lithium hypophosphite, lithium hexaflurorsilicate, lithium nitroprusside, lithium phenoxide, lithium phosphate (dibasic, monobasic, tribasic), lithium salicylate, lithium selenide, lithium tetracyanonickelate(II), lithium tetrafluoroborate, lithium xanthogenate, lithium-p-aminobenzoate, lithium copper ferrocynanide, lithium cupric ferrocyanide, lithium hexafluorophosphate, lithium hexanitricobaltate(III), lithium naphthenate, lithium-B-naphthoxide, lithium polysulfide, lithium sodium phosphate, lithium stearate, lithium sulfide, lithium sulfite, lithium sulfate, lithium thiocyanate, lithium xanthate, lithium fluorosilicate, N-lithiumethylenediamine, oxalic acid dilithium salt, lithium beta-hydropyruvic acid, lithium 1,1-dimethylurea, lithium 1,1-diethylurea, lithium 1,1-diepropylurea, lithium xanthate, lithium ethylxanthate, lithium methylxanthate, lithium salt thiophenol, lithium triphenylmethyllithium, methyl-lithium, ethyllithium, lithiumethynyl(acetylide), propyllithium, isopropyllithium, butyllithium, isobutyllithium, secbutyllithium, tertbutyllithium, pentalithium, hexyllithium, heptalithium, amyllithium, isoamyllithium, benzyllithium, dimethylbenzyllithium, tolyllithium, dodecyllithium, cyclopentadienyllithium, methyl-cyclopentadienyllithium, cyclohexyllithium, lithiumheptyl, lithiumdodecyl, lithium tetradecyl, lithium hexadecyl, lithium octadecyl, phenyllithium, lithium o-tolyl, lithium m-tolyl, lithium p-tolyl, lithium-p-chlorophenyl, lithium p-bromophenyl, lithium lithium o-anisyl, lithium m-anisyl, lithium p-anisyl, lithium diethoxyphenyl, lithium dimethoxyphenol, lithium m-cumyl, lithium p-ethoxyphenyl, lithium m-dimethylaminophenyl, lithium 9-flourene, lithium a-napthyl, lithium b-napthyl, lithium p-phenylphenyl, lithium 9-phenylanthryl, lithium 9-anthryl, lithium 9-methyl-phenanthryl, lithium pyridyl, lithium 2-pyridyl, lithium 3-pyridyl, lithium 6-bromo-2-pyridyl, lithium 5-bromo-2-pyridyl, lithium dibenzofuryl, lithium 3-quinoyl, lithium 2-lepidyl, lithium triphenylmethyl, lithium 2,4,6-trimethylphenyl, lithium 2,4,6-triisopropylphenyl, lithium 2,3,5,6-tetraisopropylphenyl, lithium tetrabutylphenyl, thiophenedilithium, toluenedilithium, dipheny-lethylenedilithium, lithiumamylethynyl, lithiumphenylethynyl, lithiummethoxybromophenyl, lithium pheny lisopropyl, lithium tetraphenylboron, lithium tetramethylboron, lithium a-thienyl, lithium m-trifluoromethylphenyl, phenylethynyllithium, 3-furyl-lithium, phenylisopropyllithium, dibenzofuranyllithium, lithium dimethylbenzyl, lithium selenocyanate, lithium trimethylsilanolate, diphenylphosphide, lithium benzoate, lithium tert-butyl carbonate, lithium azide, di-lithiumcyanamide, lithium cyanide, lithium dicyanamide, cyclohexanebutyric acid lithium salt, cyclohexane acid lithium salt, cyclopentadientyllithium, lithium tri-tert-butoxy-aluminum hydride, lithium triethylborohydride, lithium trimethyl-borohydride, lithium tripropylborohydride, lithium triisopropyl-borohydride, lithium tributylborohydride, lithium triisobutyl-borohydride, lithium tri-sec-butylborohydride, lithium tri-tert-butylborohydride, lithium trisiamylborohydride, lithium chlorate, lithium tert-butoxide, lithium sec-butoxide, iso-butoxide, lithium antimonate, lithium diphenylphosphide, lithium bis(trismethylsilyl) amide, trilithium phosphite, lithium selenocyanate, lithium tri-sec-butylborohydride, lithium triethylsilanolate, lithiumthiocyanate, lithium acetylide, lithium chlorate, lithium salicylate, lithium di-lithium tetracarbonylferrate, lithium tetraphenylborate, lithium triethylborohydride, lithium triacetoxyborohydride, lithium triphenylborane, lithium hydroxide, lithium diphenylphosphide, lithium methoxide, lithium ethoxide, lithium tri-sec-butyl-borohydride, tri-tert-butylborohydride, lithium triethylborohydride, lithium triphenylborohydride, lithium trisiamylborohydride, lithium metavanadate, lithium cyclohexanebutyrate, lithium hexachloroplatinate, lithium thiocyanate, lithium selenocyanate, lithium cyanate, lithium floride, lithium hexafluoroantimonate, lithium hexafluoroaluminate, lithiumaluminate, lithiumaluminum-tri-tert-butoxide, lithium hexafluoroarsenate, lithium hexafluorosilicate, lithium hexacyanocobalt(II) ferrate(II), lithium ferrosilicon, dilithiumhexacyanocobalt (II)ferrate(II), lithium hexafluorotitan-ate, lithium hexafluorozirconate, lithium hexahydroxyantimonate, lithium hexachlororuthenate, lithium hexachloropalladate, lithium formate, lithium tetracyanonickelate, lithium tetrafluoroaluminate, lithium tetrafluoroborate, lithium thioacetate, L-glutamic acid monOlithium salt, fumaric acid lithium salt, oxamic acid lithium salt, lithium salt diphenylphospane, P-aminobenzoic lithium salt, aminobenzole acid lithium salt, alpha-napthalemeacetic acid lithium salt, dilithium salt 2,6-naphthalenedicarboxlic acid, lithium cyclcohexanetherate, lithium phthalimride, P-aminosalicylic acid lithium salt, lithium salt 3,5-dimethylcyclohexyl sulfate, 7ndolebutyric acid lithium salt, indole-3-butyric acid lithium salt, diphenylphosphide, lithium dimethylsilanolate, lithium triethylborohydride, lithium propoxide, lithium isopropoxide, lithium butoxide, lithium sec-butoxide, lithium pentoxide, lithium tert-pentoxide, lithium hydrogenphthalate, lithium oxalate, lithium hydrogensulfate, monolithium acetylenedicarboxylic acid, lithium pyrophosphate, lithium dihydrogenp-hosphate, lithium hexoate (lithium salt hexoic acid), lithium diphenylphosphide, lithium trimethylsilonalate, lithium phthalic acid, P-aminobenzoic acid lithium salt, monolithium L-aspartic acid, tetraphenyldilithium (C6H5) 2CLi2C(C6H5)2, lithiumethylphenyl (LiCH2C6H5), lithium bromate, lithium hydrogenphospate, monlithium salt D-shaccharic acid, DI-asparatic lithium salt, (R)-alpha-hyroxymethylaspartic acid lithium salt, lithium fluoride, lithium iodate, lithium salt ethyl malonate, lithium thioacetate, lithium phenol, lithium salt aminobenzbic acid, lithium aminophenol salt, lithium cyclohexenol, lithium methylcyclohexenol, lithium cyclopropanol, lithium methylcyclopropanol, lithium cyclobutanol, lithium methylcyclobutanol, lithium methylcyclopentanol, lithium cyclopentanol, lithium cyclohexenol, lithium methylcyclohexenol, lithium dimethylcyclohexenols (e.g. lithium 3,5-dimethylcyclohexanol, lithium 2,3-dimethylcyclohexanol, lithium 2,6-dimethylcyclohexanoi, lithium 2,5-dimethylcyclohexanol, 3,5-dimethylcyclohexanol), lithium o-ethylxanthic acid, monolithium salt. 2-ketoglutaric acid, dilithium salt, ketomalonic acid, lithium salt lactic acid, dilithium thiosulfate, lithium antimony tartrate, lithium dichloroacetate, lithium dimethylacetate, lithium diethylacetate, lithium dipropyl-acetate, lithium metaborate, lithium tetraborate, lithium tetra-chlorocuprate, lithium acetoacetate, lithium diisopropylamide, lithium diethylamide, lithium dimethylamide, lithium bis (dimethyl-silyl)amide, dilithium phthalocyanine, dilithiumtetrabromocuprate, dilithium tetrabromonickelate, dilithiumtetrachloromanganate, dilithiumbutadiyne, lithium cyclopentadienide, lithium dicyclo-hexylamide, lithium diethylamide, lithium dimethylamide, lithium dipropylamide, lithium diisopropylamide, lithium thexylborohydride, lithium tri-tert-butoxyaluminohydride, lithium trimethlyl-silyl)acetylide, lithium triethylsilyl)acetylide, lithium tris[(3-ethyl-3-pentyl)oxy]aluminohydride, (phenylethynyl) lithium, 2-thienyllithium, lithium diethyldihydroaluminate, lithium dimethyldihydroaluminate, lithium aluminum hydride, lithium bifluoride, lithium biphenyl, lithium biselenite, lithium bis(2-methoxyethoxy)-aluminum hydride, lithium bismuthate, lithium borate, lithium chlorite, lithium cobaltnitrite, lithium cyanoborohydride, lithium cyclopentadienide, lithium dicyanamide, lithium hexametaphosphate, lithium hexanitrocolbaltate, lithium hydrogenphosphite, lithium hydrogenselenite, lithium hydrogensulfite, lithium hydrosulfite, lithium hypochloride, lithium metaarsenite, lithium metabisulfide, lithium metaperiodate, lithium methacrylate, lithium nitrofer-ricyanide, oxybate, lithium pentamethylcyclopentadienide, lithium phenolate, polyphosphate, lithium polyphosphite, lithium propion-ate, lithium pyrophosphate, lithium selenate, lithium selenite, lithium tetrachloroaluminate, lithium thiomethoxide, lithium thiosulfate, lithium thiosulfide, lithium thiosulfite, lithium tri-actoxyborohydride, lithium lithium trimethylsilonate, lithium triethylsilonate, lithium tris(1-pyrazoly)borohydride, including analogues, homologue, isomers and derivatives thereof. See Lithium Chemistry: A Theorical and Experimental Overview, Sapse, Schleyer, John Wiley & Sons, N.Y. (1995), incorporated herein by reference.

Non limiting examples of the boron derivative compounds of this invention include: alkyl boron compounds, aryl boron compounds, 1,3,2-benzodioxaborole, diisopropoxymethylborane, ethylborane, diethylborane, diemthylborane, dicyclohexylborane, boric acid esters (e.g. borate ester, dimethyl borate, di-n-butyl borate, dicyclohexyl borate, didodecylborate, di-p-cresyl borates), phenylboronic acid, 2-phenyl-1,3,2-dioxborinane, pyrrolyboranes (e.g. 1-pyrrolyborane, 2-pyrrolyborane), tetrabutylammonium borohydride, tetramethylammonium borohydride, tetraisoproplyam-monium borohydride, tetrapropylammonium borohydride, tetraethylam-monium borohydride, tetraisobutylammbnium borohyd ride, tetra-tert-butylammonium borohydride, tetra-sec-butylammonium borohydride, tetrabutylammonium cyanoborohydride, tetramethylammonium cyanoborohydride, tetraisoproplyammonium cyanoborohydride, tetrapropylammonium cyanoborohydride, tetraethylammonium cyanoborohydride, tetraisobutylammonium cyanoborohydride, tetra-tert-butylammonium cyanoborqhydride, tetra-sec-butylammonium cyanoboro-hydride, tetramethylammonium triacetoxyborohydride, thiopheneboric acid, 2-thiopheneboric acid, 3-thiopheneboric acid, tolylboronic acid (e.g. o-tolylboronic acid, p-tolylboronic acid, m-tolylboronic acid), tributoxyborane, tributylborane, tri-sec-butylborane, tri-tert-butylborane, tributylborate, tri-tert-butylborate, tri-methoxyboroxine, trimethylamineboran, trimethylborate, trimethylboroxine, trimethylborazine, trimethylene borate, triphenylborate, triphenylborane, tribenzyl borate, borate, trisiamylborane, tris(2-methoxyethyl)borate, boron hydride, lithium borohydride, sodium borohydride, boron hydrate, boron hydride, boron anhydride, triethylboron (C2H5)3, decaborane, borazoles, aluminimum borohydride, beryllium borohydride, lithium borohydride, hexamethyl-diamineborane (CH3)3NBH(CH3)3), (CH3)2Bl, berylliumborohydride (Be(BH4)2), trimethoxytriborate (BO)3(OCH3)3, C4H9B(OH)2, Al(BH4)2, Be(BH4)2, LiBH4, B(OC2H5)3, B(OCH3)3, trimethoxytriborane, 3-bromophenylboronic acid, trimethoxy borate, triethoxy borate, triproxyborate, tributoxyborate, triisobutoxyborate, tri-tert-butoxyborate, tri-sec-butoxyborate, tri-phenoxyborate, tri-phenoxyboroamine, tri-phenoxyborane, phenylboronic acid, benzyl-boronic acid, cylohexylboronic acid, cylohexenylboronic acid, cyclopentylboronic acid, methylphenylboronic acid, methylcylohexylboronic acid, methylcyclopentylboronic acid, methylbenzylboronic acid, dimethylphenylboronic acid, dimethylcylohexylboronic acid, dimethylcyclopentylboronic acid, dimethylbenzylboronic acid, diphenylboronic acid, dibenzylboronic acid, dicylohexylboronic acid, dicylohexenylboronic acid, dicyclopentylboronic acid, methyldiphenylboronic acid, bis[(methyl)cylohexyl]boronic acid, bis[(methyl)cyclopentyl]boronic acid, bis[(methyl)benzyl]boronic acid, bis[(dimethyl)phenyl]boronic acid, bis[(dimethyl)-cylohexyl]boronic acid, bis[(dimethyl)cyclopentyl]boronic acid, bis[(dimethyl)benzyl]boronic acid, phenylboroncarbonyl, benzylboroncarbonyl, cylohexylboroncarbonyl, cylohexenylboroncarbonyl, cyclopentylboroncarbonyl, methylphenylboroncarbonyl, methylcylohexylboroncarbonyl, methylcyclopentylboroncarbonyl, methylbenzylboroncarbonyl, phenylboronic acid carbonyl, benzylboronic acid carbonyl, cylohexylboronic acid carbonyl, cylohexenylboronic acid carbonyl, cyclopentylboronic acid carbonyl, methylphenylboronic acid carbonyl, methylcylohexylboronic acid carbonyl, methylcyclopentylboronic acid carbonyl, methylbenzylboroncarbonyl, dimethylphenylboroncarbonyl, dimethylcylohexylboroncarbonyl, dimethylcyclopentylboroncarbonyl, dimethylbenzylboroncarbonyl, diphenylboroncarbonyl, dibenzylboroncarbonyl, dicylohexylboroncarbonyl, dicylohexenylboroncarbonyl, dicyclopentylboroncarbonyl, methyldiphenylboroncarbonyl, di[(methyl)cylohexyl]boroncarbonyl, di[(methyl)cyclopentyl]boroncarbonyl, di[(methyl)benzyl]boroncarbonyl, di[(dimethyl)phenyl]boroncarbonyl, di[(dimethyl)cylohexyl]boroncarbonyl, di[(dimethyl)cyclopentyl]boroncarbonyl, di[(dimethyl)benzyl]boroncarbonyl, phenylboromethoxide (phenylborodimethoxide C6H5B(OCH3)2), benzylboromethoxide, cylohexylboromethoxide, cylohexenylboromethoxide, cyclopentylboromethoxide, methylphenylboromethoxide, methylcylohexylboromethoxide, methylcyclopentylboromethoxide, methylbenzylboromethoxide, methylphenylboromethoxide, dimethylphenylboromethoxide, methylcylohexylboromethoxide, dimethylcylohexylboromethoxide, methylcyclopentylboromethoxide, dimethylcyclopentylboromethoxide, methylbenzylboromethoxide, dimethylbenzylboromethoxide, diphenylboromethoxide, dibenzylboromethoxide, dicylohexylboromethoxide, dicylohexenylboromethoxide, dicyclopentylboromethoxide, di(methylphenyl)boromethoxide, di(methylcylohexyl)boromethoxide, di(methylcyclopentyl)boromethoxide, di(methylbenzyl)boromethoxide, di(dimethylphenyl)boromethoxide, di(dimethylcylohexyl)boromethoxide, di(dimethylcyclopentyl)boromethoxide, di(dimethylbenzyl)boromethoxide, phenylboroethoxide (phenylborodiethoxide C6H5B(OCH3)2), benzylboroethoxide, cylohexylboroethoxide, cylohexenylboroethoxide, cyclopentylboroethoxide, methylphenylboroethoxide, methylcylohexylboroethoxide, methylcyclopentylboroethoxide, methylbenzylboroethoxide, methylphenylboroethoxide, dimethylphenylboroethoxide, methylcylohexylboroethoxide, dimethylcylohexylboroethoxide, methylcyclopentylboroethoxide, dimethylcyclopentylboroethoxide, methylbenzylboroethoxide, dimethylbenzylboroethoxide, diphenylboroethoxide, dibenzylboroethoxide, dicylohexylboroethoxide, dicylohexenylboroethoxide, dicyclopentylboroethoxide, di(methylphenyl)boroethoxide, di(methylcylohexyl)boroethoxide, di(methylcyclopentyl)boroethoxide, di(methylbenzyl)boroethoxide, di(dimethylphenyl)boroethoxide, di(dimethylcylohexyl)boroethoxide, di(dimethylcyclopentyl)boroethoxide, di(dimethylbenzyl)boroethoxide, phenylboric acid, benzylboric acid, cylohexylboric acid, cylohexenylboric acid, cyclopentylboric acid, methylphenylboric acid, methylcylohexylboric acid, methylcyclopentylboric acid, methylbenzylboric acid, diriethylphenylboric acid, dimethylcylohexylboric acid, dimethylcyclopentylboric acid, dimethylbenzylboric acid, dibenzylboric acid, dicylohexylboric acid, dicylohexenylboric acid, dicyclopentylboric acid, methyldiphenylboric acid, bis(methylcylohexyl)boric acid, bis[methylcyclopentyl]boric acid, bis[methylbenzyl]boric acid, bis[dimethylphenyl]boric acid, bis[dimethylcylohexyl]boric acid; bis[dimethylcyclopentyl]boric acid, bis[dimethylbenzyl]boric acid, aminophenylboronic acid, 3-aminophenylboronic acid, diborane, tetramethoxydiborane, tetraethoxydiborane, boric acid, borazine, borocarbonate, borane-tert-butylamine, tetraethylammonium borohydride, tetraethyl-ammonium tetrafluoroborate, tetrapropylammonium teirafluoroborate, naphthylboronic acids. (e.g. 1-naphthylboronic acid, 2-naphthylboronic acid, 3-naphthylboronic acid, 4-naphthylbofonic acid), methylnaphthiboronic acid, biphenylboronic acid, carborane, cyclohexylamine diborane, methylbenzeneboric acid, dimethylbenzeneboric acids (e.g. 3,5-dimethylbenzeneboric acid), hexadecaneboronic acid, tetreadecaneboronic acide, phenylethylboroamine, methylborazine, dimethylborazine, trimethylborazine, ethylborazine, diethylborazine, triethylborazine, carboborazine, dicarboborazine, tricarboborazine, triisopropoxyboroxine, tripropoxyboroxine, trimenthyl borate, trimenthyl borine, trimenthyl borane, trimethal-lyl borate, trimethallyl borine, tripentyl borate, tripentyl borine, tripentyl borane, trimethyl borate, trimethylborine, triethylborine, triethylborane, triethylborate, tripropylborane, tripropylborine, tripropylborate (tripropoxyborane), triisopropyl-borane, triisopropylborate, triisopropylborine, trii-isobutyl-borane, tri-iso-butylborate, tri-sec-borane, tri-sec-borate, tri-sec-borine, tributyl borate, tributyl borine, tributyl borane, tri-tert-butyl borate, tri-tert-butyl borine, tri-tert-butyl borane, triphenyl borate, triphenyl borane, tricyclohexylborate, tricyclohexylborane, dimethyl boric acid, diethylboric acid, dipropyl-boric acid, diisopropylboric acid, di-iso-butylboric acid, di-sec-boric acid, dibutylboratic acid, di-tert-butylboric acid, diphenyl-boric acid, dicyclohexylboric acid, boron tribromide, sodium tetrafluoroborane, sodium, trimethylborohydride, triethyl-borohydride, sodium tripropylborohydride, sodium triisopropylborohydride, sodium tributylborohydride, sodium triisobutyl-borohydride, sodium-tert-butylborohydride, sodium-sec-butyl-borohydride, sodiumphenylborohydride, potassium tetrafluoroborane, potassium trimethylborohydride, triethylborohydride, potassium tripropylborohydride, potassium triisopropylborohydride, potassium tributylborohydride, potassium triisobutylborohydride, potassium-tert-butylborohydride, potassium-sec-butylborohydride, potassium phenylborohydride, butylboronic acid, sodiumborohydride, methyldichloroborane, ethyldichloroborane, propyldichloroborane, isopropyldichloroborane, butyldichloroborane, isobutyldi-chloroborane, tertbutyldichloroborane, secbutyldichloroborane, phenyldichloroborane, methylboric acid, ethylboric acid, trichloro-borazine, borane-tetrahydrofuran, tetrafluoroboric acid, boron trichloride, tre-sec-butylborane, boran-trimethylamine, borane-triethylamine, borane-N,N-diethylaniline, boran-pyridine, borane-tert-butylamine, borane-morpholine, borane-dimethylamine, borane-diethylamine, trisiamylborane, trisiamylborate, disiamylborane, disiamylborate, trimesitylborane, sodium metaborate, lithium metaborate, potassium metaborate, sodium metaborane, borane-tributylphosphine, lanthanum hexaboride, boran-triphenylphosphine, boran-tributylphosphine, cyclopentadienylboran, methylcyclopentadienylboran, boran-N,N-diisopropylborohydride, N,N'-bis(mono-isoipinocampheylborane)-N,N,N'N'-tetramethylethylenediamine, boron nitride, 4-(borane-dimethylamine)benzene, 4-(borane-dimethylamine)-pyridyl, 3-(methylthio)propl yborane, tris(dimethylamino) borane, butyldiisopropoxyborane, triphenyl borane sodium, sodiumtetraphenylborane, sodiumtetraphenylborane, sodium tetrakis(1-imidazolyl)borane, sodium tetrakis(1-imidazolyl)borate, diisopropoxyphenylborate, diisopropoxymethylborate, diisopropoxyethylborate, boron-ammonia, borontrifluoride, diethyl(3-pyridyl)borane, dimethyl(3-pyridyl)borane, lithium thexylborohydride, dichloromethyldiisopropylboraete, diethylmethoxyborane, dipropylmethoxyborane, diisopropylmethoxyborane, diethylethoxyborane, dipropylethoxyborane, diisopropylethoxyborane, boran-piperidine, diphenylborinic anhydride, tris(trimethylsilyl)borate, tris(tri-methylsityl)borane, trimethylacetic acid with diethylboinic acid, (2-methylpropyl)borinic acid, boroglycine, boron alchols, boron etherates, boron acetates (e.g. propylborodiacetate, phenyl-borodiacetate, boron tris(trifluoro) acetate), sodium tris(1-pyrazolyl)borohydride, sodium perborate, tolylboronic acid, aluminum diboride, chlorodicyclohexylborane, methyldicyclohexyl-borane, ethyldicyclohexylborane, propyldicyclohexylborane, isopropyldicyclohexylborane, dimethylcyclohexylborane, diethylcyclohexylborane, dipropylcyclohexylborane, diisopropylcyclohexylborane, lithium tetramethylboron, lithium tetraethylboron, lithium tetrapropyllboron, lithium tetraisopropylboron, tetrabutylboron, lithium tetraisobutylboron, lithium tetra-sec-butylboron, tetra-tert-butylboron, lithium tetraphenylboron, potassium hydroxide with trimethylboron, potassium hydroxide with triethylboron, potassium hydroxide with tripropyllboron, potassium hydroxide with tri-isopropylboron, tributylboron, potassium hydroxide with triisobutylboron, potassium hydroxide with tri-sec-butylboron, tri-tert-butylboron, potassium hydroxide with triphenylboron, vinyl-phenylboronic acid, 4-vinylphenylboronic acid, boron phosphide, boron carbide, borinoaminoborine, boroethane, pentaborane, hexaborane, decaborane, triselenideborane, hexasilicide borane, trisilicide borane, trichloroborine dimethyletherate, trichloro-borine trimethlyammine, trimethylborine trimethlyammine, trimethyl-borine triethlyammine, triethylborine trimethlyammine, tricyclo-hexylborine, tri-n-hexyltriborine trioxane, triisoamylborate, triisoamylborine, tri-p-anisylborine, trimethoxyboroxine, tri-methylamminoborine, triethylamminoborine, tripropylamminoborine, triisopropylamminoborine, triisobutylamminoborine, tributylam-minoborine, tri-sec-butylamminoborine, tri-tert-butylamminoborine, triphenylamminoborine, tribenzylamminoborine, trimethylamminoboric acid, triethylamminoboric acid, tripropylamminoboric acid, triisopropylamminoboric acid, triisobutylamminoboric acid, tributylamminoboric acid, tri-sec-butylamminoboric acid, tri-tert-butylamminoboric acid, triphenylamminoboric acid, tribenzylam-minoboric acid, trimethyldiborane, triethyldiborane, tripropyldiborane, trimethyltriborinetriamine (B), triethyltriborinetriamine (B), trimethyltriborinetriamine (N), triethyltriborinetriamine (N), trimethyltriborinetriamine (N-B-B'), triethyltriborinetriamine (N-B-B'), tri-B-naphthylborate, tri-a-naphthaborate, tripehnyl-borineammine, tri-p-tolyborine, tri-p-xylxborine, including analogues, homologues, isomers and derivatives thereof. Corresponding compounds of aluminum, gallium, indium, and thallium are contemplated. See Organo Boron Chemistry, Volumes I & II (and subsequent volumes, editions, or supplements), Howard Steinberg, lnterScience Publishers (1966), Boron-Nitrogen Compounds, Niedenzu, Dawson, N.Y., Academic Press (1965), The Organic Compounds of Boron, Aluminum, Gallium, Indium, and Thallium, Nesmeianov, Nikolaevich, Amterdam, North-Holland Pub. Co. (1967), Peroxides, Superperoxides, and azomides of Alkali and Alkali Earth Metals, Perekisi, N.Y., Plenum Press (19966), incorporated herein by reference.

Non-limiting examples of sodium derivative compounds of this invention include: sodium bis(dimethylsilyl)amide, sodium bis(trimethylsilyl)amide, oxamic acid, P-aminosalicylic acid sodium salt, sodium salt 5-nitroorotic acid, sodium D-gluconate, sodium hexacyanoferrate(III) (Li3Fe(CN)6), sodium diphenylphosphide, sodium acetate, sodium acetate acid, sodium salt acetic acid, sodium acetamide, sodium anilide, sodium azide, ammonium diisodium amminepentacyanoferrate, sodium benzamide, sodium antimonide, sodium orthoarsenate, sodium orthoarsenite, sodium meta-arsenite, sodium diborane, sodium pentaborate, sodium dihydroxydiborane, sodium borohydride, sodium cadium iodide, sodium chloride, sodium calcium chloride, sodium carbide, sodium carbonate, sodium hydrogen carbonate, sodium carbonate, sodium carbonyl, sodium cobalt(II) cyanide, sodium cobalt(III) cyanide, sodium cobaltinitrite, sodium cynomanganate(II), sodium cynomanganate(III), sodium citrate, sodium ferrosilicon, sodium ferricyanide, sodium ferrocyanide, sodium nitroferricyanide, sodium amminepentacyanide, sodium hydride, sodium hydroxide, sodium manganate, sodium permanganate, sodium methionate, sodium napthenate, sodium nitride, sodium nitrate, sodium nitrite, sodium nitrobenzene (e.g. sodium-p-nitrobenzene), sodium nitrophenoxide, sodium etherate, sodium chromate, sodium oleate, sodium oxalate, sodium oxalatoferrate(II), sodium oxalatoferrate(III), sodium monoxide, sodium oxide, sodium peroxide, sodium, sodium mono-orthophosphate, sodium hypophosphite, sodium orthophosphite, sodium hydroxoplumbate, sodium rhodium cyanide, sodium selenide, sodium selenite, sodium selenocynate, sodium selenocyanoplatinate, sodium disilicate, sodium metasilicate, lithium sodium carbonate, lithium sod ium ferricyanide, sodium hydroxostannate, sodium disufide, sodium hydrosulfide, sodium pentasulfide, sodium tetrasulfide, sodium trisulfide, sodium telluride, sodium thioarsenate, sodium thioar-senite, sodium trithiocarbonate, sodium thiocyanate, sodium amide, sodium salt (E,E)-2,4-hexadienoic acid, disodium fluorophosphate, disodium fluorophosphite, trisodium phosphate, trisodium phosphite, sodium perchlorate, propanoic acid sodium salt, sodium formate, sodium cyanate, sodium hexacyanocobaltate(III), sodium hypo-phosphite, sodium hexaflurorsilicate, sodium nitroprusside, sodium phenoxide, sodium phosphate (dibasic, monobasic, tribasic), sodium salicylate, sodium selenide, sodium tetracyanonickelate(II), sodium tetrafluoroborate, sodium xanthogenate, sodium-p-aminoben-zoate, sodium copper ferrocynanide, sodium cupric ferrocyanide, sodium hexafluorophosphate, sodium hexanitricobaltate III, sodium naphthenate, sodium-B-naphthoxide, sodium polysulfide, lithium sodium phosphate, sodium stearate, sodium sulfide, sodium sulfite, sodium sulfate, sodium thiocyanate, sodium xanthate, sodium fluorosilicate, N-sodiumethylenediamine, oxalic acid disodium salt, sodium beta-hydropyruvic acid, sodium 1,1-dimethylurea, sodium 1,1-diethylurea, sodium 1,1-diepropylurea, sodium xanthate, sodium ethylxanthate, sodium methylxanthate, sodium salt thio-phenol, sodium triphenylmethylsodium, methylsodium, ethylsodium, sodiumethynyl(acetylide), propylsodium, isopropylsodium, butylsodium, isobutylsodium, secbutylsodium, tertbutylsodium, pentasodium, hexylsodium, heptasodium, amylsodium, isoamylsodium, benzylsodium, dimethylbenzylsodium, tolylsodium, dodecylsodium, cyclopentadienylsodium, methylcyclopentadienylsodium, cyclohexylsodium, sodiumheptyl, sodiumdodecyl, sodium tetradecyl, sodium hexadecyl, sodium octadecyl, phenylsodium, sodium o-tolyl, sodium m-tolyl, sodium p-tolyl, sodium-p-chlorophenyl, sodium p-bromo-phenyl, sodium sodium o-anisyl, sodium m-anisyl, sodium p-anisyl, sodium diethoxyphenyl, sodium dimethoxyphenol, sodium m-cumyl, sodium p-ethoxyphenyl, sodium m-dimethylaminophenyl, sodium 9-flourene, sodium a-napthyl, sodium b-napthyl, sodium p-phenyl-phenyl, sodium 9-phenylanthryl, sodium 9-anthryl, sodium 9-methylphenanthryl, sodium pyridyl, sodium 2-pyridyl, sodium 3-pyridyl, sodium 6-bromo-2-pyridyl, sodium 5-bromo-2-pyridyl, sodium dibenzofuryl, sodium 3-quinoyl, sodium 2-lepidyl, sodium triphenyl-methyl, sodium 2,4,6-trimethylphenyl, sodium 2,4,6-triisopropyl-phenyl, sodium 2,3,5,6-tetraisopropylphenyl, sodium tetrabutyl-phenyl, thiophenedisodium, toluenedisodium, diphenylethylenedi-sodium, sodiumamylethynyl, sodiumphenylethynyl, sodium-methoxybromophenyl, sodium phenylisopropyl, sodium tetraphenyl-boron, sodium tetramethylboron, sodium a-thienyl, sodium m-trifluoromethylphenyl, phenylethynylsodium, 3-furylsodium, phenylisopropylsodium, dibenzofuranylsodium, sodium dimethylbenzyl, sodium selenocyanate, sodium trimethylsilanolate, diphenyl-phosphide, sodium benzoate, sodium tert-butyl carbonate, sodium azide, di-sodiumcyanamide, sodium cyanide, sodium dicyanamide, cyclohexanebutyric acid sodium salt, cyclohexane acid sodium salt, cyclopentadientylsodium, sodium tri-tert-butoxyaluminum hydride, sodiumaluminum-tri-tert-butoxide, sodium triethylborohydride, sodium trimethylborohydride, sodium tripropylborohydride, sodium triisopropylborohydride, sodium tributylborohydride, sodium triisobutylborohydride, sodium tri-sec-butylborohydride, sodium tri-tert-butylborohydride, sodium trisiamylborohydride, sodium chlorate, sodium tert-butoxide, sodium sec-butoxide, iso-butoxide, sodium antimonate, sodium diphenylphosphide, sodium bis(trismethyl-silyl)amide, trisodium phosphite, sodium selenocyanate, sodium tri-sec-butylborohydride, sodium triethylsilanolate, sodium thiocyanate, sodium acetylide, sodium chlorate, sodium salicylate, sodium di-sodium tetracarbonylferrate, sodium tetraphenylborate, sodium triethylborohydride, sodium triacetoxyborohydride, sodium triphenylborane, sodium hydroxide, sodium diphenylphosphide, sodium methoxide, sodium ethoxide, sodium tri-sec-butylborohydride, tri-tert-butylborohydride, sodium triethylborohydride, sodium tri-phenylborohydride, sodium trisiamylborohydride, sodium metavanadate, sodium cyclohexanebutyrate, sodium hexachloroplatinate, sodium thiocyanate, sodium selenocyanate, sodium cyanate, sodium floride, sodium hexafluoroantimonate, sodium hexafluoroaluminate, sodium hexafluoroarsenate, sodium hexafluorosilicate, sodium hexacyanocobalt(II)ferrate(II), disodiumhexacyanocobalt (I)-ferrate(II), sodium hexafluorotitanate, sodium hexafluorozirconate, sodium hexahydroxyantimonate, sodium hexachlororuthenate, sodium hexachloropalladate, sodium formate, sodium tetracyanonickelate, sodium-tetrafluoroaluminate, sodium tetrafluoroborate, sodium thioacetate, L-glutamic acid monosodium salt, fumaric acid sodium salt, oxamic acid sodium salt, sodium salt diphenyl-phospane, P-aminobenzoic sodium salt, aminobenzole acid sodium salt, alpha-napthaleneacetic acid sodium salt, disodium salt 2,6-naphth-alenedicarboxlic acid, sodium cycicohexanetherate, sodium phthalimide, P-aminosalicylic acid sodium salt, sodium salt 3,5-dimethyl-cyclohexyl sulfate, indolebutyric acid sodium salt, indole-3-butyric acid sodium salt, diphenylphosphide, sodium dimethylsilanolate, sodium triethylborohydride, sodium propoxide, sodium isopropoxide, sodium butoxide, sodium sec-butoxide, sodium pentoxide, sodium tert-pentoxide, sodium hydrogenphthalate, sodium oxalate, sodium hydrogensulfate, monosodium acetylenedicarboxylic acid, sodium pyrophosphate, sodium dihydrogenphosphate, sodium hexoate (sodium salt hexoic acid), sodium diphenylphosphide, sodium trimethyl-silonalate, sodium phthalic acid, P-aminobenzoic acid sodium salt, monosodium L-aspartic acid, tetraphenyldisodium (C6H5)2-CLi2C (C6H5)2, sodiumethylphenyl (LiCH2C6H5), sodium bromate, sodium hydrogenphospate, monsodium salt D-shaccharic acid, DI-asparatic sodium salt, (R)-alpha-hyroxymethylaspartic acid sodium salt, sodium fluoride, sodium iodate, sodium salt ethyl malonate, sodium thioacetate, sodium phenol, sodium salt aminobenzoic acid, sodium aminophenol salt, sodium cyclohexenol, sodium methylcyclohexenol, sodium cyclopropanol, sodium methylcyclopropanol, sodium cyclobutanol, sodium methylcyclobutanol, sodium methylcyclopentanol, sodium cyclopentanol, sodium cyclohexenol, sodium methylcyclohexenol, sodium dimethylcyclohexenols (e.g. sodium 3,5-dimethylcyclohexanol, sodium 2,3-dimethylcyclohexanol, sodium 2,6-dimethylcyclohexanol, sodium 2,5-dimethylcyclohexanol, 3,5-dimethylcyclohexanol), sodium o-ethylxanthic acid, monosodium salt 2-ketoglutaric acid, disodium salt, ketomalonic acid, sodium salt lactic acid, disodium thiosulfate, sodium antimony tartrate, sodium dichloroacetate, sodium dimethylacetate, sodium diethylacetate, sodium dipropylacetate, sodium metaborate, sodium tetraborate, sodium tetrachlorocuprate, sodium acetoacetate, sodium diisopropylamide, sodium diethylamide, sodium dimethylamide, sodium bis(dimethylsilyl)amide, disodium phthalocyanine, disodium-tetrabromocuprate, disodium tetrabromonickelate, disodium-tetrachloromanganate, disodiumbutadiyne, sodium cyclopentadienide, sodium dicyclohexylamide, sodium diethylamide, sodium dimethylamide, sodium dipropylamide, sodium diisopropylamide, sodium thexylborohydride, sodium tri-tert-butoxyaluminohydride, sodium trimethylsilyl)acetylide, sodium triethylsilyl)acetylide, sodium tris[(3-ethyl-3-pentyl)oxy]aluminohydride, (phenylethynyl)sodium, 2-thienylsodium, sodium diethyldihydroaluminate, sodium dimethyldihydroaluminate, sodium aluminum hydride, sodium bifluoride, sodium biphenyl, sodium biselenite, sodium bis(2-methoxyethoxy)-aluminum hydride, sodium bismuthate, sodium borate, sodium chlorite, sodium cobaltnitrite, sodium cyanoborohydride, sodium cyclopentadienide, sodium dicyanamide, sodium hexametaphosphate, sodium hexanitrocolbaltate, sodium hydrogenphosphite, sodium hydrogenselenite, sodium hydrogensulfite, sodium hydrosulfite, sodium hypochloride, sodium metaarsenite, sodium metabisulfide, sodium metaperiodate, sodium methacrylate, sodium nitro-ferricyanide, oxybate, sodium pentamethylcyclopentadienide, sodium phenolate, polyphosphate, sodium polyphosphite, sodium propionate, sodium pyrophosphate, sodium selenate, sodium selenite, sodium tetrachloroaluminate, sodium thiomethoxide, sodium thiosulfate, sodium thiosulfide, sodium thiosulfite, sodium tri-actoxyborohydride, sodium sodium trimethylsilonate, sodium triethylsilonate, sodium tris(1-pyrazoly)borohydride, including analogues, homologues, isomers and derivatives thereof.

The non limiting examples of aluminum derivative compounds of this invention include: diisobutylaluminum hydride, dimethylaluminum hydride, dimethylaluminum hydride, dipropylaluminumhydride, diisopropylaluminumhydride, dibutylaluminumhydride, di-tert-butylaluminum hydride, di-sec-butylaluminum hydride, di-isobutylaluminum chloride, ethylaluminum sesquichloride, lithium aluminum hydride, lithium tri-tert-butoxyaluminum hydride, lithium aluminum alloy, aluminum triethoxide, aluminum trimethoxide, aluminum tripropoxide, aluminum triisopropoxide, aluminum tri-tert-butoxide, aluminum tri-sec-butoxide (aluminum sec-butoxide), aluminum tri-isobutoxide, aluminum tributoxide, aluminum pentoxide, diethylaluminum ethoxide, aluminum phosphate, diethylaluminum chloride, diethylaluminum cyanide, diethylaluminum ethoxide, diethylaluminum methoxide, diisobutylaluminum hydride, diisobutylaluminum chloride, diisobutyalumnum fluoride, tetraisobutyl-dialuminoxane, triethylaluminum, trimethylaluminum, tributyl-aluminum, triisobutylaluminum, tri-sec-butylaluminum, tri-tert-butylaluminum, tripentaluminum, triphenylaluminum, triamylaluminum, triisoamylaluminum, tripropylaluminum, triisopropylaluminum, triisobutylaluminum, triisobutyldialuminoxane, trioctylaluminum, sodium aluminum hydride, bis(2-methoxyethoxy)aluminum hydride, aluminum borohydride, aluminum hydride, dimethylberyllium, potassium tri-tert-butoxyaluminum hydride, sodium tri-tert-butoxyaluminum hydride, lithium tri-tert-butoxyaluminum hydride, aluminum sec butoxide, aluminum tert-butoxide, aluminum acetyl-acetone, aluminum ethoxide, aluminum methoxide, aluminum propoxide, aluminum isopropoxide, aluminum butoxide, aluminum isobutoxide, aluminum pentoxide, aluminum metaphosphate, aluminum hydroxide, aluminum metaphosphite, aluminum monostearate, aluminum hydroxystearate, aluminum nitrate, aluminum fluoride, aluminum fluoride trihydrate, sodium diethyldihydroaluminate, sodium hexafluoro-aluminate, aluminum hexafluorosilicate, lithium aluminum hydride, lithium aluminum hydride bis(tetrahydrofuran), lithium tris((3-thyl-3-pentyl)oxy)aluminohydride, lithium tri-tert-aluminohydride, aluminum nickel catalyst, aluminum silicate, aluminum silicate hydroxide, aluminum chloride hydrate, diethylaluminum chloride, sodium bis(2-methoxyethoxy)aluminum dihydride, aluminum carbide, aluminum phosphate, aluminum acetate (aluminum diacetate hydroxide), dihydroaluminum acetate, aluminum formoacetate, lithium aluminate, aluminum salt lactic acid, tetramethyllithiumaluminum salt (LiAl (CH3)4), tetaethyllithiumaluminum salt, tetrapropyl-lithiumaluminum salt, tetraisopropyllithiumaluminum salt, tetrabutyllithiumaluminum salt, tetraisobutyllithiumaluminum salt, tetra-sec-butyllithiumaluminum salt, tetra-tert-butyllithiumaluminum salt, tetraphenyllithium aluminum salt, aluminum tririconoleate, aluminum metaphosphate, sodium aluminum hydride, aluminum dodecaboride, aluminum diboride, aluminum arsenide, aluminum lactate, aluminum titanium chloride, tri(N-nitroso-N-phenylhydroxylaminoato) aluminum, aluminum acetylacetonate, methylaluminumdichloride, ethylaluminum dichloride, propylaluminum dichloride, isopropylaluminum dichloride, butylaluminum dichloride, sec-butylaluminum dichloride, tert-butylaluminum dichloride, isobutylaluminum dichloride, phenylaluminum dichloride, ethylaluminum sesquichloride, methylaluminum sesquichloride, methylaluminoxane, propylaluminum sesquichloride, ethylaluminoxane, sodium bis(2-methoxyethoxy)aluminum, aluminum magnesium silicate, aluminum hydroxychloride, aluminum phosphide, aluminum potassium sulfide, aluminum stearate, aluminum octoate (aluminum ethylhexonate), aluminum diformate, aluminum triformate, aluminum chromate, aluminum napthenate, aluminum oleate, aluminum palmite, aluminum pictrate, aluminum sodium silicate, aluminum sodium chloride, aluminum isopropylate, aluminum magnesium ethoxide, trimethylaluminum etherate, triethylaluminum etherate, including analogues, homologues, isomers and derivatives thereof. Corresponding compounds of gallium, indium, thallium are contemplated in the practice of this invention.

The non-limiting examples of silicon derivative compounds of this invention include: dimethoxymethylsilane, dimethoxyethylsilane, diethoxymethylsilane, dipropoxymethylsilane, diisopropoxymhethylsilane, dibutoxymethylsilane, diisobutoxymethylsilane, di-sec-butoxymethylsilane, di-sec-butoxymethylsilane, diethoxyethylsilane, dipropoxyethylsilane, diisopropoxyethylsilane, dibutoxyethylsilane, diisobutoxyethylsilane, di-sec-butoxyethylsilane, di-sec-butoxyethylsilane, diethoxydimethylsilane, diimethoxydimethylsilane, dipropoxydimethylsilane, diisopropoxydimethylsilane, dibutoxydimethylsilane, diisobutoxydimethylsilane, di-sec-butoxydimethylsilane, di-sec-butoxydimethylsilane, diethoxymethylethyl-silane, ethoxytrimethylsilane, ethoxytriethylsilane, ethoxytri-propylsilane, ethoxytriispropylsilane, methoxytrimethylsilane, propoxytrimethylsilane, isopropoxytrimethylsilane, butoxytrimethyl-silane, isobutoxytrimethylsilane, sec-butoxytrimethylsilane, sec-butoxytrimethylsilane, phenoxytrimethylsilane, ethoxydiethylsilane, isobutyldiethoxysilane, sec-butyldiethoxysilane, butyldiethoxy-silane, tertbutyldiethoxysilane, pentyldiethoxysilane, isobutyl-dimethoxysilane, secbutyldimethoxysilane, butyldimethoxysilane, tertbutyltrimethoxysilane, methyltrimethoxysilane, methyltriethoxysilane, pentyldimethoxysilane, diethylsilandiol, tripropylsilan-diol, triisopropylsilandiol, tertbutyldimethylsilane, diethyl-silanediol (C2H5Si(OH)2), methyl-tripropoxysilane, methyltris(dimethylsiloxy)silane, 1,1-diphenylsilacyclohexane, pentamethylsilanime, 1,1,1-trimethyl-N-phenyl-N-silanamine, hexamethyldisilazane, [1,1'-biphenyl]-4-yltrichlorosilane, (bromomethyl)chlorodimethylsilane, bromomethyltrimethylsilane, (4-bromophenoxy)trimethylsilane, butylchlorodimethylsilane, trichlorobutylsilane, trimethylbutylsilane, chloro(chloromethyl)dimethyl-silane, chloro(dichloromethyl)dimethylsilane, chlorodimethylphenyl-silane, chlorodimethyl-2-propenylsirane, chloroethenyldimethyl-silane, chloromethylsilane, (chloromethyl)dimethylphenylsilane, chloromethytdiphenylsilane, chloromethylphenylsilane, (chloromethyl)trimethylsilane, (4-chloropehoxy) trimethylsilane, phenylchlorosilane, (3-chlorophenyl) trimethylsilane, (3-chloropropyl)trimethylsilane, chlorotriethoxysilane, chlorotriethylsilane, trimethylchlorosilane, dichloro(chloromethyl)methylsilane, dichloro (dichloromethyl)methylsilane, dichlorodiethoxysilane, dichlorodiethylsilane, dichlorodimethylsilane, dichlorodiphenyl-silane, dichloroethenylmethylsilane, methylethyldichlorosilane, dichloromethylsilane, dichloromethyl(1-methylethyl)silane, dichlbromethyl(4-methylphenyl)silane, dichloromethylphenylsilane, dichloromethyl-2-propenylsilane, dichlorophenylsilane, diethenyldiphenylsilane, diethoxydimethylsilane, diphenyldiethoxysilane, diethoxymethylphenylsilane, diethyloxymethyl-2-propenylsilane, diethylsilane, diethyldifluorosilane, difluorodiphenylsilane, dimethyoxydimethylsilane, dimethoxydiphenylsilane, dimethylsilane, dimethyldiphenoxysilane, dimethyldiphenylsilane, dimethyl-2-propenylsilane, dimethylphenylsilane, dimethyl-diacetatesilane, diphenylsilane, 1,2,-ethenediylbis[trimethyl-(E)]silane (C8H20Si2), ethenyldiethoxymethylsilane, ethenylethoxydimethylsilane, ethenyltriethoxysilane, ethenyltrimethylsilane, ethenyltris(1-methyl-ethoxy)silane, ethenyltris(2-propenyloxy)silane, ethoxytriethyl-silane, ethoxytrifluorosilane, ethoxytrimethylsilane, ethoxytri-phenylsilane, ethyltrifluorosilane, ethyltrimethoxysilane, 1,2,-ethynediylbis[trimethyl]silane, ethynylsilane, methoxysilane, methylsilane, methyldiphenylsilane, methylenebissilane, methylene-bis [trichloro]silane, (2-methylphenoxy)triphenylsilane, methylphenylsilane, methyltriphenoxysilane, methyltriphenylsilane, methyltri-p-toly-silane, phenylsilane, [1,3-phenylenebis(oxy)]bis-[trimethyl]silane, phenyltripropylsilane, tetraethenylsilane, tetraethylsilane, tetraethoxysilane, tetramethylsilane, tetra-methoxysilane, tetrapropylsilane, tetrapropoxysilane, tetraisopropylsilane, tetraisopropoxysilane, tetrabutylsilane, tetra-butoxysilane, tetra-sec-butylsilane, tetra-sec-butoxysilane, tetra-tert-butylsilane, tetra-tert-butoxysilane, tert-iso-butylsilane, tetra-isobutoxysilane, tetraphenylsilane, tetraphenoxysilane, triethylsilane, triethoxysilane, trimethylsilane, trimethoxysilane, tripropylsilane, tripropoxysilane, triisopropylsilane, triisopropoxysilane, tributylsilane, tributoxysilane, tri-sec-butylsilane, tri-sec-butoxysilane, tri-tert-butylsilane, tri-tert-butoxysilane, tert-iso-butylsilane, tri-iso-butoxysilane, triphenylsilane, triphenoxysilane, triethylmethylsilane, triethoxymethyl-silane, trimethoxymethylsilane, tripropylmethylsilane, tripro-poxymethylsilane, triisopropylmethylsilane, triisoproxymethylsilane, tributylmethylsilane, tributoxymethylsilane, tri-sec-butylmethylsilane, tri-sec-butoxymethylsilane, tri-tert-butyl-methylsilane, tri-tert-butoxymethylsilane, tert-iso-butylmethyl-silane, tri-iso-butoxymethylsilane, triphenylmethylsilane, triphenoxymethylsilane, diethylsilane, diethoxysilane, dimethyl-silane, dimethoxysilane, dipropylsilane, dipropoxysilane, di-isopropylsilane, diisopropoxysilane, dibutylsilane, dibutoxysilane, di-sec-butylsilane, di-sec-butoxysilane, di-tert-butylsilane, di-tert-butoxysilane, tert-iso-butylsilane, di-iso-butoxysilane, diphenylsilane, diphenoxysilane, ethylsilane, ethoxysilane, methylsilane, methoxysilane, propylsilane, propoxysilane, iso-propylsilane, isoproxysilane, butylsilane, butoxysilane, sec-butylsilane, sec-butoxysilane, tert-butylsilane, tert-butoxysilane, iso-butylsilane, iso-butoxysilane, phenylsilane, phenoxysilane, tribromomethylsilane, tributylsilane, tributylphenylsilane, trichloro(chloromethyl)silane, trichloro(4-chlorophenyl)silane, trichloro(3-chloropropyl)silane, trichloro(dichloromethyl)silane, trichlorododecylsilane, trichloroethenylsilane, trichloroethoxy-silane, trichloroethylsilane, trichlorohexylsilane, trichloromethylsilane, trichloro(1-methylethyl)silane, trichloro(2-methyl-phenyl)silane, trichloro(3-methylphenyl) silane, trichloro(2-methylpropyl)silane, trichlorootadectylsilane, trichlorooctyl-silane, trichloropentylsilane, trichlorophenylsilane, trichloro(2-phenylethyl)silane, trichloro-2-propenylsilane, trichloropropylsilane, triethoxysilane, triethoxyethylsilane, triethoxyethylsilane, triethoxyphenylsilane, triethoxypentylsilane, triethoxy-2-propenylsilane, triethylsilane, triethylfluorosilane, triethylphenylsilane, trifluorophenylsilane, trimethoxymethylsilane, trimethoxyethylsilane, trimrethoxypropylsilane, trimethoxylsopropylsilane, trimethoxybutylsilane, trimeth-oxylsobutylsilane, trimethoxy-sec-butylsilane, trimethoxy-tert-butylsilane, trimethoxypheriylsilane, trimethylsilane, trimethyl(4-methylphenyl)silane, trimethyl(2-methylpropyl)silane, trimethylphenoxysilane, trimethylphenylsilane, trimethyl (phenylmethyl)silane, trimethyl(cyclohexylmethyl)silane, trimethyl-2-propenylsilane, trimethylpropylsilane, trimethyl [4-[(trimethylsilyl)oxy]phenyl]silane, ethenyltriacetatesilanetriol, methyltriacetatesilantriol, tripropylsilane, ethyldimethylsilanol, methyldiphenylsilanol, triethylsilanol, triphenylsilanol, tetrabutyl ester silicic acid,(C16H36O4Si), tetraethyl ester silicic acid, tetrakis(2-ethylbutyl)ester silicic acid, methylsilicate (C4H12SiO4), tetraphenyl ester silicic acid, tetrapropyl ester silicic acid, triethyl phenyl ester silicic acid, 1,2-dichloro-1,1,2,2-tetramethyldisilane, 1,2,-difluorotetramethyldisiiane, hexamethyldisilane, 1,3-diethenyl-1,1,3,3-tetramethyldisiloxane, 1,3-diethenyl-1,1,3,3-tetramethyldisilazane, bis-(methoxydimethylsilyl)oxide, 1,1,1,3,3,3-hexaethyldisiloxane, 1,1,1,3,3,3-hexaethyldisilazane, hexamethyldisiloxane, hexamethyl-disilazane, 1,1,3,3-tetramethyldisiloxane, 1,1,3,3-tetramethyl-disilazane, 1,1,3,3-tetramethyl-1,3-diphenyldisiloxane, 1,1,3,3-tetramethyl-1,3-diphenyldisilazane, 1,1,1-trimethyl-3,3,3-triphenyldisiloxane, 1,1,1-trimethyl-3,3,3-triphenyldisilazxane, docosamethyldecasiloxane, docosamethyldecasilazane, ethenylhep-tamethylcyctetrasiloxane, ethenylheptamethylcyctetrasilazane, heptamethylcyclotetrasiloxane, heptamethylcyclotetrasilazane, octaphenylcyclotetrasiloxane, butylmethyl(cyclic tetramer)siloxane, 2,4,6,8-tetraethenyl-2,4,6,8-tetramethylcyclotetrasiloxane (C12H24O4Si4), 2,4,6,8-tetraethyl-2,4,6,8-cyclotetrasiloxane, 2,4,6,8-tetraethyl-2,4,6,8-cyclotetrasilazane, 2,4,6,8-tetraethyl-2,4,6,8-cyclotetrasiloxane, 2,4,6,8-tetramethylcyclotetrasiloxane, 2,4,6,8-tetramethylcyclotetrasilazane, 2,4,6,8-tetramethyl-2,4,6,8-tetraphenylcyclotetrasiloxane, 2,2,4,4,6,6-hexamethyl-cyclotrisilazane, hexamethylcyclotrisiloxane, 2,4,6-triethyl-2,4,6-trimethylcyclotrisiloxane, 2,4,6-triethyl-2,4,6-trimethyl-cyclotrisiloxane, 2,4,6-triethyl-2,4,6-triphenylcyclotrisiloxane, 2,4,6-trimethyl-2,4,6-tripehnylcyclotrisiloxane, decamethylcyclopentasiloxane, decamethylcyclopentasiiazane, 2,4,6,8,10-pentamethylcyclopentasiloxane, 2,4,6,8,10-pentamethylcyclopentasilazane, octademethylcyclononasiloxane; octademethylcyclononasilazane, hexadecamethylcyclooctasiloxane, hexadecamethylcyclooctasilazane, dodecamethylcyclohexasiloxane, dodecamethyl-cyclohexasilazane, hexamethylcyclohexasiloxane, tetradecamethyl-cycloheptasiloxane, tetradecamethylcycloheptasilazane, decamethyl-tetrasiloxane, 1,1,1,3,5,7,7,7-octamethyltetrasiloxane, aminotri-silane, benzyltriethoxysilane, butyltrifluorosilane, carboxyethyl-dimethylsilane, chloromethylsilicane, chlorotriisocyanatesilane, dichloromethylsilicane, diethoxydibutoxysilane, diethylaniline-fluorosilicate, diethyldichlorosilane, [2-(cyclohexenyl)ethyl]triethoxysilane, [2-(cyclohexenyl)ethyl]methyldiethoxysilane, [2-(cyclohexenyl)ethyl]dimethylethoxysilane, [2-(cyclohexenyl)-ethyl]trimethylsilane, [2-(cyclohexenyl)ethyl]triethylsilane, cyclohexyldimethoxymethylsilane, cyclohexylmethoxydimethylsilane, cyclohexyltrimethylsilane, cyclohexyltriethylsilane, dicyclohexyldimethylsilane, cyclohexyldimethylsilane, cyclohex-1-enyl-trimethylsilane, benzyltrimethylsilane, (1-cyclohexen-1-ylethynyl)trimethylsilane, 1-cyclohexenyltrimethylsilane, cyclohexenyloxytrimethylsilane, cyclohexyltrichlorosilane, 1-cyclopropyl-1-(trimethylsilyloxy)ethylene, phenyldimethylsilanol, phenylsilandiol, cyclohexylsilandibi, cyclohexylethylsilandiol, tert-butylsilandiol, cyclohexyldimethylsilanol, cyclohexyldiethylsilanol, benzyltrimethylsilane, N-benzyltrimethylsilylamine, phenyl dimethylsilanol, phenyl diethylsilanol, cyclohexylethylenetrimethylsilane, N-cyclohexylethylenetrimethylsilylamine, cycloethylenetrimethyl-silane, diphenyldiethoxysilane, diphenyldimethoxysilane, diphenyl-methylethoxysilane, diphenylmethylsilane, diphenylmethylsilandiol, diphenylsilandiol, methyl-phenyl-diethoxysilane, methyl-phenyldimethoxysilane, methyl-phenyl-dichlorosilane, octadecyltrimethoxysilane, octyltriethoxysilane, octyltrimethoxysilane, 1,3-bis(3-aminopropyl)-1,1,3,3-tetramethyldisiloxane, 1,3-bis(3-aminopropyl)-1,1,3,3-tetramethyldisilazane, tertbutyldimethylsilan-diol, hydroxymethylenetrimethylsilane (CH3)3CH2OH), hydroxyethylenetrimethylsilane, hydroxymethyltriethylsilane, hydroxyethyltriethylsilane, diethylsilanediol, dimethylsilanediol, dipropylsilanediol, diisopropylsilanediol, dibutylsilanediol, di-tert-butylsilanediol, di-iso-butylsilanediol, di-sec-butyl-silanediol, diphenylsilanediol, dicyclohexylsilanediol, cyclohexylmethylsilanediol, cyclohexylethylsilanediol, dimethoxydichloro-silane, dimethylanilineflourosilicate, dimethyldi(B-chloroethoxy)-silane, dimethylflourochlorosilane, dimethylsilicane, di-a-napthylamineflourosilicate, di-b-napthylamineflourosilicate, di-m-nitranilineflourosilicate, dinitrosodiphenylamine, diphenylarsinophenylenetriethylsilane, diphenydichlorophenoxysilane, di-o-toluidinefluorosilicate, di-m-toluidinefluorosilicate, di-p-toluidinefluorosilicate, docosamethyldecasiloxane, dodecamethylcyclohexasiloxane, dodecamethylpentasiloxane, eicosamethylnonasiloxane, silanesilanesilanedocosamethyldecasilazane, dodecamethylcyclohexasilazane, dodecamethylpentasilazane, eicosamethylnonasilazane, ethyldiethoxyacetoxysilane, ethyldiethoxychloro-silane, ethylisocyanatesilane, ethyltriethoxysilane, ethyltri-phenylsilicane, hexadacamethylcyclooctasiloxane, hexadacamethyl-cyclooctasilazane, hexamethylsilicane (hexamethyldisilane), hexamethylmethylenedislane, hydroxymethyltrimethylsilane, methyl-silicane, methyltripheriylsilicane, octadecamethylcotasiloxane, octamethylcyclotetrasiloxane, octamethyltrisiloxane, octadeca-methylcotasilazane, octamethylcyclotetrasilazane, octa-methyltrisilazane, tetraphenylenesilane, phenylenediamineflouro-silicate, phenylisocyanatesilane, phenyltrichlorosilicane, silicobenzoic acid, tetra-m-aminophenylsilane, tetrabenzylsilicane, tetra-p-biphenylylsilane, tetradecamethylcycloheptasiloxane, tetradecamethylcycloheptasilazane, tetradecamethylhexasiloxane, tetradecamethylhexasilazane, tetraethylsilane, tetraethyl-thiosilane, tetrahexyloxysilane, tetraisopropylmercaptane silicon, tetramethoxysilane, tetramethylmercaptanesilicon, tetramethyl-silane, tetraphenoxysilane, tetraphenylsilane, tertapropoxysilane, tetratriethylsiloxysilane, thioisocyanatotriethylsilane, tolidinefluorosilicate(o), tri-p-Biphenylylphenylsilane, trichloromethyltriethoxysilane, triethylbromosilane, triethylchlorosilane, triethylfluorosilane, triethylphenylsilane, trimethylchloromethyl-silane, trimethylethoxysilane, triphenylacetoxysilane, vinyltri-phenoxysilane, vinyltriethoxysilane, silicane cyanate, dibromo-silane, dibromodichlorosilane, dichlorosilane, dichlorodifluoro-silane, hexaoxocyclosilane, hexacyclosilazane, monooiodosilane, (tri-)nitrilosilane(silicylamine), trichlorosilane, tri-fluorosilane, silicane diimide (Si(NH)2), silicane tetramide, silicane isocyanate, silicon tetracetate, tetrabromosilane, silicon hex(di-)bromide, silcon carbide, tertachlorosilane, hexachlorodi-silane, tetrafluorosilane, hexafluorodisilane, silicon hydride (SiH4), disilane (Si2H6), trisilanepropane, tetrasilane butane, silicon nitride, silicon thiocyanate, disilicic acid, silicon cyanate, allylchlorodimethylsilane, ailylchloromethyldimethylsilane, allyldichlorodimethylfsilane, allyl(diisoproprylamino)dimethylsilane, allyloxy-tert-butyldimethylsilane, allyloxy-sec-butyldimethylsilane, allyloxy-iso-butyldimethylsilane, allylchloro-diethylsilane, allylchloromethyldiethylsilane, allyldichloro-diethylsilane, allyl(diisoproprylamino)diethylsilane, allyloxy-tert-butyldiethylsilane, allyloxy-sec-butyldiethylsilane, allyloxy-iso-butyldiethylsilane, allyloxybutyldimethylsilane, allyloxy-trimethylsilane, allyloxytriethylsilane, diallyloxydimethylsilane, triallyloxymethylsilane, diallyloxydiethylsilane, triallyloxyethylsilane, diallyloxydimethoxylsilane, triallyloxymethoxylsilane, diallyloxydiethoxylsilane, triallyloxyethoxylsilane, allyltri-chlorosilane, allyltriethoxysilane, allyltriisopropylsilane, allyltripropylsilane, allyltriisopropyloxysilane, allyltripropyloxysilane, allyltrimethoxysilane, allyltrimethylsilane, allyltriethylsilane, allyltriphenylsilane, 3-aminopropyltriethoxy-silane, 3-aminopropyltrimethoxysilane, 3-aminoethyltriethoxysilane, 3-aminoethyltrimethoxysilane, 3-aminomethyltriethoxysilane, 3-aminomethyltrimethoxysilane, 3-aminotrimethoxysilane, 3-aminotriethoxysilane, 3-amino(cyclohexyl)propyltriethoxysilane, 3-amino(cyclohexyl)propyltrimethbxysilane, 3-amino(cyclohexyl)ethyltriethoxysilane, 3-amino(cyclohexyl)ethyltrimethoxysilane, 3-amino(cyclohexyl)methyltriethoxysilane, 3-amino(cyclohexyl)methyltrimethoxysilane, 3-amino(cyclohexyl)trimethoxysilane, 3-amino(cylcohexyl)triethoxysilane, trimethoxypropylsilane, triethoxypropylsilane, trimethoxysilane, 3-aminopropyltrimethoxysilane, N-[3-(trimethoxysilyl)propyl]aniline, N-[3-(triethoxysilyl)propyl]-aniline, N-[3-(triethoxysilyl)ethyl]aniline, N'-[3-(trimethoxysilyl)propyl]diethylenetriamine, N-[3-(trimethoxysilyl)propyl]ethylenediamine, N-[3-(triethoxysilyl)propyl]ethylenediamine, 3-(trimethoxysilyl)propyl methacrylate, 3-(triethoxysilyl)prbpyl methacrylate, aminotriphenylsilane, azidotrimethylsilane, azidotriethylsilane, azidotripropylsilane, azidotributylsilane, azidotrimethoxysilane, azidotriethoxysilane, azidotripropoxysilane, azidotributoxysilane, bis[3-(trimethoxysilyl)propyl]amine, N,O-bis(trimethylsilyl)acetamide, bis(trimethylsilyl)acetylene, bis(trimethylsilyl)cyclopentadiene, 1,4-bis(trimethylsilyl)benzene, N,O-bis(trimethylsilyl)hydroxylamine, bis(trimethylsilyl)methane, 2,3-bis(trimethylsilyloxy)-1,3-butadiene, 1,2-bis(trimethylsilyloxy)cyclobutene, 1,2-bis(trimethylsilyl)cyclobutene, 1,2,3-bis(trimethylsilyl)cyclobutene, 1,2,3,4-bis(trimethylsilyl)cyclo-butene, bis(trimethylsilyl)cyclobutene, 1,2-bis(trimethylsilyl-oxy)ethane, 2,3-bis(trimethylsilyl)-1-propene, 2,4-bis(trimethylsilyloxy)pyrimidine, 1,3-bis(trimethylsilyl)urea, O,O'-bis(tri-methylsilyl)uracil, bis(trimethylsilyl)trifluoroacetamide, (1-cyclohexenyl-1-ethynyl)trimethylsilane, 1-cyclohexenyloxytrimethyl-silane, 1-cyclohexyltrimethylsilane, cyclohexyldimethoxysilane, cyclohexyltrimethoxysilane, cyclohexyldiethoxysilane, cyclohexyltriethoxysilane, cyclohexyldimethoxymethylsilane, cyclohexyltrimethoxysilane, cyclohexyldiethoxymethylsilane, cyclohexyltriethoxysilane, cyclohexyldimethoxysilandiol, cyclohexyldiethoxysilandiol, cyclohexyldipropxymethylsilane, cyclohexyldipropxymethylsilandiol, cyclohexyltrichlorosilane, [(1-cyclopropyletheneyl)oxy]trimethylsilane, diallyldimethylsilane, diethoxymethylphenylsilane, 3-(diethoxymethylsilyl)propylamine, diethoxymethylsilane, dimethyloctadecyline, ethyltriacetoxysilane, methyltriacetoxysilane, propyltriacetoxysilane, isopropyltriacetoxysilane, butyltriacetoxysilane, isobutyltriacetoxysilane, sec-butyltriacetoxysilane, tert-butyltriacetoxysilane, benzyltriacetoxysilane, phenyltriacetoxysilane, cyclpentadienyltriacetoxysilane, cyclohexyltriacetoxysilane, isopropoxytrimethylsilane, isopropylaminotrimethylsilane, lithium bis(trimethylsilyl)amide, methoxydimethyloctylsilane, methylbis(trimethylsilyloxy)vinyl-silane, octyltriethoxysilane, octyltrimethoxysilane, (phenylthiomethyl)trimethylsilane, phenyltriethoxysilane, phenyltrimethoxysilane, poly(dimethylsiloxane)silicon hexaboride, silicon nitride, silicon tetracetate, silicon tetrachloride, silicon tetrafluoride, sodium bis(trimethylsilyl)amide, tetrakis-(trimethylsilyl)silane, tetravinylsilane, trichloro-3-chloropropyl-silane, trichlorocyclopentysilane, cyclohexyltrichlorosilane, trichlorovinylsilane, 3-(triethoxysilyl)propionitrile, 3-(tri-methoxysilyl)propylamine, 3-(trimethoxysilyl)propyl isocyanate, 3-(trimethoxysilyl)propyl thiocyanate, trihexylsilane, triisopropyl-silane, (triisopropylsilyl)acetylene. (chlorotriisopropylsilane), triisopropylsilylchloride, 1-(triisopropylsilyl)pyrrole, trimethylsilylacetate, (trimethylsilyl)acetic acid, (trimethylsilyl)-acetylene, trimethylsilyl cyanide, (trimethylsilyl)diazomethane, 5-(trimethylsilyl)-1,3-cyclopentadiene, 1-(trimethylsilyl)imid-azole, 1-(trimethylsilyl)pyrrolidine, triphenylsilane, 1,1,1-triphenylsilylamine, triphenylsilylchloride, tris(2-methoxyethoxy)-vinylsilane, 2,5,5-tris(trimethylsilyl)-1,3-cylcopentadiene, tris(trimethylsilyl)borate, tris(trimethylsilyl)amine, tris(tri-methylsilyl)germaniumhydride, tris(trimethylsilyl)methane, tris(trimethylsilylmethyl)borane, tris(trimethylsilyloxy)silane, vinyltrimethoxysilane, vinyltrimethylsilane, trimethylsilyl N-(trimethylsilyl)-carbamate, triphenylsilylamine, triethoxysilyl-amine, tributoxysilyamine, tripropoxysilylamine, vinyltrichloro-silane, vinyltriethoxysilane, vinyl-triisopropoxsilane, vinyltri-methoxysilane, vinyltriethoxysilane, dimethoxymethylvinylsilane, diethoxymethylvinylsilane, dimethoxyethylvinylsilane, diethoxy-ethylvinylsilane, dimethylmethoxyvinylsilane, dimethylethoxyvinyl-silane, dimethylpropoxyvinylsilane, dimethylisopropoxyvinylsilane, diethylmethoxyvinylsilane, diethylethoxyvinylsilane, diethylpropoxyvinylsilane, diethylisopropoxyvinylsilane, dimethylethoxy(methylvinyl)silane, dimethoxymethyl(ethylvinyl)silane, diethoxymethyl(propylvinyl)silane, vinyltrimethylsilane, vinyltriethyl-silane, vinyltriphenylsilane, vinyltris(2-butylidenaminooxy)silane, vinyltris(2-methoxyethoxy)silane, vinyltris(2-methylethoxy)silane, vinyltris(2-ethoxy)silane, vinyltris(trimethylsiloxy)silane, 3-(2-aminoethylamino)propyltrimethoxysilane, 3-aminopropylmethyldiethoxysilane, 3-aminopropyltriethoxysilane, 3-aminopropyltrimethoxysilane, 3-aminomethyltriethoxysilane, 3-aminoethyltriethoxy-silane, 3-aminopropyltrimethoxysilane, 3-aminomethyltrimethoxy-silane, 3-aminoethyltrimethoxysilane, (3-aminopropyl)tris[2-(2-methoxyethoxy)ethoxysilane, amyltriethoxysilane, 1,3-bis(chloromethyl)-1,1,3,3-tetramethyldisilazane, 1,3'-bis(chloromethyl)-1,1,3,3-tetramethyldisiloxane, 1,2-bis(chlorodimethylsilyl)ethane, 1,3-bis(3-cyanopropyl)tetramethyldisiloxane, 1,3-bis(3-cyanopropyl)tetramethyldisilazane, bis(diethylamino)dimethylsilane, bis(dimethylamino)dimethylsilane, bis(diethylamino)diethylsilane, bis(dimethylamino)diethylsilane, 1,2-bis[(dimethylamino)dimethylsilyl]ethane, 1,2-bis(dimethylsilyl)benzene, 1,2-bis(dimethylsilyl)cyclohexene, 1,4-bis(dimethylsilyl)benzene, 1,4-bis(dimethylsilyl)cyclohexene, 1,3-bis(4-hydroxybutyl)-1,1,3,3-tetramethyldisiloxane, 1,3-bis(4-hydroxybutyl)-1,1,3,3-tetramethyldisilazane, bis(N-methylbenzamido)methylethoxysilane, 1,4-bis(trimethyl-silyl)butadiyne, N,O-bis(trimethylsilyl)acetimide, N,N-bis(tri-methylsilyl)methylamine, N,N-bis(trimethylsilyl)amine, N,N-bis(tri-ethylsilyl)amine, N,N'-bis(trimethylsilyl)urea, bis(trimethyl-silyl)phosphite, N,O-bis(trimethylsilyl)trifluoroacetimide, tert-butyldimethylsilane, tertbutyldimethylsilanol, (tert-butyldimeth-silyl)acetylene, tert-butyldimethylsilyl cyanide, N-(tert-butyl-dimethylsilyl) dimethylamine, butyldimethylchlorosilane, tert-butyldimethylchlorosilane, O-(tert-butyldimethylsilyl) hydroxyl-amine, 1-(tert-butyldimethylsilyl)imidazole, tert-butyldiphenyl-silyl cyanide, tert-butyldicyclohexylsilyl cyanide, N-tert-butyltrimethylsilylamine, tert-butyl-trimethylsilyl peroxide, tert-butyl-trimethylsilyl acetate, [2-(cyclohexenyl)ethyl]triethoxy-silane, N,N-diethyltrimethylsilylamine, N,N-diethyltriethyl-silylamine, N,N-diethyl (trimethylsilylmethyl)amine, diethyltrimethylsilyl phosphite, diphenylmethylsilane, dicyclohexylmethyl-silane, diphenylethylsilane, dicyclohexylethylsilane, diphenylsilane, dicyclohexylsilane, dicyclohexylsiladiol, 1,3-diphenyl-1,1,3,3-tertamethyldisilazane, 1,3-diphenyl-1,1,3,3-tertamethyldisiloxane, 1,3-dicyclohexyl-1,1,3,3-tertamethyl-disilazane, 1,3-dicyclohexyl-1,1,3,3-tertamethyldisiloxane, 1,3-divinyl-1,1,3,3-tetramethyldisilazane, 1,3-divinyl-1,1,3,3-tetramethyldisiloxane, dodecyltriethoxysilane, 1,1,3,3,5,5-hexamethyltrisilazane, 1,1,3,3,5,5-hexamethyltrisiloxane, methyltriethoxysilane, ethyltriethoxysilane, propyltriethoxysilane, isopropyltriethoxysilane, butyltrimethoxysilane, butyltriethoxy-silane, isobutyltriethoxysilane, sec-butyltriethoxysilane, tert-butyltriethoxysilane, hexyltriethoxysilane, (3-isocyanatropropyl)-triethoxysilane, (isopropenyloxy)trimethylsilane, isopropyl-dimethylchlorosilane, lithium bis(trimethylsilyl)amide, potassium bis(trimethylsilyl)amide, (3-mercaptopropyl)methyldimethoxysilane, (3-mercaptopropyl)triethoxysilane, (3-mercaptopropyl)trimethoxy-silane, (methoxymethyl)trimethylsilane, methoxytrimethylsilane, ethoxytrimethylsilane, [3-(methylamino)propyl] trimethoxysilane, methyldiethoxysilane, 2-methylbenzosilylazole, methyl-octadecyldichlorosilane, methyl-octyldimethoxysilane, methyl-octyldichlorosilane, methyl-phenyl-chlorosilane, methyl-phenyl-dichlorosilane, methyl-phenyl-diethoxysilane, methyl-phenyl-dimethoxysilane, (methylthio)trimethylsilane, methyltriactoxysilane, methyltrichlorosilane, ethyltrichlorosiiane, methylethoxysilane, ethylethoxysilane, methyltriethoxysilane, ethyltrimethoxysilane, ethyltriethoxysilane, N-methyl-N-trimethylsilylacetamide, methylvinyldiethoxysilane, phenyltriethoxysilane, cyclohexyltriethoxysilane, Phenyltrimethoxysilane, cyclohexyltrimethoxysilane, Phenyl(methylene)triethoxysilane, cyclohexyl(methylene)triethoxysilane, phenyl(methylene)trimethoxysilane, cyclohexyl(methylene) trimethoxysilane, Phenyl(ethylene)triethoxysilane, cyclohexyl(ethylene)triethoxysilane, phenyl(ethylene)trimethoxysilane, cyclohexyl(ethylene)trimethoxysilane, phenyltrimethylsilane, phenyltriethylsilane, phenyltripropylsilane, phenyltriisopropylsilane, phenyltributyl-silane, phenyltri-sec-butylsilane, phenyltri-tert-butylsilane, phenyltriisobutylsilane, cyclohexyltrimethylsilane, cyclohexyltriethylsilane, cyclohexyltripropylsilane, cyclohexyltriisopropyl-silane, cyclohexyltributylsilane, cyclohexyltri-sec-butylsilane, cyclohexyltri-tert-butylsilane, cyclohexyltriisobutylsilane, Phenyltriethoxysilanediol, cyclohexyltriethoxysilanediol, Phenyl-trimethoxysilanediol, cyclohexyltrimethoxysilanediol, phenyltrimethylsilanediol, phenyltriethylsilanediol, phenyltripro-pylsilanediol, phenyltriisopropylsilanediol, phenyltributyl-silanediol, phenyltri-sec-butylsilanediol, phenyltri-tert-butyl-silanediol, phenyltriisobutylsilanediol, cyclohexyltrimethyl-silanediol, cyclohexyltriethylsilanediol, cyclohexyltripropyl-silanediol, cyclohexyltriisopropylsilanediol, cyclohexyltributyl-silanediol, cyclohexyltri-sec-butylsilanediol, cyclohexyltri-tert-butylsilanediol, cyclohexyltriisobutylsilanediol, propyltrimethoxy-silane, tetramethylsilane, 2,4,6,8-tetramethylcyclotetrasilazane, 1,1,3,3-tetramethyldisilazane, 1,1,3,3-tetramethyldisiloxane, tetramethyltetrasilylfulvalene, trimethylethoxysilane, N-(trimethylsilyl)acetamide, trimethylphenoxylsilane, 1-(trimethylsiloxy)cyclopentene, 1-(trimethylsiloxy)cyciohexene, trimethoxylphenylsilane, 1-(trimethoxylsilyl)cyclopentene, 1-(trimethoxylsilyl)cyclohexene, triethoxylphenylsilane, 1-(triethoxylsilyl)cyclopentene, 1-(triethoxylsilyl)cyclohexene; trimethoxylcyclohexylsilane, (trimethoxylsilyl)cyciopentane, (trimethoxylsilyl) cyclohexane, triethoxylcyclohexylsilane, (triethoxylsilyl) cyclopentane, (triethoxylsilyl)cyclohexane, trimethylsilyl azide, triethylsilyl azide, tripropylsilyl azide, triisopropylsilyl azide, tributyl azide, triisobutylazide, tri-tert-butyl azide, tri-sec-butyl azide, triphenyl azide, trimethoxylsilyl azide, triethoxylsilyl azide, tripropoxylsilyl azide, triisopropoxylsilyl azide, tributoxyl azide, triisobutoxyl azide, tri-tert-butoxyl azide, tri-sec-butoxyl azide, (trimethylsilyl)cyclop,entadiene, trimethylsilyl cyanide, (trimethylsilyl)acetontrile, trans-3-(trimethylsilyl)allyl alcohol, 2-(trimethylsilyl)methanol, 2-(triethylsilyl)ethanol, (trimethylsilyl)methanol, (triethylsilyl)ethanol, triisobutylsilane, 2-(trimethylsilyl)methanol, 2-(trimethylsilyl)ethanol, O-(trimethylsilyl)hdroxylamine, 1-(trimethylsilyl)imidazole, trimethylsilylisocyanate, (trimethylsilyl)methyl acetate, trimethylsilyl methacrylate, (trimethylsilyl)methylamine, N-(trimethylsily-lmethyl)urea, 4-(trimethylsilyl)morpholine, 4-(triethoxysilyl)-butyronitrile, 1-(trimethylsilyl)pryrrolide, 1-trirmethylsilyl-1,2,4-triazole, triphenylsilane, triphenylsilandiol, triphenyl-silylamine, tricyclohexylsilylamine, phenyldimethoxysilylamine, methylphenyldimethoxysilane, phenyldiethoxysilylamine, cyclohexyl-dimethoxysilylamine, cyclohexyldiethoxysilylamine, diphenyl-methoxysilylamine, diphenylethoxysilylamine, dicyclohexyl-methoxysilylamine, dicyclohexylethoxysilylamine, cyclohexylsilyltriamine, cyclohexyl(ethyl)silyltriamine, cyclohexyl (methyl)silyltriamine, benzylsilyltriamine, benzyl(methyl) silyltriamine, diphenylsilyldiamine, phenylethoxysilyldiamine, cyclohexylethoxy-silyldiamine, cyclohexyldiethoxysilylamine, cyclohexylmethoxysilyl-diamine, cyclohexyl(ethyl)ethoxysilyldiamine, cyclohexyl(methyl)ethoxysilyldiamine, benzylmethoxysilyldiamine, benzyldimethoxysilylamine, tris(trimethylsilyl)amine, tris (trimethoxylsilyl)amine, tris(triethoxylsilyl)amine, tris (trimethylsilyl)-borate, tris(trimethylsilyl)methane, tris (trimethylsilyl)ethane, tris(trimethylsilyl)phosphate, tris (trimethylsilyl)phosphine, tris(trimethylsilyl)silane, vinyltriethoxysilane, vinyltrichloro-silane, vinyltriisopropylsilane, vinyltrimethylsilane, vinyltri-phenylsilane, vintris(2-buytlidenaminooxy)silane, vinyltris(2-methoxyethoxysilane), vinyltris(trimethylsiloxy)silane, allyldimethylsilane, allyldiethylsilane, diallyldimethylsilane, diallyldiethylsilane, allyoxytrimethylsilane, allyoxytriethyl-silane, allylphenylsilicon, tripropylsilane, tris(trimethylsily4)-silane, pentamethylcyclopentasiloxane, 2,4,6,8,10-pentamethylcyclopentasiloxane, pentamethyldisiloxane, amyltriethoxysilane, vinyltricholorsilane, vinyltriethylsilane, vinyltrimethylsilane, vinyltriphenylsilane, vinyltriethoxysilane, vinyltripropyoxysilane, vinyltrisopropyoxysilane, vinyltrimethoxylsilane, vinyltriphenoxy-silane, vinyltributoxysilane, vinyltriisobutoxysilane, vinyltrisec-butoxysilane, vinyltri-tert-butoxysilane, vinyltris(2-butylidenaminooxy)silane, vinyltris(2-methoxyethoxy)silane, vinyltris(trimethoxysiloxy)silane, N,N-dimethyltrimethylsilyamine, N,N-diethyltrimethylsilyamine, 3,3-dimethyl-1-trimethylsily-1-butyne, 3,3-diethyl-1-trimethylsily-1-butyne, dimethyltrimethylsilylmethylphosphonate, dimethyltrimethylsilylphosphite, dimethyltritylbromosilane, dimethyl-vinylethoxysilane, dimethylvinylchlorosilane, diphenylmethylchlorosilane, diphenylethylchlorosilane, phenyldimethylchlorosilane, phenyldiethylchlorosilane, diphenyldi(M-tolyl)silane, 1,2-dimethylsilane, 1,2-diethylsilane, 2,2,4,4,6,6-hexamethylcyclotrisilazane, N-benzyltrimethylsilylamine, chlorodimethyloctylsilane, trimethyloctylsilane, disiloxane, silicon nitride, disilane, dimethylsilanediol, trichlorocyclopen-tysilane, tris(isopropylthio)silane, chlorotrimethylsilane, chlorodimethylsilane, bis(chloromethyl)dimethylsilane, propyltri-chlorosilane, trimethyl(pentafluorophenyl)silane, trichloro(1H,1H,-2H,2H-perfluorooctyl)silane, silicon tetraboride, silicon hexaboride, trimethyl-2-thienylsilane, (4-bromophenyl) trimethylsilane, 4-(trimethylsilyl)phenol, 5-(trimethylsilyl)-1,3-cyclopentadiene, trimethylsilylmethylmagnesiumchloride, N,N-diisopropyltrimethylsilylamine, dicyclohexyl-methyl-silane, tetracyclohexysilane, 1,1,2,2,3,3,4,4,5,5-decaphenyl-6,6-dimethylcyclohexasilane, trimethylsilylpolyphosphate, trimethylsilylpolyphosphite, including analogues, homologues, isomers and derivatives thereof. Additional examples of acceptable silicon derivatives can be found in Silicon Compounds, Register and Review, Petrarch Systems, Inc. (1984), Frontiers of Organosilicon Chemistry, Bassindale, Gaspar, The Royal Society of Chemistry, (1991), incorporated herein by reference. Corresponding compounds of germanium, tin, titanium, zirconium, selenium, tellurium, are contemplated in the practice of this invention.

Other non-limiting germanium derivative compounds include: decamethylgermaniumocene (bis(pentamethylcyclopentadienyl)germanium), tertbutylgermanium, tetramethylgermanium, tetraethylgermanium, tetrapropylgermanium, tetraisopropylgermanium, tetrabutylgermanium, tetraisobutylgermanium, tetra-tert-butylgermanium, tetra-sec-butylgermanium, tetra-phenylgermanium, phenylgermanium, methylphenylgermanium, methylphenolgermanium, including analogues, homologues, isomers and derivatives thereof.

Other non-limiting derivative tin compounds include: decamethylstannocene (bis(pentamethylcyclopentadienyl) tin), dibutyltin bis(2-ethylhexanoate), dibutyltin diacetate, dibutyloxo-tin (dibutyltin oxide), dimethyltin, diethyltin, dipropyltin, diisopropyltin, dibutyltin, diisobutyltin, di-tert-butyltin, di-sec-butyltin, di-phenyltin, tetramethyltin, tetraethyltin, tetrapropyltin, tetraisopropyltin, tetrabutyltin, tetraisobutyltin, tetra-tert-butyltin, tetra-sec-butyltin, tetraphenyltin, tetrameth-oxytin, tetraethoxytin, tetrapropoxytin, tetraisopropoxytin, tetrabutoxytin, tetraisobutoxytin, tetra-tert-butoxytin, tetra-sec-butoxytin, tetraphenoxytin, trimethoxymethyltin, triethoxymethyl-tin, tripropoxymethyltin, triisopropoxymethyltin, tributoxymethyl-tin, triisobutoxymethyltin, tri-tert-butoxymethyltin, tri-sec-butoxymethyltin, triphenoxymethyltin, dibutyltin dichloride, dibutyltin dilaurate, dibutyltin dimethoxide, dibutyltin dieth-oxide, dibutyltin methoxide, dibutyltin ethoxide, tetrabutyltin, tetramethyltin, tetraethyltin, tetrapropyltin, tetra-tert-butyltin, allyldibutyltin, allyldiphenyltin, allyldiphenylstannane, dichlorodiphenyltin, diphenyltin acetate, tributyltineacetate, tributyltinechloride, tributyltincyanide, tributyltin ethoxide, tributyltin methoxide, tributyltinhydride, tributylvinyltin, triphenyltinchloride, triphenyltinhydroxide, triphenyltinhydride, tributyltin ethoxide, including analogue, homologue, isomer, and derivative thereof. The non-limiting examples of phosphorus derivative compounds of this invention include: tetrabutylphosphonium hydroxide, allyldiphenylphospine, diphenylphosphine, phenylphosphine, diphenyl phosphate, diphenylphosphine, diphenylphosphinic acid, diphenylethoxyphospine, diphenylmethoxyphospine, diphenylpropoxy-phospine, diphenylisopropoxyphospine, diphenylbutoxyphospine, diphenyl-sec-butoxyphospine, diphenyl-tert-butoxyphospine, diphenyl-iso-butoxyphbspine, dicyclohexylethoxyphospine, dicyclohexylmethoxyphospine, dicyclohexylpropoxyphospine, dicyclohexylisopropoxyphospine, dicyclohexylbutoxyphospine, dicyclohexyl-sec-butoxyphospine, dicyclohexyl-tert-butoxyphospine, dicyclohexyl-iso-butoxyphospine, dicyclopentylethoxyphospine, dicyclopentylmethoxyphospine, dicyclopentylpropoxyphospine, dicyclopentylisopropoxyphospine, dicyclopentylbutoxyphospine, dicyclopentyl-sec-butoxyphospine, dicyclopentyl-tert-butoxyphospine, dicyclopentyl-iso-butoxyphospine, dicyclohexyl(ethyl)ethoxy-phospine, dicyclohexyl(ethyl) methoxyphospine, dicyclohexyl(ethyl)propoxyphospine, dicyclohexyl(ethyl)isopropoxyphospine, dicyclohexyl (ethyl)butoxyphospine, dicyclohexyl(ethyl)-sec-butoxyphospine, dicyclohexyl(ethyl)-tert-butoxyphospine, dicyclohexyl(ethyl)-iso-butoxyphospine, phenyldiethoxyphospine (diethylphenylphosphonite), phenyldimethoxyphospine, phenyldipropoxyphospine, phenyldiisopropoxyphospine, phenyldibutoxyphospine, phenyldi-sec-butoxyphospine, phenyldi-tert-butoxyphospine, phenyldiisobutoxyphospine, cyclohexyldiethoxyphospine, cyclohexyldimethoxyphospine, cyclohexyldipropoxyphospine, cyclohexyldiisopropoxyphospine, cyclohexyldibutoxyphospine, cyclohexyldi-sec-butoxyphospine, cyclohexyldi-tert-butoxyphospine, cyclohexyldi-iso-butoxyphospine, cyclopentyldiethoxyphospine, cyclopentyldimethoxyphospine, cyclopentyldipropoxyphospine, cyclopentyldiisopropoxyphospine, cyclopentyldibutoxyphospine, cyclopentyldi-sec-butoxyphospine, cyclopentyldi-tert-butoxyphospine, cyclopentyldi-isobutoxyphospine, cyclohexyl(ethyl)diethoxyphospine, cyclohexyl(ethyl)dimethoxyphospine, cyclohexyl(ethyl) dipropoxyphospine, cyclohexyl(ethyl)diisopropoxyphospine, cyclohexyl(ethyl)dibutoxyphospine, cyclohexyl(ethyl) di-sec-butoxyphospine, cyclohexyl(ethyl)ditert-butoxyphospine, cyclohexyl(ethyl)diiso-butoxyphos-pine, dimethylmethylphosphate, diethylmethylphosphate, diethylethylphosphate, dimethylethylphosphate, ethylenebis(diphenylphosphine), methyldichlorophosphite, methyldichlorophosphate, methyldichlorophosphine, methyldiphenylphosphine, propylphosphonic anhydride, dimethylphosphine, diethylphosphine, dimethylphosphine, dipropylphosphine, diisopropylphosphine, dibutylphosphine, diisobutylphosphine, disecbutylphosphine, di-t-butylphosphine, diphenylphosphine, diphenylphosphate, diphenylphosphineoxide, diphenylphosphine oxide, diphenylphosphineselenide, dis(diethylamino)phosphine, dis (dimethylamino)phospine, dis(2-ethylhexyl)phosphate, dis (dimethylsilyl)phosphate, dis(dimethylsilyl)phosphite, di(toly)phosphine, di(o-toly)phosphine, di(m-toly)phosphine, di(p-toly)phosphine, di(toly)phosphite, di(o-toly) phosphite, di(m-toly)phosphite, di(p-toly)phosphite, di(toly)-phosphate, di(toly)hydrophosphate, di(toly)phosphonic acid [(CH3C6H4)2P(OH)], mono(toly)phosphonic acid [(CH3C6H4)P(OH)2], diethylphenylphosphine, diethylphenylphosphite, dipropylphosphite, diisopropylphosphite, dibutylphosophite, diisobutylphosophite, di-sec-butylphosophite, di-tert-butylphosophite, diphenylphosphite, allydiphenylphosphonium, allydiphenylphosphonium hydride, allydiphenylphosphonium hydroxide, allydiphenylphosphonium chloride, dimethylphosphoramidous dichloride, hexamethylphosphoramide, hexamethylphosphorus diamide, hexamethylphosphorus triamide, hexamethylphospophorimidic triamide, trimethylphosphine, trimethylphospate, trimethylphosphite, triethylylphosphite, tripropyl-phosphite, triisopropylphosphite, tri-butyl-phosphite, tri-iso-butylphosphite, tri-sec-butylphosphite, tri-tert-butylphosphite, triphenylphosphite, dimethylphosphite, diethylphosphite, dipropyl-phosphite, diisopropylphosphite, dibutylphosphite, diisobutyl-phosphite, di-sec-butylphosphite, di-tert-butylphosphite, diphenyl-phosphite, dimethylethylphosphine, dimethylethylphosphate, dimethylethylphosphite, diethylmethylphosphite, dipropylmethylphosphite, diisopropylmethyl phosphite, di-butylmethylphosphite, di-iso-butylmethylphosphite, di-sec-butylme thylphosphite, di-tert-butylmethylphosphite, diphenylmethyl phosphite, dimethylphosphonate, diethylphosphonate, dipropylphosphonate, diisopropylphosphonate, di-butyl-phosphonate, di-iso-butylphosphonate, di-sec-butylphosphonate, di-tert-butylphosphonate, diphenylphosphonate, dimethylmethylphosphonate, dimethylethylphosphonate, diethylmethyl-phosphonate, dipropylmethylphosphonate, diisopropylmethylphosphonate, di-butyl-methylphosphonate, di-iso-butylmethylphosphonate, di-sec-butylmethylphosphonate, di-tert-butylmethylphosphonate, diphenylmethyl phosphonate, diethylethylphosphonate, dipropylethylphosphonate, diisopropylethylphosphonate, di-butyl-ethylphosphonate, di-iso-butylethylphosphonate, di-sec-butylethylphosphonate, di-tert-butylethylphosphonate, diphenylethyl phosphonate, dimethylcarbophosphonate, diethylcarbophosphonate, dipropylcarbophosphonate, diisopropylcarbophosphonate, di-butyl-phosphonate, diiso-butylcarbophosphonate, di-sec-butylcarbophosphonate, di-tert-butylcarbophosphonate, diphenylcarbophosphonate, dimethylmethylcarbophosphonate, dimethylethylcarbophosphonate, diethylmethylcarbophosphonate, dipropylmethylcarbophosphonate, diisopropylmethylcarbophosphonate, di-butyl-methylcarbophosphonate, di-iso-butylmethylcarbophosphonate, di-sec-butylmethylcarbophosphonate, di-tert-butylmethylcarbophosphonate, diphenylmethyl phosphonate, diethylethylcarbophosphonate, dipropylethylcarbophosphonate, diisopropylethylcarbophosphonate, di-butyl-ethylcarbophosphonate, di-iso-butylethylcarbophosphonate, di-sec-butylethylcarbophosphonate, di-tert-butylethylcarbophosphonate, diphenylethyl phosphonate, dimethylphospite, dimethylphosphite, trimethyl phosphonoacetate, trimethyl 2-phosphonoacrylate, trimethyl phbsphonoformate, trioctylphosphine oxide, triphenyl phospate, triphenylphosphine, triphenylphosphine oxide, triphenyl-phosphine-copper hydride, triphenylphosphine hydrobromide, triphenylphosphine dibromide, triphenylphosphine oxide, triphenyl-phosphine selenide, triphenylphosphine sulfide, tripiperidinophosphine oxide, tris(2-ethylhexyl)phosphate, tris(dimethylamino)phosphine, tris (hydroxymethyl)aminomethane phosphate, tris (trimethylsilyl)phosphate, tris(trimethylsilyl)phos-phite, tri (toly)phosphines (e.g. tri(o-toly)phosphine, tri(m-toly) phosphine, tri(p-toly)phosphine), tri(toly)phosphite (e.g. tri (o-toly)phosphite, tri(m-toly)phosphite, tri(p-toly) phosphite), tri(toly)phosphate, tri(toly)hydrophosphate, tri (toly)phosphonic acid [(CH3C6H4)3P(OH)2], bis(2-ethylhexel)phosphite, diallyphenyl-phosphine, dibenzylphosphite, dibenzylphosphate, dibutyl phosphite, dimethyl methylphosphonate, dimethyl methylphosphine, dimethyl methylphosphonite, dimethylphenylphosphine, dimethylphenylphosphonite, dimethylphenylphosphite, dimethylphosphinic acid, dimethyl(trimethylsilylmethyl)phosphonate, dimethyl trimethylsilyl phosphite, dimethyl trimethylsilyl phosphonate, ethyldiphenylphosphonite, diphenyl (2-methoxyphenyl)phosphine, manganese(II) hydrogen phosphite, disodium fluorophosphate, disodium fluorophosphite, disodiumhydrogenphosphite, trisodium phosphate, trisodium phosphite, dipotassiium fluorophosphate, dipotassium fluorophosphite, tripotassium phosphate, tripotassium phosphite, ethyldiphenylphosphine, ethyldiphenylphosphinite, ethyldiphenylphosphonate, methyldiphenylphosphine, methyldiphenylphosphinite, methydiphenylphosphonate, phenylphosphine, phenylphosphonic acid, phenylphospate phosphorus acid, phosphoric acid, phosphorus trichloride, phosurea, phosphorus trisulfide, tributyl phosphate, tributylphosphine, tri-tert-butylphosphine, tributylphosphine oxide, tributylphosphite, tris(2,4-di-tert-butylphenyl)phosphite, tris(noniphenyl)phosphite, phosphorous acid triphenylester with propane 1,3-diol, tris(2,2,2-tri-fluoroethyl)phosphite, tris(2-chloroethyl)phosphite, tris(1-chloroethyl) phosphite, trichlorophosphite, tris(tridecyl)phosphite, isooctyldiphenylphosphite, diisodecylphenylphosphite, triethyl 4-phosphonocrotonate, trimethyl 4-phosphonocrotonate, triethyl-phosphonoacetate, trimethylphosphonoacetate, trimethyl 2-phosphono-butyrate, triethyl 2-phosphonobutyrate, trimethylphosphonoformate, triethylphosphonoformate, trimethylphosponopropionate, trimethylphosponopropionate, tricyclohexylphosphite, tricyclohexylphophine, triethylphosphine, triethylphosphite, trimethylphosphine, triethylphosphate, trimethylphosphate, tripropylphosphate, triisopropylphosphate, tributylphosphate, triisobutylphosphate, tri-sec-butylphosphate, tri-tert-butylphosphate, triphenylphosphate, dimethylphosphate, diethylphosphate, dipropylphosphate, diisopropylphosphate, dibutylphosphate, diisobutylphosphate, di-sec-butylphosphate, di-tert-butylphosphate, diphenylmethylphosphate, diphenylethylphosphate, diphenylpropylphosphate, diphenylisopropylphosphate, dimethylethylphosphate, diethylmethylphosphate, dipropylmethylphosphate, diisopropylmethylphosphate, dibutylmethylphosphate, di-iso-butylmethylphosphate, di-sec-butylmethylphosphate, di-tert-butylmethylphosphate, diphenylmethyl phosphate, triethylphosphoramide, trimethylphosphoramide, tripropylphosphoramide, triisopropylphosphoramide, tributylphosphoramide, triisobutylphosphoramide, tri-sec-butylphosphoramide, tri-tert-butylphosphoramide, triphenylphosphoramide, dimethoxyphosphorusamide (CH3O)2PNH2), diethoxyphosphorusamide, dipropoxyphosphorus-amide, diisopropoxyphosphorusamide, dibutoxyphosphorusamide, diisobutoxyphosphorusamide, di-sec-butoxyphosphorusamide, di-tert-butoxyphosphorusamide, diphenoxyphosphorusamide, dimethylphosphor-amide (CH30)2PONH2), diethylphosphoramide, dipropylphosphoramide, diisopropylphosphoramide, dibutylphosphoramide, diisobutylphosphoramide, di-sec-butylphosphoramide, di-tert-butylphosphoramide, diphenylphosphoramide, dimethylethylphosphoramide, diethylmethylphosphoramide, dipropylmethylphosphoramide, diisopropylmethylphosphoramide, di-butyl-methylphosphoramide, di-iso-butylmethylphosphoramide, di-sec-butylmethylphosphoramide, di-tert-butylmethylphosphoramide, diphenylmethyl phosphoramide, triethylcarbophosphate, trimethylcarbophosphate, tripropylcarbophosphate, triisopropylcarbophosphate, tri-butyl-phosphate, tri-iso-butylcarbophosphate, tri-sec-butylcarbophosphate, tri-tert-butylcarbophosphate, triphenylcarbophosphate, dimethylcarbophosphate, diethylcarbophosphate, dipropylcarbophosphate, diisopropylcarbophosphate, dibutylcarbophosphate, diisobutylcarbophosphate, di-sec-butylcarbophosphate, di-tert-butylcarbophosphate, diphenylcarbophosphate, dimethylethylcarbophosphate, diethylmethylcarbophosphate, dipropylmethylcarbophosphate, diisopropylmethylcarbophosphate, di-butyl-methylcarbophosphate, di-iso-butylmethylcarbophosphate, di-sec-butylmethylcarbophosphate, di-tert-butylmethylcarbophosphate, diphenylmethyl phosphate, dimethylvinylphosphate, diethylvinylphosphate, dipropylvinylphosphate, diisopropylvinylphosphate, dibutylvinylphosphate, diisobutylvinylphosphate, di-sec-butylvinylphosphate, di-tert-butylvinylphosphate, diphenylvinylphosphate, triisobutylphosphine, triisodecylphosphite, triisopropylphosphite, dibenzyldiethylphosphoramidite, dibenzyldiisopropylphosphoramidite, dibenzylphosphite, dibenzylphosphate, tris(tridecyl)phosphite, tritolylphosphate, tritolyphophine, tritolyphos-phite, tricyclohexylphosphine, aliminum phosphate, 1,2-bis(diphenylphosphino)propane, trioctylphosphine oxide, trioctyl-phosphine, dichloromethylphosphine, dichlorophosphineoxide (Cl2PO), ethyldichlorophosphite, tetraethylpyrophosphite, benzyldiethylphosphite, benzyldiethoxyphosphorus, cyclohexyldiethoxyphosphorus, dibenzyldiisopropylphosphoramite (dissopropyl-phosphoraramidous acid dibenyl ester), di-tert-butyl diisopropylphosphoramidite, tert-butyl tetraisopropylphosphorodiamidite, (+/−)-1-amino-cis-3-phosphonocyclopentanecarboxlic acid, diallyl diisopropylphosphoramide, tert-butyl tetraisopropylphosphorodiamite, (1-aminobutyl)-phosponic acid, 6-amino-1-hexyl phosphate, 1-aminoethyl-phosponic acid, 2-aminoethyl dihydrogenphosphate, 2-aminoethyl-phosponic acid, methyl, N,N,N'-tetraisopropylphosphordiamidite, hexamethylphos,phoramide [(CH3)2N]3PO, hexamethylphosphortriamidite [(CH3)2N]3P, diethyl 4-aminobenzylphosphonate, diethyl 4-aminoben-zylphosphite, diethylbenzylphosphonate, diethylbenzylphosphite, tetraethylbenzylphosphonate, diethyl(pyrrolidinomethyl) phos-phonate, diethyloxyphosphinyl isocyanate, 6-amino-1-hexylphosphate, diethyloxyphinyl isocyanate, diethylcyanomethylphosphonate, diethylveinylphosphonate, dioctylphenylphosphonate, ethylphenylphosphinate, ethylphenylphosphonic acid, methylphosphonic acid, ethylphosphonic acid, propylphosphonic acid, isopropylphosphonic acid, butylphosphonic acid, sec-butylphosphonic acid, tert-butylphosphonic acid, isobutylphosphonic acid, phenylphosphonic acid, phenylphosphoric acid, phenylphosphinic acid, methylphenylphosphinate, methylphenylphosphine, aminomethylphosphonic acid, vinylphosphonic acid, hypophosphorus acid, sodium hypophosphate, sodium dihydrogenphosphate, fluorophosphoric acid, ammonium, hydrogenphosphate, ammonium hydrogenphosphite, ammonium hydrogen-phosphine, lithiumdihydrogenphosphate, triphenylphosphineselenide, phosphoric acid, phosphorus oxychloride, phosphorus pentasulfide, metaphosphoric acid, phenylphosphate disodium salt, nitrilotris(methylene)triphosphonic acid, ethylenephosphite, ammonium salt benzylphosphite, potassiumhexafluorophosphate, diethyltrimethylsilylphosphite, diethyl(trichloroethyl)phosponate, dimethyl(trimethylsilyl)phosphite, tris(trimethylsilyl)phosppnate, 2-chloro-1,3,2-dioxaphospolan e, 2-chloro-1,3,2-dioxaphospholane-2-oxide, dimethylmethylphosphonate, diethylmethylphosphonate, dimethylethylphosphonate, diethylethylphosphonate, ethylmethyl-phosphonate, 2-carboxyehtylphosphonic acid, 2,2,2-trichloro-1,1-dimethylethyldichlorophosphite, bis(2-chloroethyl)phosphoramidic dichloride, butyldichlorophosphite, butylphosphonic dichloride, tert-butylphosphonic dichloride, tert-butyldichlorophosphine, trimethylphosphonoformate, trimethylpropionamide, trimethylpropionanilide, diethylchlorophosphate, diethylchlorophosphite, chlorodiethylphosphine, diethylphosphoramidous dichloride, diethylthiophosphate, sodium salt diethylthiophosphate, diethylphosphoramidate, dimethylphosphoramidate, tetramethylphosophorodiamidic chloride, tetramethylphosphonium chloride, diethylcyanophosphate, diethylcyanophosphonate, diethylcyanomethylphosphonate, diethoxyphosphinyl isocyanate, O,O'-diethylmethylphosphonothioate, diethylmethylphosphonate, diethyl(hydroxymethyl)phosphonate, dimethyltrimethylsilylphosphite, 1-ethyl-3-methyl-1H-imidzolium hexafluorophosphite, diethylcyanmethylphosphonate, phosphorus napthenate, methylphenylphospholene, methylphenylphosolenedichloride, (aminobenzyl)phosphonic acid (e.g. (4-aminobenzyl)phosphonic acid), cyclophosphamide, pinacolylmethylphosphonate, diethyl(ethylthiomethyl)phosphonate, 2-furyl tetra-methylphosphorodiamidite, diisopropylcyanomethylphosphate, 1,3,5-tris(2-hydroxyethyl)cyanuric acid, tris(2,4,-di-tert-butylphenyl)phosphite, tris(tridecyl) phosphite, tris(nonylphenyl)phos-phite, phosphorus anyhydride, phospham, phosphonium chloride, phosphoniumsulfide, phosphoniumsulfate, phosphoramide, phorphoramidite, metaphosphoramide, phosphorus chloride(di)nitride, phosphorus cyanide, phosphorus trifluoride, phosphorus pentafluoride, phosphorus oxybromide, phosphorus pentaselenide, phosphorus trioxide, phosphorus sesquioxide, phosphorus tri(tetra)selenide, phosphorus thiochloride, phosphorus thiocyanate, hypophosphorus acid, metaphosphorus acid, orthophosphorus acid, pyrophosphorus acid, phosphine, phosphorus nitride, phosphorus sesquisulfide, including analogues, homologues, isomers and derivatives thereof. The corresponding compounds of arsenic, antimony and bismuth are contemplated.

Other non-limiting antimony derivative compounds include: alkyl antimony compounds, trialkyl compounds, cyclomatic/ring system compounds, including, trimethylantimony, triethylantimony, tripropylantimony, triisopropylantimony, tributylantimony, triisobutylantimony, tri-tert-butylantimony, tri-sec-butylantimony, triphenylantimony, phenylantimony, tri(methylphenyl)antimony, triphenylantimony oxide, tri(methylphenol)antimony, antimony ethoxide, pentamethylantimony, phenyldimethylantimony, phenyl-stibinic acid, tetramethyldistibyl, tributylstibene, triethylan-timony, triethylantimony chloride, trimethylantimony, triphenylan-timony, triphenylantimony dichloride, triphenylantimony sulfide, including analogue, homologue, isomers and derivative thereof.

Non-limiting arsenic derivative compounds include: alkyl arsenic compounds, dialkyl compounds, cyclomatic/ring system compounds including, trimethylarsine, triethylarsine, tripropylar-sine, triisopropylarsine, tributylarsine, triisobutylarsine, tri-tert-butylarsine, tri-sec-butylarsine, tri-phenylarsine, phenylar-sine, tri(methylphenyl)arsine, triphenylarsine oxide, tri(methyl-phenol)arsine, phenylarsenic acid, phenylcyclotetramethylenearsine; arsenobenzene, cacodyl oxide, cacodyl amide, dimethylarsine, dimethylchlorarsine, dimethylcyanoarsine, diphenylarsinic acid, diphenylchloroarsine, ethylarsonic acid, methylarsine, methyl-dichloroarsine, phenylarsine, phenyldimethylarsine, tetraethyldiar-sine, tetramethylbiarsine, tribenzylarsine, trimethylarsine, triethylarsine, tributyl arsine, tri-isobutyl arsine, triphenyl arsine, including analogue, homologue, isomers and derivative thereof. See Organo Arsenial Compounds, Raiziss, Gavron, American Chemical Society (1923) and related/subsequent editions, volumes or supplements, incorporated by reference. Corresponding compounds of phosporus, antimony, bismuth are also contemplated herein and incorporated by reference.

Non-limiting bismuth derivative compounds include: alkyl bismuth compounds, dialkyl compounds, cyclomatic/ring system compounds including, triphenylbismuth, triphenylbismuth carbonate, diphenylbismuthine, methylbismuthine, triethylbismthine, trimethylbismthine, triphenylbismuthine, tri-n-propylbismuth, including analogue, homologue, isomers and derivative thereof.

Non-limiting potassium derivative compounds of this invention include: potassium bis(dimethylsilyl)amide, potassium acetamide, potassium bis(trimethylsilyl)amide, oxamic acid, P-aminosalicylic acid potassium salt, potassium salt 5-nitroorotic acid, potassium D-gluconate, potassium hexacyanoferrate(III) (K3Fe(CN)6), potassium diphenylphosphide, potassiumetherate, potassium acetate, potassium acetate acid, potassium salt acetic acid, potassiumbenzamide, potassium azide, potassium antimonide, potassium orthoarsenate, potassium orthoarsenite, potassium meta-arsenite, potassium diborane, potassium pentaborate, potassium dihydroxy diborane, potassium borohydride, potassium anilide, potassium cadium iodide, potassium chloride, potassium calcium chloride, potassium carbide, potassium carbonate, potassium hydrogen carbonate, potassium carbonate, potassium carbonyl, potassium cobalt(II) cyanide, potassium cobalt(III) cyanide, potassium cobaltinitrite, potassium cynomanganate(II), potassium cynomanganate(III), potassium citrate, potassium ferricyanide, potassium ferrocyanide, potassium hydride, potassium hydroxide, potassium manganate, potassium permanganate, potassium methionate, potassium napthenate, potassium nitride, potassium nitrate, potassium nitrite, potassium nitrophenoxide, potassium nitrobenzene (e.g. potassium-p-nitrobenzene)potassium oleate, potassium oxalate, potassium oxalatoferrate(II), potassium oxalatoferrate(III), potassium monoxide, potassium oxide, potassium peroxide, potassium mono-orthophosphate, potassium hypophosphite, potassium orthophosphite, potassium hydroxoplumbate, potassium rhodium cyanide, potassium selenide, potassium selenite, potassium selenocynate, potassium selenocyanoplatinate, potassium disilicate, potassium metasilicate, potassium sodium carbonate, potassium sodium ferricyanide, potassium hydroxostannate, potassium disufide, potassium hydrosulfide, potassium pentasulfide, potassium tetrasulfide, potassium trisulfide, potassium telluride, potassium thioarsenate, potassium thioarsenite, potassium trithiocarbonate, potassium thiocyanate, potassium amide, potassium salt (E,E)-2,4-hexadienoic acid, dipotassium fluorophosphate, dipotassium fluorophosphite, tripotassium phosphate, tripotassium phosphite, potassium perchlorate, propanoic acid potassium salt, potassium formate, potassium cyanate, potassium hexacyanocobaltate(III), potassium hypophosphite, potassium hexaflurorsilicate, potassium nitroprusside, potassium phenoxide, potassium phosphate (dibasic, monobasic, tribasic), potassium salicylate, potassium selenide, potassium tetracyanonickelate(II), potassium tetrafluoroborate, potassium xanthogenate, potassium-p-aminobenzoate, potassium copper ferrocynanide, potassium cupric ferrocyanide, potassium hexafluorophosphate, potassium hexanitricobaltate III, potassium naphthenate, potassium-B-naphthoxide, potassium polysulfide, potassium sodium phosphate, potassium stearate, potassium sulfide, potassium sulfite, potassium sulfate, potassium thiocyanate, potassium xanthate, potassium fluorosilicate, N-potassiumethylene-diamine, oxalic acid dipotassium salt, potassium beta-hydropyruvic acid, potassium 1,1-dimethylurea, potassium 1,1-diethylurea, potassium 1,1-diepropylurea, potassium xanthate, potassium ethylxanthate, potassium methylxanthate, potassium salt thiophenol, potassiumaluminum-tri-tert-butoxide, potassium ferrosilicon, triphenylmethylpotassium, methylpotassium, ethylpotassium, potassiumethynyl(acetylide), propylpotassium, isopropylpotassium, butylpotassium, isobutylpotassium, secbutylpotassium, tertbutylpotassium, pentapotassium, hexylpotassium, heptapotassium, amylpotassium, isoamylpotassium, benzylpotassium, dimethylbenzylpotassium, tolylpotassium, dodecylpotassium, cyclopentadienylpotassium, methylcyclopentadienylpotassium, cyclohexylpotassium, potassiumheptyl, potassiumdodecyl, potassium tetradecyl, potassium hexadecyl, potassium octadecyl, phenylpotassium, potassium o-tolyl, potassium m-tolyl, potassium p-tolyl, potassium-p-chlorophenyl, potassium p-bromophenyl, potassium potassium o-anisyl, potassium m-anisyl, potassium p-anisyl, potassium diethoxyphenyl, potassium dimethoxyphenol, potassium m-cumyl, potassium p-ethoxyphenyl, potassium m-dimethylaminophenyl, potassium 9-flourene, potassium a-napthyl, potassium b-napthyl, potassium p-phenylphenyl, potassium 9-phenylanthryl, potassium 9-anthryl, potassium 9-methylphenanthryl, potassium pyridyl, potassium 2-pyridyl, potassium 3-pyridyl, potassium 6-bromo-2-pyridyl, potassium 5-bromo-2-pyridyl, potassium dibenzofuryl, potassium 3-quinoyl, potassium 2-lepidyl, potassium triphenylmethyl, potassium 2,4,6-trimethylphenyl, potassium 2,4,6-triisopropylphenyl, potassium 2,3,5,6-tetraiso-propylphenyl, potassium tetrabutylphenyl, thiophenedipotassium, toluenedipotassium, diphenylethylenedipotassium, potassiumamylethynyl, potassiumphenylethynyl, potassiummethoxybromophenyl, potassium phenylisopropyl, potassium tetraphenylboron, potassium tetramethylboron, potassium a-thienyl, potassium m-trifluoromethylphenyl, phenylethynylpotassium, 3-furylpotassium, phenylisopropylpotassium, dibenzofuranylpotassium, potassium dimethylbenzyl, potassium selenocyanate, potassium trimethylsilanolate, diphenylphosphide, potassium benzoate, potassium tert-butyl carbonate, potassium azide, di-potassiumcyanamide, potassium cyanide, potassium dicyanamide, cyclohexanebutyric acid potassium salt, cyclohexane acid potassium salt, cyclopentadientylpotassium, potassium tri-tert-butoxyaluminum hydride, potassium triethylborohydride, potassium trimethylborohydride, potassium tripropylborohydride, potassium triisopropylborohydride, potassium tributylborohydride, potassium triisobutylborohydride, potassium tri-sec-butylborohydride, potassium tri-tert-butylborohydride, potassium trisiamylborohydride, potassium chlorate, potassium tert-butoxide, potassium sec-butoxide, iso-butoxide, potassium antimonate, potassium diphenylphosphide, potassium bis(trismethylsilyl)amide, tripotassium phosphite, potassium selenocyanate, potassium tri-sec-butylborohydride, potassium triethylsilanolate, potassium thiocyanate, potassium acetylide, potassium chlorate, potassium salicylate, potassium di-potassium tetracarbonylferrate, potassium tetraphenylborate, potassium triethylborohydride, potassium triacetoxyborohydride, potassium triphenylborane, potassium hydroxide, potassium diphenylphosphide, potassium methoxide, potassium ethoxide, potassium tri-sec-butylborohydride, tri-tert-butylborohydride, potassium triethylborohydride, potassium triphenylborohydride, potassium trisiamylborohydride, potassium metavanadate, potassium cyclohexanebutyrate, potassium hexachloroplatinate, potassium thiocyanate, potassium selenocyanate, potassium cyanate, potassium floride, potassium hexafluoroantimonate, potassium hexafluoroaluminate, potassium hexafluoroar-senate, potassium hexafluorosilicate, potassium hexacyano-cobalt(II)ferrate(II), dipotassiumhexacyanocobalt(II)ferrate(II), potassium hexafluorotitanate, potassium hexafluorozirconate, potassium hexahydroxyantimonate, potassium hexachlororuthenate, potassium hexachloropalladate, potassium formate, potassium tetracyanonickelate, potassium tetrafluoroaluminate, potassium tetrafluoroborate, potassium thioacetate, L-glutamic acid mono-potassium salt, fumaric acid potassium salt, oxamic acid potassium salt, potassium salt diphenyl-phospane, P-aminobenzoic potassium salt, aminobenzole acid potassium salt, alpha-napthaleneacetic acid potassium salt, dipotassium salt 2,6-naphthalenedicarboxlic acid, potassium cycicohexanetherate, potassium phthalimide, P-aminosalicylic acid potassium salt, potassium salt 3,5-dimethylcyclo-hexyl sulfate, indolebutyric acid potassium salt, indole-3-butyric acid potassium salt, potassium diphenylphosphide, potassium dimethylsilanolate, potassium triethylborohydride, potassium propoxide, potassium isoprbpoxide, potassium butoxide, potassium sec-butoxide, potassium pentoxide, potassium tert-pentoxide, potassium hydrogenphthalate, potassium oxalate, potassium hydrogensulfate, monopotassium acetylenedicarboxylic acid, potassium pyrophosphate, potassium dihydrogenphosphate, potassium hexoate (potassium salt hexoic acid), potassium diphenylphosphide, potassium trimethylsilonaliate, potassium phthalic acid, P-aminoben-zoic acid potassium salt, monopotassium L-aspartic acid, tetra-phenyldipotassium (C6H5)2CK2C(C6H5)2, potassiumethylphenyl (KCH2C6H5), potassium bromate, potassium chromate, potassium hydrogenphospate, monpotassium salt D-shaccharic acid, DI-asparatic potassium salt, (R)-alpha-hyroxyrmethylaspartic acid potassium salt, potassium fluoride, potassium iodate, potassium salt ethyl malonate, potassium thioacetate, potassium phenol, potassium salt aminobenzoic acid, potassium aminophenol salt, potassium cyclo-hexenol, potassium methylcyclohexenol, potassium cyclopropanol, potassium methylcyclopropanol, potassium cyclobutanol, potassium methylcyclobutanol, potassium methylcyclopentanol, potassium cyclopentanol, potassium cyclohexenol, potassium methylcyclohexenol, potassium dimethylcyclohexenols (e.g. potassium 3,5-dimethylcyclohexanol, potassium 2,3-dimethylcyclohexanol, potassium 2,6-dimethylcyclohexanol, potassium 2,5-dimethylcyclohexanol, 3,5-dimethylcyclohexanol), potassium o-ethylxanthic acid, monopotassium salt 2-ketoglutaric acid, dipotassium salt, ketomalonic acid, potassium salt lactic acid, dipotassium thiosulfate, potassium antimony tartrate, potassium dichloroacetate, potassium dimethyl-acetate, potassium diethylacetate, potassium dipropylacetate, potassium metaborate, potassium tetraborate, potassium tetrachloro-cuprate, potassium acetoacetate, potassium diisopropylamide, potassium diethylamide, potassium dimethylamide, potassium bis(dimethylsilyl)amide, dipotassium phthalocyanine, dipotassium-tetrabromocuprate, dipotassium tetrabromonickelate, dipotassium-tetrachloromanganate, dipotassiumbutadiyne, potassium cyclopen-tadienide, potassium dicyclohexylamide, potassium diethylamide, potassium dimethylamide, potassium dipropylamide, potassium diisopropylamide, potassium thexylborohydride, potassium tri-tert-butoxyaluminohydride, potassium trimethylsilyl)acetylide, potassium triethylsilyl)acetylide, potassium tris[(3-ethyl-3-pentyl) oxy]-aluminohydride, (phenylethynyl)potassium, 2-thienylpotassium, potassium diethyldihydroaluminate, potassium dimethyldihydroalumin-ate, potassium aluminum hydride, potassium bifluoride, potassium biphenyl, potassium biselenite, potassium bis(2-methoxyethoxy)-aluminum hydride, potassium bismuthate, potassium borate, potassium chlorite, potassium cobaltnitrite, potassium cyanoborohydride, potassium cyclopentadienide, potassium dicyanamide, potassium hexametaphosphate, potassium hexanitrocolbaltate, potassium hydrogenphosphite, potassium hydrogenselenite, potassium hydrogen-sulfite, potassium hydrosulfite, potassium hypochloride, potassium metaarsenite, potassium metabisulfide, potassium metaperiodate, potassium methacrylate, potassium nitroferricyanide, oxybate, potassium pentamethylcyclopentadienide, potassium phenolate, polyphosphate, potassium polyphosphite, potassium propionate, potassium pyrophosphate, potassium selenate, potassium selenite, potassium tetrachloroaluminate, potassium thiomethoxide, potassium thiosulfate, potassium thiosulfide, potassium thiosulfite, potassium triactoxyborohydride, potassium trimethylsilonate, potassium triethylsilonate, potassium tris(1-pyrazoly)borohydride, including analogues, homologues, isomers and derivatives thereof. Corresponding compounds of rubidium, caesium (cesium), francium are contemplated in the practice of this invention.

Non-limiting derivative magnesium compounds contemplated by this invention include: alkyl manganese compounds, dialkyl magnesium compounds, magnesium ethylate (ethoxide), magnesium methoxide, dimethylmagnesium, diethylmagnesium, dipropylmagnesium, diisopropylmagnesium, dibutylmagnesium, ditertbutylmagnesium, di-iso-butylmagnesium, di-sec-butylmagnesium, diphenylmagnesium, methylmagnesium chloride, methylmagnesium iodide, magnesium methylcarbonate, magnesium hydroxide, magnesium anthracene dianion, bromomagnesium isopropylcyclohexylamide, methylmagnesium bromide, methylmagnesium chloride, ethylmagnesium chloride, magnesium floride, magnesium chloride, butylmagnesium chloride, isopropylmag-nesium chloride, cyclopentylmagnesiumhydride, cyclopentylmagnesium-hydroxide, cyclopentylmagnesiumchloride, cyclopentylmagnesium-methyl, cyclopentylmagnesiumethyl, cyclopentylmagnesiummethylol, cyclopentylmagnesiumethylol, cyclopentylmagnesiummethoxy, cyclopen-tylmagnesiumethoxy,cyclohexylmagnesiumhydride, cyclohexylmagnesiumhydroxide, cyclohexylmagnesiumchloride, cyclohexylmagnesiummethyl, cyclohexylmagnesiumethyl, cyclohexylmagnesiummethylol, cyclohexylmagnesiumethylol, cyclohexylmagnesiummethoxy, cyclohexylmagnesiumethoxy, tert-butylmagnesium chloride, isobutylmagnesium chloride, allymag-nesium chloride, benzylmagnesium chloride, benzylmagnesium hydride, benzylmagnesium ethylate, benzylmagnesium methylate, benzylmagnesium ethoxy, benzylmaghesium methoxy, magnesium acetate, magnesium methyl carbonate, trimethylsilylmethyl magnesium chloride, magnesium acetate tetrahydrate, methylmagnesium isopropylcyclohexylamide, magnesium pyrophosphate, phenylethynylmagnesium bromide, methylphenylmagnesiumchloride, methylmagnesium, ethylmagnesium, propylmagnesium, isopropylmagnesium, butylmagnesium, isobutylmagnesium, tert-butylmagnesium, sec-butylrmagnesium, phenylmagnesium, magnesium acetate, magnesium hydrogenphosphate, cyclopentylmagnesium, cyclopentylmagnesium-hydroxide, cyclopentylmethylmagnesium, methylcyclopentylmethylmag-nesium, allylmagnesium, benzylmagnesium, pentylmagnesium, 1,1-dimethylpropylmagnesiumhydroxide, 1,1-dimethylpropylmethylmagnesium, phenylmagnesium, phenolmagnesium, magnesium hydroxide, magnesiumcarbonate, magnesiumsilicide, magnesium phosphate, magnesium phosphite, magnesium bisulfite, L-aspartic acid magnesium, DL-aspartic acid-magnesium, including analogue, homologue, isomer, and derivative thereof. Corresponding beryllium, calcium, strontium, barium, radium and zinc compounds are contemplated in the practice of this invention. See The Organic Compounds of Magnesium, Beryllium, Calcium, Strontium, and Barium, Ioffe, Nesmeyanov, Amsterdam (1967), Organomagnesium Methods in Organic Synthesis, Wakefield, Academic Press, Florida (1995), incorporated by reference. The mixture of dialkyl magnesium compounds with pyrophoric metallics is specifically contemplated.

Non-limiting selenium derivative compounds include: alkyl and dialkyl selenium compounds, dimethylselenium, dimethyl selenide, diethylselenium, dipropylselenium, diaisopropylselenium, diabutylselenium, diaisobutylselenium, dia-tert-butylselenium, dia-sec-butylselenium, di-phenylselenium, tetramethylselenium, tetraethylselenium, tetrapropylselenium, tetraisopropylselenium, tetrabutyl-selenium, tetraisobutylselenium, tetra-tert-butylselenium, tetra-sec-butylselenium, tetra-phenylselenium, phenylselenium, methylphenylselenium, methylphenylselenide, methylphenolselehium, zinc selenite, di-n-butylphosphane selenide, selenanthrene, selenourea, selenophene, allylphenylselenide, 1,3-dihydro-benzoimid, 2,3-dihydro-3-methyl, 1,1-dimethyl-2-selenourea, diphenyl diselenide, phenylselenyl chloride, benzeneseleninic acid, sodium selenite, benzeneseninic anhydride, potassium selenocyanate, selenourea, sodium hydrogenselenite, 4-chlorobenzeneseleninide, 4-(methylseleno)butyrate, benzyl selenide, alkyl selenium, including dimethylselenide, diethylselenide, dipropylselenide, etc., ally phenyl. selenide, benzeneselenol, benzyl selenide, (phenylselenomethyl)trimethylsilane, potassium selenate, potassium selenite, selenic acid, dibenzyl diselenide, p-tolyl selenide, triphenylphosphine selenium, seleno-DL-methionine, P-tolyl selenide, including analogue, homologue, isomer, and derivative thereof. See Organoselenium Chemistry, Liotta, John Wiley & Sons, N.Y. (1987), incorporated herein by reference.

Non-limiting telluride derivative compounds include: di-n-butylphosphane selenide, selenanthrene, selenourea, selenophene, allylphenylselenide, dimethyltelluride, diethyltelluride, dipropyltelluride, diisopropyltelluride, dibutyltelluride, diaisobutyltel-luride, dia-tert-butyltelluride, dia-sec-butyltelluride, di-phenyltelluride, tetramethyltelluride, tetraethyltelluride, tetrapropyltelluride, tetraisopropyltelluride, tetrabutyltelluride, tetraisobutyltelluride, tetra-tert-butyltelluride, tetra-sec-butyltelluride, tetra-phenyltelluride, phenyltelluride, methyl-phenyltelluride, methylphenoltelluride, zinc selenite, di-n-butylphosphane telluride, diphenyl ditelluride, dimethyltelluride, diethyltelluride, dipropyltelluride, diisopropyltelluride, dibutyltelluride, diisobutyltelluride, di-tert-butyltelluride, di-sec-butyltelluride, di-phenyltelluride, dimethylditelluride, diethylditelluride, dipropylditelluride, diisopropylditelluride, dibutylditelluride, diisobutylditelluride, di-tert-butylditelluride, di-sec-butylditelluride, diphenylditel-luride, including analogue, homologue, isomer, and derivative thereof.

Non-limiting iron derivative compounds include: [cyclopentadienyl]methylcyclopentadienyl iron, ferrocene, methylferrocene, and butadiene iron tricarbonyl, [butadiene iron tricarbonyl]dicyclopentadienyl iron and dicyclopentadienyl iron compounds;ferrocene, methylferrocenes, decamethylferrocene (bis(pentamethylcyclopentadienyl)iron), 1,1'-diacetylferrocene, ferrocenecarboxylic acid, 1,1'-ferrocenecarboxylic acid, ferroceneacetic acid, ferroceneacetronitrile, 1,1'-ferrocene-bis(diphenylphosphine), ferrocenecarbonxaldehyde, ferrocenecarboxylic acid, 1,1'-ferrocenedicarboxylic acid, 1,1-ferrocenedimethanol, ferrocenedimethanol, di-ironnonacarbonyl, di-irondodecacarbonyl, di-ironnonacarbonyl, ironpentacarbonyl, triiron dodecacarbonyl, vinylferrocene, biscyclopentadienyl iron (ferrocene), cyclopentadienyl methylcyclopentadienyl iron, bis(methylcyclopentadienyl)iron, cyclopentadienyl ethylcyclopentadienyl iron, bis(ethylcyclopentadienyl)iron, bis(dimethylcyclopentadienyl)iron, bis(trimethyl-cyclopentadienyl)iron, cyclopentadienyl tert-butylcyclopentadienyl iron, bis(pentamethylcyclopentadienyl)iron, methylcyclopentadienyl ethylcyclopentadienyl iron, bis(hexylcyclopentadienyl)iron, bisindenyl iron, butadiene iron tricarbonyl, dicyclopentadienyl iron, cyclopentadienyl iron (dicarbonyl) (iodide), cyclopen-tadienyl iron (carbonyl) (iodide) (methyltetrahydrofuran), iron(III) ferrocyanide, ammonium hexacyanoferrate(II) hydrate, cyclopentadienyliron dicarbonyl dimer, cyclopentadienyliron dicarbonyl iodide, iron pentacarbonyl, diiron nonacarbonyl, ferroceneacetic acid, ferroceneacetonitrile, ferrocenemethanol, acetylferrocene, including analogue, homologue, isomer, and derivative thereof. Other examples are set forth U.S. Pat. Nos. 2,680; 2,804,468; 3,341,311, The Organic Chemistry of Iron, Koerner, N.Y., Academic Press (1978), incorporated herein by reference.

Non-limiting nickel derivative compounds include: alkyl, aryl, alkyloxy, alkylanol, aryloxy, di/trialkyl, di/triaryl, di/trialkyloxy, di/trialkylanol, di/triaryloxy, and/or cyclomatic complexes, including, biscyclopentadienyl nickel, cyclopentadienyl methylcyclopentadienyl nickel, bis(methylcyclopentadienyl)nickel, bis(triphenylphosphine)dicarbonyl nickel, bis(isopropylcyclopentadienyl)nickel, bisindenyl nickel, cyclopentadienyl nickel nitrosyl, methylcyclopentadienyl nickel nitrosyl, including analogue, homologue, isomer, and derivative thereof.

Non-limiting cobalt derivative compounds include: biscyclopentadienyl cobalt, bis(methylcyclopentadienyl)cobalt, bis(dimethylcyclopentadienyl)cobalt, cyclopentadienyl cobalt, dicarbonyl, cobalt(ous)hexamethylenetetramine, cobalt(ous)hydroxyquinone, cyclopentadienylcobalt dicarbonyl, including analogue, homologue, isomes, and derivative thereof.

Non-limiting zinc derivative compounds include: alkyl zinc, aryl zinc, alkyloxy zinc, aryloxy zinc, dialkyl zinc, diaryl zinc, dialkyloxy zinc, diaryloxy zinc, cyclomatic zinc complexes, including, dimethylzinc, diethylzinc, dipropylzinc, diisopropyl-zinc, dibutylzinc, diisobutylzinc, di-tert-butylzinc, di-sec-butylzinc, di-phenylzinc, zinc acetate, zinc ethoxide, zinc arsenide, zinc hydroxide, zinc selenide, zinc selenite, zinc flouride, zinc chloride, zinc cyanide, zinc floride, zinc chloride, zinc undecylenate, zinc nitrate, zinc acrylate, zinc methacrylate, methyl zinc chloride, isobutylzinc chloride, zinc stearate, zinc dimethyldie-thiocarbamate, di-n-propylzinc, di-o-tolyzinc, isobutyl-zinc chloride, rethylzinc chloride, zinc methacrlate, zinc acrylate, zinc hexaflourosilicate, zinc nitrate, zinc hydroxide, zinc undecylenate, zinc selenite, zinc stearate, zinc cyanide, isobutylzinc chloride, methyl zinc chloride, L(+)lactic acid hemizinc, including analogues, ho-mologues, isomers and derivatives thereof. Corresponding magnesium compounds are contemplated. See Zinc, The Science and Technology of the Metal, Its Alloys & Compounds, Mattewson, N.Y., Reinhold (1959), incorporated by reference.

Non-limiting examples of transition metal derivative compounds, e.g. metals of scandium, titanium, vanadium, chromium, manganese, iron, cobalt, nickel, and their respective chemical groups, include transition metal alkyl, aryl, alkyloxy, aryloxy, and/or ring system type compounds. Multiple alkyl, alkyloxy radicals per metal are contemplate. Cyclomatic transition metal compounds are expressly contemplated. See Organometallic Chemistry of Transition Metals, 2 Ed, Crabtree, John Wiley & Sons, N.Y. (1994), incorporated herein by reference.

Non-limiting examples-of manganese compounds include benzyleyelopentadienyl manganese tricarbonyl; 1.2-dipropyl 3-cyclohexylcyclopentadienyl manganese tricarbonyl; 1.2-diphenylcyclopentadienyl manganese tricarbonyl; 3-propenylienyl manganese tricarbonyl; 2-tolylndenyl manganese tricarbonyl; fluorenyl manganese tricarbonyl; 2.3.4.7-propyflourentyl manganese tricarbonyl; 3-naphthylfluorenyl manganese tricarbonyl; 4.5.6.7-tetrahydroindenyl manganese tricarbonyl; 3-3ethenyl-4,7-dihydroindenyl manganese tricarbonyl; 2-ethyl 3 (a-phenylethenyl) 4,5,6,7 tetrahydroindenyl manganese tricarbonyl; 3-(a-cyclohexylenthenyl)-4.7-dihydroindenyl manganese tricarbonyl; 1,2,3,4,5,6,7,8'-octahydrofluorenyl manganese tricarbonyl and the like. A preferred cyclomatic manganese tricarbonyl is cyclopentadienyl manganese tricarbonyl. A more preferred cyclomatic manganese tricarbonyl is methyl cyclopentadienyl manganese (MMT). Non-limiting examples of acceptable substitutes include the alkyl, aralkyl, aralkenyl, cycloalkyl, cycloalkenyl, aryl and alkenyl groups. The above compounds can be generally prepared by methods that are known in the art. Corresponding compounds of technetium and rhenium (see Canadian Patent #1073207) are contemplated.

Non-limiting nitrogen derivative compounds include: 2-methoxybenzylamine, 2-methoxybenzylamine, 2-(4-methoxybenzylamino)pyridine, nitroanline, 1-nitroanline, 2-nitroanline, 3-nitroanline, 4-nitroanline, niitroanisole, 1-nitroanisole, 2-nitroanisole, 3-nitroanisole, 4-nitroanisole, aniline, 2-anilino-ethanol, anisamide, anisonitrile, acetonitrile, nitromethane, nitroethane, picoline, 1-picoline, 2-picoline, 3-picoline, 4-picoline, tetramethylammoniumhydroxide, tetraethylammoniumhydroxide, N,N,N',N'-tetramethylethylenediamine, toluic hydazide, toluidine, m-toluidine, o-toluidine, p-toluidine, tolunitrile, o-tolunitrile, p-tolunitrile, triazacyclononane, triazole, 1,2,4-triazole, triazine, 1,3,5-triazine, tributylamine, triethanolamine, trimethanolamine, tripropanolamine, trimethoxypyrimidine, 2,4,6-trimethoxypyrimidine, tetramethylammonium, trimethylpyrazine, urea, urazole, guanidine nitrate, guandine acetatic acid, thiophenol, sodium salt thio-phenol, thiourea, cumidine, diphenylamine, m-xylidine, monmel-thylanine, toluidine, amylaminobenzene, ethylaminobenzene, aminophenyl, methyl-o-toluidine, n-butylaminobenzene, n-propylaminobenzene, monoethylaniline, mono-n-propylaniline, ethyldiphenylamine, mono-n-butylaniline, diethylamine, di-n-propylaniline, mono-isoamylaniline, diethylaniline, dimethylaniline, ethylamine, triethylamine, triphenylamine, isopropylnitrite, ammonia, including analogues, homologues, isomers and derivatives thereof.

Non-limiting titanium derivative compounds include: titanium diisopropoxide bis(2,4-pentanedionate), titanium methoxide, titanium ethoxide, titanium(IV) 2-ethylexoxide, titanium isopro-poxide, tetraethylorthotitanate, including analogues, homologues, isomers and derivatives thereof.

Non-limiting zirconium derivative compounds include: zirconium carbide, zirconium propoxide, zirconium ethoxide, decamethylzirconocene, decamethylzirconocene dichloride, bis-cyclopentadienyl zirconium, including analogues, homologues, isomers and derivatives thereof.

Non-limiting molybdenum derivative compounds include: molybdenumcarbonyl, molybdenum hexacarbonyl, tripyridine tricarbonylmolybdenum, molybdenumoxytetrachloride, cyclopentadienyl molybdenum carbonyls, including but not limited to benzenemolybdenumtricar-bonyl, bicycloheptadienemolybdenum tetracarbonyl, cycloheptatrien-molybdenum tricarbonyl, bis-cyclopentadienylbimolybdenum pentacarbonyl, mesitylenemolybdenum tricarbonyl, tropeniummolybdenum tricarbonyl fluoroborate, cyclopentadienylmolybdenum tricarbonyl dimer, methylcyclopentadienylmolybdenum tricarbonyl dimer, anisole molybdenum tricarbonyl, mesitylene molybdenum tricarbonyl, including analogue, homologue, isomers and derivative thereof. See U.S. Pat. Nos. 3,272,606, and 3,718,444, incorporated by reference. Corresponding chromium and tungsten compounds are contemplated in the practice of this invention.

Non-limiting copper derivative compounds include: alkyl copper compounds, bis(ethylenediamine)copper(II) hydroxide, copper carbonate, cyclopentadienyltriethylphosphine copper, diazoaminobenzene (ous), copper acetate, copper acetylacetonate, copper aminoacetate, copper ethylacetate, copper ferrocyanide, copper potassium ferrocyanide, copper nathenate, copper nitrate, copper phosphide, copper phthalate, including analogue, homologue, isomers and derivative thereof. See Copper, The Science and Technology of the Metal, Its Alloys & Compounds, Butts, N.Y., Reinhold (1954), incorporated by reference.

Other contemplated organometallic compounds are metallocenes, non-limiting example compounds include, ferrocene, cobaltocene, nickelocene, titanocene dichloride, zirconocene dichloride, uranocene, decamethylferrocene, decamethylsilicocene, decamethyl-germaniumocene, decamethylstannocene, decamethylphosocene, decamethylosmocene, decamethylruthenocene, decamethylzirconocene, including analogue, homologue, isomers and derivative thereof.

It is to be noted the above list is not exhaustive. The metals and their derivative compounds of this invention include every metal, metalloid, and/or non-metal (herein "metal" or "metallic") capable of acheiving vapor phase combustion, individually or incombination with DMC.

Applicant's invention contemplates wide variation in metal substitution and mixing practice. Thus, it is expressly contemplated the non-lead organo-metallics, non-lead inorganic metallics, and/or their related high heat releasing compounds, including those set forth above may be mixed in varylng proportions, and/or substituted and/or replaced by any non-lead metallic or non-metallic (organic or inorganic [atom, molecule or compound, including those containing nitrogen, sulfur, chlorine, fluorine, helium, neon, argon, krpton, xenon, or radon atoms]) accomplishing the object of this invention.

Derivative compounds and combinations may be entirely or may contain in part or whole non-metal atoms, e.g. nitrogen, sulfur, chlorine, fluorine, helium, neon, argon, krpton, xenon, or radon, etc., so long as primary object of vapor phase combustion is accomplished. It is contemplated said non-metals will employed in varylng proportions within the compound or combination compounds to achieve synergistic improvements in heat releases, burning velocity, thermal efficiency, emissions, power generation, and the like. For example, hexamethylphosphoric triamide, N,N,N',N'-hexamethylsilanediamine, bis(diethylamono)-dimethylsilane may be added as a co-metallic in minor amounts to the composition to further improve vapor phase combustion (e.g further enhancing fuel ecomony or power, etc.).

Ranges vary depending upon the specific metallic, fuels, fuel weight, regulations, advance applications, thermodynamics, and the extent combustion systems are modified to enhance the accelerated low temperature high energy nature of Applicant's invention. Thus, metallic concentrations that maximize combustion velocity and/or the vapor phase combustion object of this invention are expressly contemplated.

Thus, it is contemplated Applicant's metals are substitutents in the fuel, itself, which may also contain certain non-metals and their derivative compounds, including but not limited to nitrogen, sulfur, fluorine, chlorine, helium, neon, argon, krpton, xenon, or radon, in combination with dialkyl carbonates. These non-metals, and their derivative compound, may be employed with or without any other contemplated metals. It is further contemplated to substitute or mix these non-metallics with non-metallics, with metallics, or to mix metallics with mretallics, etc., to achieve synergistic improvements in heat releases, burning velocity, thermal efficiency, emission reductions, power generation, and the like. This is set forth below in the practice of trimethoxymethylsilane. However, it is contemplated that Applicant's fuel also be absent any metal or non-metal. That is, Applicant's invention, by accelerating burning velocity and/or increasing latent heat of vaporization, adn/or reducing combustion temperatures by fuel substituent tailoring, chemical and/or mechanical means, as set forth herein or in my co-pending Applications, said fuel can be employed absent either DMC or a metallic or non-metallic.

In accordance with this invention, Applicant's fuels will contain that amount of at least non-lead metallic, which constitutes a combustion improving amount consistent with the fuel composition, stoichiometry, combustion system, efficiencies, fuel economy and power desired, as well as legal and/or environmental considerations.

It is expressly contemplated that Applicant's metallics be incorporated into liquid fuel systems by means of mutual solvents, mutual dispersents/solvents, colloidal media, suspension media, or other known means, or being separately injected. Metallic's, which are solid at ambiant temperatures may be introduced into the combustor/combustion chamber by liquidification or gasification means.

It is preferred the metallics of this invention be relatively inexpensive to manufacture on a mass production basis.

The metal and concentration amounts are to be optimized, such that vapor phase combustion results. Thus, the metal and its optimum concentration amount, is an amount that results in vapor phase combustion, which is evidenced by improved fuel economy, emissions, power, etc. In the practice of this invention, the ratio of dialkyl carbonates (DMC) by weight to elemental metal weight concentration is equal to or less than 10,000:1 (by parts) to 1:1, including from 1,000,000:1, 100,000:1, 50,000:1, 25,000:1, 15,000:1, 10,000:1, 5,000:1, 1,000:1, 500:1, 300:1, 200:1, 150.1, 100:1, 90:1, 80:1, 75:1, 70:1, 60:1, 50:1, 40:1, 30:1, 20:1, 10:1, 5:1 to 3:1, or interval ratio contained therein (e.g. 50:1 to 30:1) and also 1:1 to 1:20, or other ratio that maximizes vapor phase combustion.

Metallic salts may be employed in fuels at 0.01 to 4000.0 parts metallic per million fuel, 1.0 to 150 ppm metallic being contemplated, with concentrations equal or less than 50.0, 40.0, 30.0, 20.0, 16.0, 10.0, 5.0 ppm metallic also contemplated. Other salt concentrations will vary from 0.10 to 75.0 ppm metal per million, from 30.0 to 2000.0 per million, from 25 to 750 parts metallic or salt per million fuel. In the application of Applicant's invention elemental metal concentrations from 3.0 to 500.0 ppm metal are expressly contemplated and desirable. Concentrations outside these ranges are contemplated.

It has been found that higher oxygen weight concentrations in fuel compositions, particularly with higher concentrations of enhanced combustion properties, permit higher acceptable metallic concentrations. Higher average fuel densities are also associated with higher acceptable metallic concentrations and higher exhaust velocities, and are preferred. Engine combustion thermal dynamics and stoichiometry dictate upper metallic limits.

As noted above, elemental metallic concentrations will vary substantially. Non-limiting examples include elemental metallic concentrations equal to or greater than 1/64 grams/gal, preferably 1.0 or more grams/gal, more preferably 10 or more grams/gal, even up to 90 grams/gal. Indeed, in advance aviation, rocket and/or propellant applications, elemental metal concentrations can be on the order of 100 to 1000 or more grams/gal, especially in hypergolic conditions. Concentrations above these ranges are also contemplated. All combustion improving or stoichiometric amounts of elemental metal are contemplated, which maximize combustion so long as the resultant fuel's burning velocity increases compared to fuel absent metallic.

Thus, metallic concentrations that maximize combustion velocity and/or other objects of this invention are expressly contemplated. Ranges will vary depending upon the specific metallic, its concentration, concentration and type of dialkyl carbonate, concentration and nature of hydrocarbon fuel composition, including its density, the intended application, relevant thermodynamics, extent combustion systems are modified to enhance the accelerated low temperature high energy nature of Applicant's invention, environmental regulation, and the like. Metallics used in the fuel compositions of the present invention should be fuel soluble generally having melting and boiling ranges compatible with liquid hydrocarbons, or be incorporated into liquid fuel systems by means of mutual solvents, dispersants, or other means, as required. Alternatively, the metallics may be introduced into the combustor/combustion chamber of liquide or gaseous fuels (e.g. natural gas) by separate means, including separate injection, liquidification or gasification, colloidal media, suspension media. Metallics may be introduced into the combustor in an atomized, vaporized, or gasified form, separately and/or in combination with the other ingredients of the invention.

In solid fuel applications, the metallic may be introduced as a solid. In hybrid applications, it may be introduced as either as solid, liquid or gas, together with the balance of the invention's ingredients. Most preferably, the metallic is employed as a propellant or co-propellant, or jointly together with a propellant. Hydrogen content of the metallic and/or metallic containing fuel should be maximized to the extent possible.

It is preferred practice that metals herein have oxides whose heats of formation are negative, and should be equal or exceed (e.g. be more negative) about −10,000 to −75,000 calories/mole. More preferred are those equal or exceeding −100,000 to −400,000 gr calories/mole, and greater (more negative). Acceptable simple oxides containing one or two oxygens may have heats of formation equal or exceeding −50,000 to −200,000, or greater, calories/mole.

It is also desirable the element metal employed in this invention be of a low relative molecular weight. Acceptable metals have molecular weights of 100 or less, preferably 79 or less, more preferably 40 or less, and most preferably 30 or less.

Applicant's fuel may include gaseous and solid metals and/or their related compounds. It is preferred the combustion products of the metals be environmentally friendly, e.g. low or no toxicity. Potassium, sodium, magnesium, lithium, born, silicon, sodium, iron, copper, calcium, aluminum, and phosphorus are acceptable. Potassium, sodium, magnesium, lithium, born, silicon, sodium, iron, and phosphorus are also acceptable. The related high energy combustible compounds of these metals are beleive to be environmentally friendly.

Applicant's metals also include a full range of combustion catalysts including ferrous picrate, potassium salts, Li and LH promoters. As presented below trimethoxymethylsilane has immediate application in instant invention and is preferred.

As noted, Applicant's invention, by accelerating burning velocity and/or reducing combustion temperatures by fuel substituent tailoring, chemical anrd/or mechanical means as set forth in above PCT Applications, can be employed absent a metallic.

Any example or disclosure of Mn may be substituted for any metal or derivative compound set forth in herein, under proviso said metallic causes vapor phase combustion. Likewise, wide latitude in metal substitution is contemplated. Thus, any metal, metalloid, or non-metal, may be substituted with any other in a particular metallic compound. That is not to say substitution is blind, but rather if the element is likely to be advantageously impacted, it may be substituted. Thus, non-leaded elements and-their compounds, may be freely substituted for one another, herein.

It is preferred that metals in the fuel composition of the present invention, including oxygenated metallic compounds, contribute to the fuel's heat of vaporization, its burning velocity, post ignition and pre-combustion temperatures which enhance generation and combustion of free radicals, thermal stability at ambient temperature, and have high heat and energy releasing characteristics, etc.

Metallic Catalyst Practice

In the practice of this invention, it has been found that combustion activity employlng Applicant's dialkyl carbonates and metallics, which together yield vapor phase combustion, can be improved by the addition of trimethoxymethylsilane or substitute. As contemplated herein any reference to trimethoxymethylsilane ("TMMS") or metallic catalyst in the specification or examples herein contemplates TMMS substitution, as set forth below.

Applicant has discovered TMMS to be a catalyst, when in combination with a large population of metallics disclosed herein, and acts to benefically improve the overall results of this invention.

TMMS is a desireable co-metallic of this invention. Its use is contemplated with a majority of the metallics, which may be utilized in the practice of this invention, including cyclomatic metallics, alkali metal alkanols, inorganic metallics such as the metallic hexacyanides, etc. Thus, it is an embodiment herein that disclose to any metallic also includes TMMS as a co-metallic.

Non-limiting examples of TMMS substitutes include those compounds, including metallic and non-metallic organics, whose structure is similar to TMMS's, thus including derivative, analogue, homologue and isomers of TMMS. Other subsitutes are also. contemplated. Specific non-limiting examples include, ethoxytrimethylsilane, isobutyltriethoxysilane, tetramethylsilane, dimethoxy-methyl-vinyl-silane, methyltriethoxysilane, 3-aminopropyltriethoxysilane, 3-aminopropyl-trimethoxysilane, vinyltrimethoxysilane, diethoxydimethylsilane, dimethoxydimethylsilane, vinyltris (2-butyldenaminooxy)silane, tetraalkyloxysilanes (e.g. tetramethoxysilane, tetraethoxysilane, tetrapropyloxysilane, tetraisopropylsilane, tetraisobutylsilane, etc.), dialkylphosphites (e.g. dimethylphosphite, dipropylphosphite, diethylphosphite, dibutylphosphite, di-tert-butylphosphite, etc.), trialkylphosphites (e.g. trimethylphosphite, triethylphdsphite, triisopropylphosphite, tributylphosphite), dimethylmethylphosphonate, diethylmethylphosphonate, potassium pryophosphite, trimethylorthoacetate, triethylorthoacetate, trimethylorthobutyrate, triethylorthobutyrate, trimethylorthovalerate, trimethylorthoformate, including homolgues, analogues, isomers, and derivatives thereof.

The examples of aforementioned PCT Applications are incorporated herein and are optionally modified for pH limitation, non-manganese metallics, and addition of a co-metallic catalyst. They are also optionally modifed for the viscosity, burning velocity, and enthalpy of vaporization limitations contained either therein or herein.

A vapor phase method of the present invention for combusting a metallic includes the steps of introducing kinetic free radicals into a combustor from a dialkyl carbonate (dimethyl carbonate); igniting and combusting a flammable metallic or metal compound in presence of said free radicals at temperature below said metal's oxide boiling point and preferably above said metal or metallic compound's boiling point; combusting said metal; whereby accelerated burning occurs, evidenced by a brilliant luminous reaction zone extending some distance from the metal's surface; and wherein metallic oxide particles resulting from combustion range in low to submicron range and/or remain in a gaseous state. Contemplated metallics include all non-lead metals and their related compounds whose combustion product has negative high heat of formation. As provided herein metals also refer to non-metals. Contemplated compounds of said elemental metals are those with have high heats of combustion. Metallics may be organo-metallics or inorganic compounds.

By way of further example, a fuel composition of the present invention may include a combustion improving amount of a lower dialkyl carbonate; a combustion improving amount of at least one high heating (exceeding 2,000 to 8,000 to 12,000, or more, Kcal/kg) combustible compound containing at least one element selected from the group consisting of aluminum, boron, bromine, bismuth, beryllium, calcium, cesium, chromium, cobalt, copper, francium, gallium, germanium, iodine, iron, indium, lithium, magnesium, manganese, molybdenum, nickel, niobium, phosphorus, potassium, palladium, rubidium, sodium, tin, zinc, praseodymium, rhenium, silicon, vanadium, strontium, barium, radium, scandium, yttrium,lanthanum, actinium, cerium, thorium, titanium, zirconium, hafium, praseodymium, protactinium, tantalum, neodylum, uranium, tungsten, promethium, neptunium, samarium, plutonium, ruthenium, osmium, europium, americium, rhodium, iridium, gadolinium, curium, platinum, terbium, berkelium, silver, gold, dysprosium, califorhium, cadmium, mercury, holmium, titanium, erbium, thulium, arsenic, antimony, ytterbium, selenium, tellurium, polonium, lutetium, astatine, mixture thereof, including organic and inorganic derivatives (as set forth above). Said fuel optionally containing hydrogen or a viscous hydrocarbon base fuel, an oxidizer, or a co-metallic catalyst (as set forth above). Said fuel further characterized as having a pH of 10.5 or less. When this fuel composition contains a hydrocarbon base, said base may have a viscosity outside normal industry standards (as set forth above). However, resultant fuel's viscosity is to be within industry standards. Said result fuel is characterized as being a vapor phase composition wherein a luminous reaction zone extends from surface of said element, typically-evidenced by increased fuel economy, range, thrust, emissions, or power, as compared to the hydrocarbon base alone.

By further example, a method is contemplated for minimizing hydrolysis of a fuel compositions comprising the steps of: providing or introducing a symmetrical lower dialkyl carbonate to a combustion improving amount of at one least-metal or non-metal as set forth above (combustible compound) containing at least one element selected from the group consisting of aluminum, boron, bromine, bismuth, beryllium, calcium, cesium, chromium, cobalt, copper, francium, gallium, germanium, iodine, iron, indium, lithium, magnesium, manganese, molybdenum, nickel, niobium, phosphorus, potassium, palladium, rubidiurm, sodium, tin, zinc, praseodymium, rhenium, silicon, vanadium, strontium, barium, radium, scandium, yttrium, lanthanum, actinium, cerium, thorium, titanium, zirconium, hafium, praseodymium, protactinium, tantalum, neddylum, uranium, tungsten, promethium, neptunium, samarium, plutonium, ruthenium, osmium, europium, americium, rhodium, iridium, gadolinium, curium, platinum, terbium, berkelium, silver, gold, dysprosium, californium, cadmium, mercury, holmium, titanium, erbium, thulium, arsenic, antimony, ytterbium, selenium, tellurium, polonium, lutetium, astatine, mixture thereof, including their organic and inorganic derivative compounds, then adding a hydrocarbon, including those whose viscosity is greater than acceptable industry standards; mixing said carbonate, said combustible compound, and said hydrocarbon so as to produce a fuel composition having a pH of less than 11 (more preferrable ranges set forth above), which has acceptable viscosities, can be stored at average temperatures of 95° F. or 65° F. for up to 6 or 9 months, absent hydrolysis, and which is a vapor phase composition having upon combustion a luminous reaction zone that extends from surface of said combustible compound/element.

Those skilled in the art will appreciate that many variations and modifications of the invention disclosed herein may be made without departing from the spirit and scope thereof.

What is claimed:

1. A fuel composition comprising: a combustion improving amount of dimethyl carbonate, a combustion improving amount of at least one combustible compound containing at least one element selected from the group consisting of aluminum, boron, bromine, bismuth, beryllium, calcium, cesium, chromium, cobalt, copper, francium, gallium, germanium, iodine, iron, indium, lithium, magnesium, manganese, molybdenum, nickel, niobium, phosphorus, potassium, palladium, rubidium, sodium, tin, zinc, praseodymium, rhenium, silicon, vanadium, strontium, barium, radium, scandium, yttrium, lanthanum, actinium, cerium, thorium, titanium, zirconium, hafium, praseodymium, protactinium, tantalum, neodylum, uranium, tungsten, promethium, neptunium, samarium, plutonium, ruthenium, osmium, europium, americium, rhodium, iridium, gadolinium, curium, platinum, terbium, berkelium, silver, gold, dysprosium, californium, cadmium, mercury, holmium, titanium, erbium, thulium, arsenic, antimony, ytterbium, selenium, tellurium, polonium, lutetium, astatine, mixture thereof, including organic and inorganic derivatives; optionally hydrogen or a hydrocarbon base fuel; wherein said fuel composition has a pH of from 4.5 to 10.5 and is a vapor phase composition characterized upon combustion as having a luminous reaction zone extending from surface of said element, and wherein the combustible compound is selected from the group consisting of cyclopentadienyl manganese tricarbonyl, [2-(cyclohexenyl)ethyl]tri-ethoxy-silane, cyclohexenyl dimethoxymethylsilane, benzyltrimethylsilane, N-(3-(trimethoxysilyl)propyl)ethylenediamine, N-1-(3-(trimethoxysilyl)propyl)diethylenetriamine, N-(3-(trimethoxysilyl)propyl) ethylenediamine, 1-(tri-methyl(silyl)pyrrolidine, triphenylsilanol, octamethyltrisiloxane, 2,2,4,4,6,6-hexamethylcyclotrisilazane, hexamethylcyctrisiloxane, hexamethyldisilane, 1,1,1,3,3,3-hexamethyl disilazane, hexamethyldisiloxane, hexamethyldi-silthiane, allyltributylsilane, tetraalkylsilanes, 3-aminopropyltriethoxy-silane, benzytrimethylsilane, benzytriethylsilane, N-benzyltrimethylsilyl-amine,diphenylsilanediol, dihexylsilanediol, (trimethylsilyl) cyclopentadi-ene, potassium hexacyanoferrate(II), potassium hexacyanoferrate(III), potassium hexacyanocobalt II-ferrate, potassium hexacyanocobalt, potassium sodium ferricyanide, potassium ethoxide, and mixtures thereof.

2. The fuel composition of claim 1, wherein the pH is less than 9.5.

3. The fuel composition of claim 1, wherein the pH is less than 8.0.

4. The fuel composition of claim 1, wherein the pH is from 6.3 to 6.8.

5. The composition of claim 1 further comprising a cometallic catalyst, selected from group consisting of trimethoxymethylsilane, ethoxytrimethylsilane, isobutyltriethoxysilane, tetramethylsilane, dimethoxy-methyl-vinylsilane- , methyltriethoxysilane, 3-aminopropyltriethoxysilane, 3-aminopropyl-trimethoxysilane, vinyltrimethoxysilane, diethoxydimethylsilane, dimethoxydimethylsilane, vinyltris(2-butyl-denami- nooxy) silane, tetramethoxysilane, tetraethoxysilane, tetrapropyloxysilane, tetraisopropylsilane, tetraisobutylsilane, dimethylphosphite, dipropylphosphite, diethylphosphite, dibutylphosphite, di-tert-butyl-phosphite, trialkylphosphites trimethylphosphite, triethylphosphite, triisopropylphosphite, tributylphosphite), dimethylmethylphosphonate, diethylmethylphosphonate, potassium pryophosphite, trimethylorthoacetate, triethylorthoacetate, trimethylorthobutyrate, triethylorthobutyrate, trimethylorthovalerate, trimethylorthoformate, including homolgues, analogues, isomers, derivatives, and mixture thereof.

6. The composition of claim 1, wherein the fuel composition comprises an aviation turbine hydrocarbon base having a viscosity equal or exceeding 8.1 MM2/S, and the fuel composition is characterized as being acidic not exceeding equivalent of 0.1 mg KOH/g.

7. The composition of claim 1, wherein the fuel composition is a diesel fuel oil, the hydrocarbon base fuel has a viscosity equal to or greater than 2.5, MM2/S at 40° C., and the fuel composition has a pH less than 10.5 and a viscosity equal to or less than 2.4 MM2/S at 40° C.

8. A fuel composition of claim 1, wherein said composition is a gasoline, characterized as having a pH less than 10.5, with a maximum Reid Vapor Pressure of 12.0 psi, a maximum of 12% olefins, a maximum of 30% aromatics, a maximum of 2.0% benzene, a maximum of 50 ppm sulfur or sulfur free, a total $O_2$ concentration ranging from 0.5% to 10.0% wt of dimethyl carbonate, a combustible metal or non-metal selected from group consisting of cyclopentadienyl manganese tricarbonyl, [2-(cyclohexenyl)ethyl]tri-ethoxysilane, cyclohexenyl dimethoxymethylsilane, benzyltrimethylsilane, N-(3-(trimethoxysilyl)propy- l)ethylenediamine, N-1-(3-(trimethoxysilyl)propyl)di-ethylenetriamine, N-(3-(trimethoxysilyl)propyl)ethylenediamine, 1-(trimethyl(silyl)-pyrroli- dine, triphenylsilanol, octamethyltrisiloxane, 2,2,4,4,6,6-hexamethylcyclo-trisilazane, hexamethylcyctrisiloxane, hexamethyldisilane, 1,1,1,3,3,3-hexamethyl disilazane, hexamethyldisiloxane, hexamethyldisilthiane, allyltributylsilane, tetraalkylsilanes, 3-aminopropyltriethoxy-silane, benzytrimethylsilane, benzytriethylsilane, N-benzyltrimethylsilyl-amine, diphenylsilanediol, dihexylsilanediol, trimethylsily)cyclopentadiene, potassium hexacyanoferrate(II), potassium hexacyanoferrate(III), potassium hexacyanocobalt II-ferrate, potassium hexa-cyanocobalt, potassium sodium ferricyanide, potassium ethoxide, or mixture, a maximum T-90 temperature of 330° F. to 280° F., a T-50 temperature of approx. 170° F. to 230° F., a minimum (R+M)/2 octane of 85 to 92, a bromine number of 20 or less, an average latent heat of vaporization of 880 to 920 BTU/gal at 60° F., a heating value greater than 106,000 btu/gal at 60° F.

* * * * *